US006108502A

United States Patent [19]

Kawada et al.

[11] Patent Number: 6,108,502

[45] Date of Patent: Aug. 22, 2000

[54] PHOTOSENSITIVE MEMBER TO BE USED FOR IMAGE-FORMING APPARATUS AND IMAGE-FORMING APPARATUS COMPRISING SUCH PHOTOSENSITIVE MEMBER AS WELL AS IMAGE FORMING PROCESS

[75] Inventors: Masaya Kawada, Nara; Takaaki Kaya, Mishima; Tetsuya Karaki, Shizuoka-ken, all of Japan

[73] Assignee: Canon Kabushiki Kaisha, Tokyo, Japan

[21] Appl. No.: 09/301,579

[22] Filed: Apr. 29, 1999

[30] Foreign Application Priority Data

Apr. 30, 1998 [JP] Japan ..... 10-121168

[51] Int. Cl.[7] ..... G03G 15/00

[52] U.S. Cl. ..... 399/159; 430/56; 430/84

[58] Field of Search ..... 399/159; 430/56, 430/80, 84; 428/446, 450

[56] References Cited

U.S. PATENT DOCUMENTS

| | | | |
|---|---|---|---|
| 3,966,469 | 6/1976 | Kuroda et al. | 430/80 |
| 4,748,474 | 5/1988 | Kurematsu et al. | 355/15 |
| 5,045,424 | 9/1991 | Rimal et al. | 430/126 |
| 5,106,710 | 4/1992 | Wang et al. | 430/42 |
| 5,262,259 | 11/1993 | Chou et al. | 430/47 |

*Primary Examiner*—Quana Grainger
*Attorney, Agent, or Firm*—Fizpatrick, Cella, Harper & Scinto

[57] ABSTRACT

A photosensitive member to be used for an image-forming apparatus can effectively suppress its wettability of the surface relative to foreign objects adhering to it and reduce the load and the mechanism necessary for cleaning the surface so as to prolong the service life of the photosensitive member and make the apparatus adapted to down-sizing. For this purpose, the wettability (W: work of adhesion) of the surface of the photosensitive member relative to toner is confined to be between 60 and 110 mN/m.

17 Claims, 18 Drawing Sheets

PHOTOSENSITIVE MEMBER TO BE USED FOR IMAGE-FORMING APPARATUS AND IMAGE-FORMING APPARATUS COMPRISING SUCH PHOTOSENSITIVE MEMBER AS WELL AS IMAGE FORMING PROCESS

BACKGROUND OF THE INVENTION

1. Field of the Invention

This invention relates to a photosensitive member to be used for an image-forming apparatus and also to an image-forming apparatus comprising such a photosensitive member as well as to an image forming process. More particularly, it relates to a photosensitive member to be used for an image-forming apparatus adapted to electrostatically charge the surface of its photosensitive member operating as image carrier, writing video information on the electrostatically charged surface by means of a beam of visible light or a linear-scanning laser beam and forming an image typically by means of toner and comprising a cleaning means for clearing the surface potential of the photosensitive member after transferring the toner image. It also relates to an image-forming apparatus comprising such a photosensitive member as well as to an image forming method using such a photosensitive member.

More specifically, the present invention relates to a photosensitive member to be used for an image-forming apparatus having specific surface characteristics including, in particular, the wettability (W) of the photosensitive member relative to the adherers of the surface thereof drawn out from the amount of surface free energy ($\gamma$) to thereby control the foreign objects such as toner adhering to the surface and make it apt to form images with a good image quality for a prolonged period of time regardless of fluctuations of environmental factors including moisture and temperature. It also relates to an image-forming apparatus comprising such a photosensitive member as well as to an image forming method using such a photosensitive member.

2. Related Background Art

Currently available image-forming apparatus, electrophotographic apparatus in particular, include printers operating as output means of computers and word processors that have been finding an ever-increasing demand in recent years, as well as copying machines. Since such appratus are operated in a variety of operating environments, they are more often than not provided with means for stabilizing the output image such as means for eliminating the influence of fluctuations of environmental factors on the density of the output image. In addition, such printers are required to be low cost and maintenance free particularly because they are used not only for office applications but also for home or personal applications.

Still additionally, such printers are required to be friendly to the environment from the ecological point of view and hence should be adapted to print on the opposite surfaces of a sheet of copy paper, which may be recycled paper, and reduce the consumption rate of paper and electric power.

FIG. 1 of the accompanying drawings is a schematic block diagram of an image-forming apparatus, illustrating the image-forming process of a copying machine.

Referring to FIG. 1, reference numeral 101 denotes a photosensitive member of the image-forming apparatus to be used with an electrophotographic system (hereinafter simply referred to as "photosensitive member"), which is surrounded by a principal corona unit 102, an electrostatic latent image forming site 103, a developing unit 104, a copy paper feeding system 105, a transfer corona unit 106*a*, a separation corona unit 106*b*, a cleaner unit 107, a delivery system 108 and a conditioning light source 109 arranged clockwise in FIG. 1. If necessary, the photosensitive member 101 may be provided with a circumferential internal surface heater 125 for controlling the temperature of the photosensitive member 101.

The surface of the photosensitive member 101 is uniformly and electrostatically charged by the principal corona unit 102 and, in operation, exposed to light at the electrostatic latent image forming site 103 to form an electrostatic latent image thereon.

The electrostatic latent image is then turned into a visible toner image by the developing sleeve of the developing unit 104 that carries toner on the surface.

Meanwhile, copy paper P is fed from the copy paper feeding system 105 as it is guided by a copy paper guide 119 and its leading edge is registered by register rollers so that the toner image formed on the surface of the photosensitive member 101 is transferred onto the copy paper P by means of the transfer corona unit 106*a*. Then, the copy paper P is separated from the photosensitive member 101 by means of the separation corona unit 106*b* and/or a separation means such as a separation pawl (not shown) and subsequently the toner image on the surface of the paper is moved to a fixing unit 123 by means of the delivery system 108, where the toner image is fixed by fixing rollers 124 arranged in the fixing unit 123 before it is delivered to the outside of the image-forming apparatus.

On the other hand, after the toner image is transferred to the copy paper P, the surface of the photosensitive member 101 is cleaned by a cleaning blade 120 and a cleaning roller (or brush) 121 arranged in the cleaning unit 107 to remove the residual toner and the fine particles of paper adhering to the surface in order to make it ready for the next copying cycle.

As described above, an image-forming apparatus adapted to repeat the cycle of operation of forming a toner image on the surface of a photosensitive member and transferring the toner image onto a copying material such as copy paper needs to be provided with a cleaning means for removing the foreign objects remaining on the surface of the photosensitive member including the residual toner after transferring the toner image.

Such a cleaning unit 107 typically comprises a cleaning blade made of rubber or resin and a cleaning brush made of resin fiber. The powdery magnetic objects remaining on the surface of the photosensitive member such as the residual toner may alternatively be removed by means of magnetic adsorption.

Now, such a cleaning unit and cleaning means that can be used for the unit will be described below by referring to FIG. 2 of the accompanying drawings.

FIG. 2 is a schematic view of a cleaning unit that can be used for the image-forming apparatus of FIG. 1.

Cleaning means that can be used for the cleaning unit 301 of FIG. 2 may comprise a cleaning blade 302 made of urethane rubber, a cleaning roller 303 made of silicon rubber, sponge or a magnetic material, a doctor roller 304, a waste toner pool 305 and a waste toner delivery system 306.

The doctor roller 304 may be arranged whenever necessary and show a blade-like shape. Then, it will be referred to as scraper (or doctor blade).

For the purpose of simplification, the scraper will be omitted from the following description of the components of the cleaning unit.

Referring to FIG. 2, reference numeral 301 denotes a cleaning unit comprising a cleaning blade 302 made of a material obtained by mixing urethane rubber and one or more than one silicon compounds to make it show appropriate elasticity and hardness.

A cleaning roller 303 made of a magnet is arranged at an upstream position (lower position in FIG. 2) relative to the cleaning blade 302 in the sense of rotation of the photosensitive member. The cleaning roller 303 attracts powdery magnetic materials including the toner by its magnetic force and hence comes to be coated with the adherers. Thus, the coat of the powdery magnetic materials abuts the surface of the photosensitive member with an appropriate abutting width (referred to as "nipping width") and is made to scrub the surface of the photosensitive member at a predetermined relative speed.

While the cleaning roller 303 is made of a magnet in the above description, it may alternatively be a roller that is biased with the polarity opposite to that of the toner or made of silicon rubber of spongy resin.

Still alternatively, the cleaning roller 303 may be replaced by a brush-shaped member made of a material selected appropriately by taking the hardness of the photosensitive member and the processing speed of the image-forming apparatus.

When the brush is used with a photosensitive member showing a high surface hardness such as an a-Si type photosensitive member, it may be a chemical fiber brush made of polyethylene or polystyrene or a brush made of electroconductive fiber obtained by adding carbon to chemical fiber in order to provide the fiber with an desired level of electroconductivity or fiber of amorphous metal (e.g., "BOLFUR": tradename, available from Unitika).

The nipping width of the photosensitive member 101 and the cleaning roller or the cleaning brush is desirably held to a constant value in order to realize a constant cleaning performance and prevent any problem such as an abraded photosensitive member due to excessive local abutment from occurring.

The mechanism for holding the cleaning roller or the cleaning brush in abutment with the photosensitive member 101 may be realized by using small rollers held in abutment with the photosensitive member in an area other than the image-forming site or by pushing the roller against the photosensitive member under a predetermined level of pressure. In the case of a cleaning roller made of a magnetic material, a constant nipping width can be realized by regulating the thickness of the toner coat.

The cleaning unit may also be realized by removing part of the above components or using one or more than one additional components.

FIGS. 3A through 3D of the accompanying drawings illustrate how a cleaning operation is repeated for an image-forming apparatus of the type under consideration.

Now, the cleaning operation will be described by referring to FIGS. 3A through 3D. Note that the photosensitive member 101 is made to show a straight surface (with no radius of curvature) for the purpose of simplicity.

Step 1

As the photosensitive member 101 with which the cleaning unit 301 is held in abutment is driven to rotate at a predetermined rate of revolution. In the step of operation of FIG. 3A, the surface of the photosensitive member 101 moves from left to right to come closer to the cleaning blade 302.

The photosensitive member 101 carries on the surface thereof a toner image formed by said steps of electrostatically charging the surface, forming a latent image thereon and developing the latent image.

The adherers 3001 including the toner that has not been transferred to the copying paper and pieces of rosin and talc are also brought closer to the cleaning unit as they are forced to adhere to the surface of the photosensitive member by electrostatic force, inter-molecular force, frictional force and other force that makes them adherent.

If necessary, the photosensitive member is held to a predetermined temperature level.

As described above, the cleaning unit may not comprise a cleaning roller 303 (or a cleaning brush, which will not specifically be mentioned hereinafter).

When the cleaning blade 302 is used at the site of abutment with the surface of photosensitive member, powder may often be applied to it to provide a lubricating effect. In the step of FIG. 3A, part of the collected waste toner or the toner held to the cleaning roller by an appropriate means is appropriately supplied for use from the cleaning roller 303 by way of the toner pool 307.

Step 2

If the cleaning unit comprises a cleaning roller 303, the above described adherers 3001 including the residual toner are scrubbed and scraped or sucked by the cleaning roller 303 for collection. The adherers 3001 are then taken up into the cleaning roller 303 (FIG. 3B).

Step 3

The adherers 3001 that include the residual toner and are taken up by the cleaning roller 303 are then partly collected by an appropriate mechanism such as a doctor roller 304 (or a doctor blade, which will not specifically be mentioned hereinafter). The collected adherers 3001 including the residual toner are then fed to the toner pool 305 within the cleaning unit 301 (FIG. 3C).

As described above, the residual toner may be discharged from the cleaning roller 303 at an appropriate rate from the viewpoint of lubricating effect of the cleaning blade 302 on the photosensitive member.

The collected toner is then moved into a waste toner container (not shown) by way of the waste toner delivery system 306.

Alternatively, the collected toner may be screened and the screened toner may be partly or mostly reused.

Step 4

The adherers 3001 including the residual toner not collected by the cleaning roller 303, the residual toner in case of a system not comprising a cleaning roller 303 or the residual toner left after the discharge of toner from the cleaning roller are brought closer to the cleaning blade 302 as they remain adhering to the surface of the photosensitive member 101. Then, the residual toner and other adherers are scraped off and collected typically by the cleaning blade 302 of the cleaning unit 301.

The collected toner is then moved to a waste toner storage container (not shown) by way of the waste toner delivery system 306 comprising a screw and delivered further away (FIG. 3D).

The waste toner storage container may be arranged at a position (not shown) within the image-forming apparatus or, alternatively, incorporated in the cleaning unit when the image-forming apparatus is a cartridge type laser beam printer (LBP).

The electrostatic latent image that is left on the surface of the photosensitive member is erased by a conditioning light source 109 (see FIG. 1).

As described above, the cleaning roller 303 may be replaced by a cleaning brush that is held in abutment with the surface of the photosensitive member to scrape off various adherers from the latter.

As alternative, there has been proposed the use of a magnetic cleaning roller made of a magnetic material, a cleaning roller biased with the polarity opposite to that of the toner or a cleaning roller made to show properties opposite to those of the toner, which is made to collect the residual toner on the surface of the photosensitive member in a non-contact way or as it is brought to contact directly with the surface of the photosensitive member or indirectly therewith by way of the toner already sucked by and deposited onto the surface thereof.

Such devices (cleaning blade, cleaning brush, cleaning roller, etc.) are selectively arranged within the cleaning unit and used independently or in combination so as to effectively remove foreign objects and powder of the toner from the surface of the photosensitive member.

As pointed out earlier, an increasing number of image-forming apparatus are being used under various different operating conditions including a well air-conditioned environment and extending between a low temperature/light moisture setting and a high temperature/heavy moisture setting.

In view of the use in a particularly harsh environment, there is a strong demand for image-forming apparatus that operate electrophotographically stably without giving rise to problems such as a poor cleaning performance and adhesion of molten toner so as to make them meet the requirement of maintenance free and a long service life.

Thus, image-forming apparatus using an electrophotography system are required to stably provide clear and high quality images for a prolong period of time regardless of environmental variations as they find more and more personal applications with diversified operating environment. Additionally, they have to meet the requirement of down-sizing and cost reduction.

In order for an image-forming apparatus to provide clear and high quality images for a prolonged period of time, then it is necessary to precisely control the latent image and uniformly clean the surface of the photosensitive member. Additionally, the cleaning unit of the image-forming apparatus has to be down-sized and comprise a reduced number of components that are simply configured.

However, as the cleaning system is simplified and made to show a long service life, there arises a problem that the residual toner is, if partly, not removed by the cleaning blade 302 and other members and remains on the surface of the photosensitive member.

The remaining adherers will then be subjected to the steps from the electrostatically charging step on for more than once.

Additionally, the adherers remaining on the surface of the photosensitive member can be spread over a wider area of and/or laid higher from the surface of the photosensitive member as they are scraped by the cleaning blade 302 and the cleaning brush or the cleaning roller 303 and also by the copying material (not shown) and/or the heat existing on the surface.

Furthermore, as the above steps are repeated, additional foreign objects may adhere to the surface to increase the area and the height of the adherers.

Thus, the adherers that are not removed from the surface of the photosensitive member by the cleaning unit gradually grow until they eventually become visually recognizable black spots on the images produced by the apparatus.

Particularly, if the image-forming apparatus is used after a long pause, the toner and the debris of paper collected in the cleaning unit (hereinafter referred to collectively as the collected toner) are often found to have agglomerated within the unit.

If the collected toner is not found to have agglomerated when the apparatus is used after a long pause, the residual toner located near the contact point or line of the surface of the photosensitive member and the cleaning unit and the collected toner can often become agglomerated as the temperature rises near the photosensitive member of the apparatus to consequently raise the temperature of the toner.

Particularly, in an image-forming apparatus provided with a heater for regulating the surface temperature of the photosensitive member, the toner found on the surface of the photosensitive member and the cleaning unit can become agglomerated to give rise to a phenomenon referred to as blocking phenomenon that damages the cleaning means of the cleaning unit including the cleaning blade and the cleaning roller by the temperature rise in the initial stages of the image-forming operation conducted after a long pause.

Additionally, as the adhering toner grows, there arise a number of problems to the cleaning unit such as damaged cleaning members including a chipped or burred cleaning blade and a cleaning roller having one or more than one grooves formed on the surface, a vibrating cleaning blade and an uneven nipping width extending between the cleaning roller and the photosensitive member and along the axis of the photosensitive member. Such problems can give rise to an abnormally cleaned condition on the part of the surface of the photosensitive member.

Then, the surface of the photosensitive member shows "defective cleaning", which is far from a satisfactorily cleaned state.

Defective cleaning by turn can give rise to disadvantageous phenomena such as "black streaks" of toner produced by a chipped cleaning blade, "filming" that makes the entire surface of the photosensitive member thinly coated with toner and "fusion" of toner that produces black spots on the image.

Additionally, both the coat of toner on the surface of the cleaning roller and the pressure of the cleaning roller applied to the photosensitive member can show local unevenness to make the surface of the photosensitive member become scraped unevenly.

Then, rays of light striking the photosensitive member can be refracted unevenly to give rise to interference, which by turn produces local variations in the effective quantity of light entering the photoconductive layer of the photosensitive member and hence an uneven image density.

These and other phenomena degrade the quality of image and make some of the components of the photosensitive member and the cleaning unit require frequent servicing and even replacement so that the image-forming apparatus as a whole becomes far from maintenance free.

Various techniques have been proposed and are currently used in order to eliminate such problems by completely removing the foreign objects adhering to the surface of the photosensitive member. Known techniques include the following:

(1) a technique of controlling the pressure (abutment pressure) under which the cleaning member such as the cleaning blade, the cleaning brush or the cleaning roller is made to abut the photosensitive member;

(2) a technique of selecting an optimal relative speed of the cleaning member and the photosensitive member and using an optimal material for the cleaning member to improve the effect of scraping the adherers;

(3) a technique of modifying the surface profile of the cleaning roller typically by forming a helical groove on the surface; and (4) a technique of controlling the cleaning operation by means of a magnetic material or a bias.

A phenomenon of "smeared image (caused by heavy moisture)" that occurs when the image-forming apparatus is used in a heavy moisture/high temperature environment can get to be definitely apparent as the surface of the photosensitive member becomes apt to adsorb moisture under the influence of corona products attributable to ozone that is produced from the corona unit as the latter is used repeatedly. Then, the phenomenon by turn gives rise to a lateral flow out of the electrostatic charge and a smeared image.

In the case of an a-Si type photosensitive member, Japanese Utility Model Publication No. 1-34205 describes an anti-smeared image measure using a heater to drive off the moisture that has been adsorbed by the surface of the photosensitive member. Similarly, Japanese Patent Publication No. 2-38956 describes a method of removing corona products from the surface of the photosensitive member by brushing the surface by means of a brush formed from a magnetic roller and a magnetic toner. Japanese Patent Application Laid-Open No. 61-100780 describes a method of removing corona products by scrubbing the surface of the photosensitive member by means of an elastic roller.

On the other hand, a cleaning roller or a cleaning brush as described above may also be used to scrub the surface of the photosensitive member.

A technique of scrubbing the surface of the photosensitive member is particularly feasible when the surface is very hard as in the case of an a-Si type photosensitive member.

In the case of a relatively soft photosensitive member such as an organic photosensitive member (OPC), there have been proposed a technique of designing an electrophotographic apparatus on the assumption that the photosensitive member is scrubbed and polished in the course of operation and a technique of providing the photosensitive member with a measure for making it to become polished evenly to show a prolonged service life.

However, most of the proposed techniques for improving the effect of removing foreign objects consist in increasing the extent of abutment or intrusion (=deformation) of the cleaning member or the relative speed of the cleaning brush or the cleaning roller and the photosensitive member in order to increase the frictional force.

Then, as a result, the surface of the photosensitive member becomes abraded to baffle the attempt of prolonging the service life thereof.

Additionally, the cleaning blade can become chipped and the cleaning roller comes to show scars as the photosensitive member and the cleaning unit are subjected to such a heavy load. All in all, such measures come to apply an increased load onto the image-forming apparatus comprising the photosensitive member and the cleaning unit.

If such a chipped or scarred profile is not apparent, the affected member may show a change of profile that adversely affects the cleaning performance of the cleaning unit.

On the other hand, while a technique of controlling the cleaning operation by means of a magnetic material or a bias can improve the cleaning feasibility without increasing friction, some of the substances remaining on the surface of the photosensitive member may not be affected by magnetic force or Coulomb's electrostatic attractive force if such substances are for example non-magnetic.

Additionally, such a technique requires the use of a permanent magnet or an electromagnet or a power source to baffle the attempt of reducing the size and cost of the apparatus.

Thus, it is vital to clear the above problems in order to manufacture a down-sized maintenance-free electrophotographic apparatus at low cost that can maintain its cleaning feasibility in a stable manner for a prolonged period of time.

While such an apparatus should have an improved configuration, it may be indispensably necessary to improve the controllability of the effect of cleaning the surface of the photosensitive member in order to realize such an apparatus.

In other words, in order to improve the quality of the image produced by such an apparatus, the effect of cleaning the surface of the photosensitive member has to be rigorously controlled by controlling the adhesion of foreign objects and toner to the surface of the photosensitive member by means of a cleaning unit.

Japanese Patent Applications Laid-Open Nos. 60-22131, 60-22132 and 1-269945 and Japanese Patent Publication No. 4-62579 disclose techniques of defining the condition of the uppermost surface of a photosensitive member by way of the angle of contact with pure water, although none of these patent documents satisfactorily describes the correlation of the adhesion property or wettability with foreign objects such as toner with the cleaning feasibility.

It is highly desirable that the cleaning feasibility can be measured in a simple manner and the results obtained by the measurement are used to define an optimal combination of the photosensitive member and toner in order to make the electrophotographic apparatus stably produce high quality images.

Such an arrangement will be particularly effective and beneficial for reducing the servicing frequency to small electrophotographic apparatus that are to be popularly used such as laser printers, small copying machines and facsimile machines.

SUMMARY OF THE INVENTION

In view of the above identified problems, it is therefore an object of the present invention to provide a photosensitive member to be used for an image-forming apparatus that shows an improved cleaning feasibility on the surface of the photosensitive member so as to prolong the service life of the photosensitive member as well as an image-forming apparatus comprising such a photosensitive member and an image-forming process.

Another object of the invention is to provide a photosensitive member to be used for an image-forming apparatus that is down-sized particularly in terms of its cleaning unit including a cleaning blade so as to reduce the load of the cleaning unit and prolong the servicing cycle period as well as an image-forming apparatus comprising such a photosensitive member and an image-forming process.

Still another object of the present invention is to provide a photosensitive member to be used for an image-forming apparatus that comprises a down-sized energy-saving drive motor so as to eliminate the use of an annexed device of drum heater in order to make the entire apparatus small and lightweight and hence consume less power as well as an image-forming apparatus comprising such a photosensitive member and an image-forming process.

A further object of the invention is to provide a photosensitive member to be used for an image-forming apparatus that is adapted to be housed in a cartridge as well as an image-forming apparatus comprising such a photosensitive member and an image-forming process.

According to the invention, there is provided a photosensitive member to be used for an image-forming apparatus that is adapted to repeatedly form an image by following an image-forming process comprising steps of forming a latent image by electrostatically charging the photosensitive member and exposing it to light, forming a toner image, transferring the toner image onto copy paper and cleaning the surface of the photosensitive member by removing adherers thereon, the wettability (W) of the surface of the photosensitive member relative to the adherers being between 60 and 110 mN/m.

According to the invention, there is also provided an image-forming apparatus comprising a photosensitive member, a latent image forming means for forming a latent image by electrostatically charging the photosensitive member and exposing it to light, a toner image forming means for forming a toner image by applying toner to the latent image and a cleaning means for removing any unnecessary toner from the surface of the photosensitive member, the wettability (W) of the surface of the photosensitive member relative to the toner being between 60 and 110 mN/m.

According to the invention, there is also provided an image-forming method comprising steps of electrostatically charging a photosensitive member and exposing it to light to form a latent image, forming a toner image and removing any unnecessary toner from the surface of the photosensitive member, the wettability (W) of the surface of the photosensitive member relative to the toner being between 60 and 110 mN/m.

The wettability W of the photosensitive member relative to adherers including toner can be derived from the Forkes's extension theory.

By defining and controlling the wettability of the photosensitive member relative to foreign objects adhering to the surface, it is possible to reduce the load and simplify the mechanism necessary for removing foreign objects from the surface of the photosensitive member to cleaning the surface hereof.

Additionally, the performance of the cleaning unit and that of the photosensitive member can be maintained for a prolonged period of time by reducing the cleaning load.

As a result, it is possible to maintain the accuracy and reliability of the latent and visible image forming steps and other image-forming steps for a long time so that the apparatus can stably provide high quality images.

DESCRIPTION OF THE PREFERRED EMBODIMENTS

Now, the present invention will be described in greater detail by referring, whenever necessary, to the accompanying drawings.

While image-forming apparatus comprising an a-Si type photosensitive member may be provided with a heater for heating the photosensitive member, the heater is preferably a small capacity heater or completely eliminated from the energy saving point of view.

The latitude of the photosensitive member relative to fused toner will be broadened as the surface temperature of the photosensitive member falls.

It may be needless to say that the operating characteristics of the photosensitive member including the bearability of electrostatic charge do not change with a temperature change if a small capacity heater is used or no heater is used.

An a-Si type photosensitive member to be used for the purpose of the invention preferably shows improved operating characteristics. Such an a-Si type photosensitive member preferably comprises a photoconductive layer containing hydrogen by 10 to 30 atomic % that shows a characteristic energy level of 50 to 60 meV at the exponential Urbach's tail of the photoabsorption spectrum and a localized state density of $1\times10^{14}$ to $1\times10^{16}$ $cm^{-3}$.

The advantages of the present invention will be enhanced by using an a-Si type photosensitive member having an improved temperature characteristic in terms of change with temperature of the electric charge bearability as its is combined with the above effect.

Now, the overall process of electrophotography and the cleaning unit used in the process will be described by referring to FIG. 1 that illustrates a block diagram of an image-forming apparatus.

Figure 1:
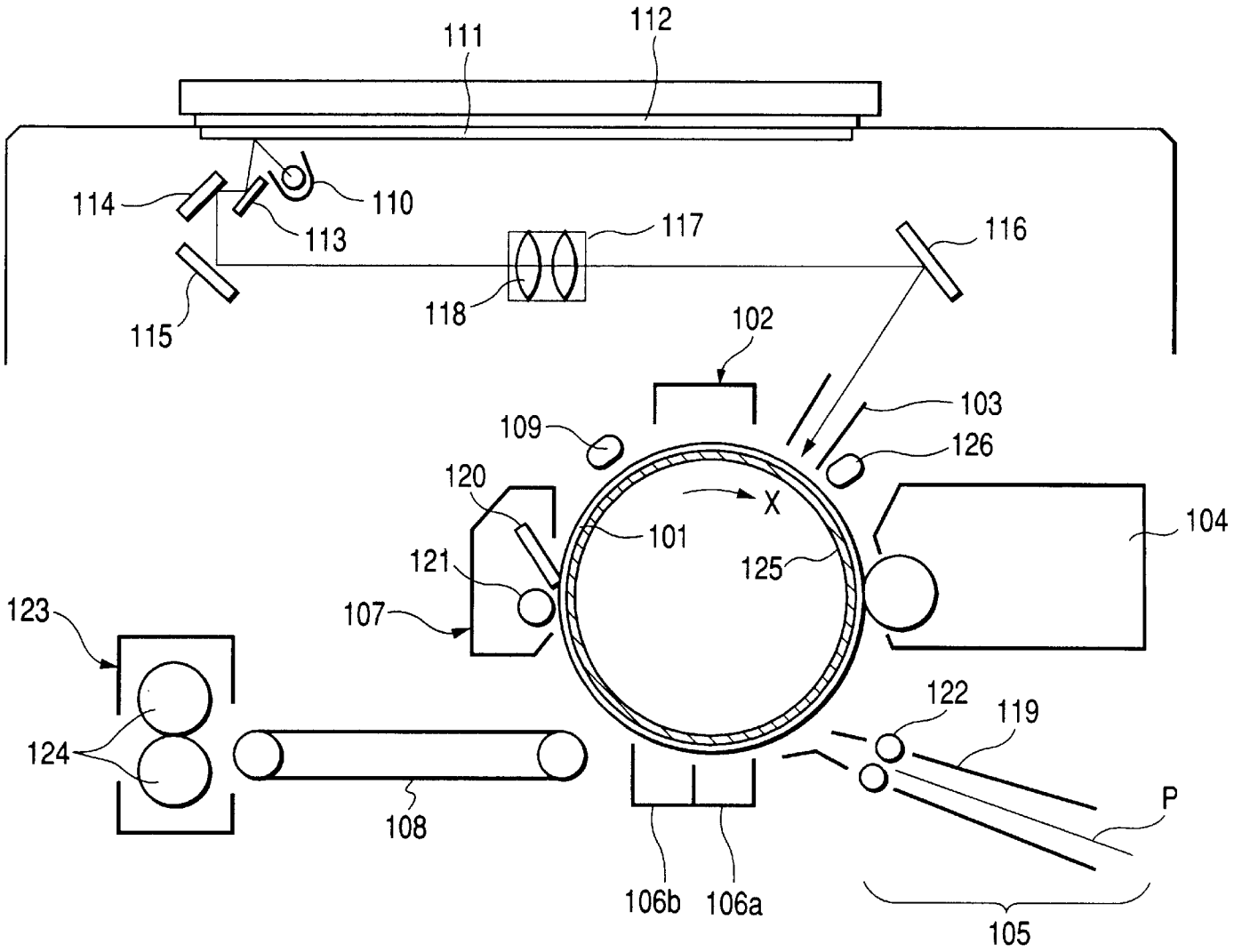
FIG. 1 is a schematic view of an image-forming apparatus using an electrophotography system, illustrating its configuration.

In FIG. 1, the photosensitive member 101 adapted to rotate in the sense of arrow X is surrounded by a principal corona unit 102, an electrostatic latent image forming site 103, a developing unit 104, a copy paper feeding system 105, a transfer corona unit 106A, a separation corona unit 106B, a cleaner unit 107, a delivery system 108 and a conditioning light source 109. If necessary, the photosensitive member 101 may be provided with a circumferential internal surface heater 125 for controlling the temperature of the photosensitive member 101.

In the image-forming process, the surface of the photosensitive member 101 is uniformly and electrostatically charged by the principal corona unit 102 to which a high voltage of +5 to 10 kV is applied by a voltage applying means (not shown). In operation, light is emitted from a lamp 110 and reflected by the original 112 placed on original glass mount 111 and further by mirrors 113, 114, 115 before it is focused by lens 118 of lens unit 117 and reflected by mirror 116 to expose the electrostatic latent image forming site of the photosensitive member and form an electrostatic latent image thereon.

The latent image is fed with negative polarity toner (to be referred to as "negative toner" hereinafter) from the developing unit 104 to which a predetermined ac (alternating current) or ac+dc (direct current) voltage is applied to turn into a toner image.

Meanwhile, copy paper P is fed from the copy paper feeding system 105 as it is guided by a copy paper guide 119 and its leading edge is registered by register rollers 122 so that the toner image formed on the surface of the photosensitive member 101 is transferred onto the copy paper P by means of the transfer corona unit 106A to which a high voltage of 7 to 8 kV is applied as an electric field with the polarity opposite to that of toner is generated between the transfer corona unit 106A and the photosensitive member 101 from behind.

Then, the copy paper P is separated from the photosensitive member 101 by means of the separation corona unit 106B and/or a separation means such as a separation pawl (not shown) and moved to fixing unit 123 by way of copy paper transfer delivery system 108, where the toner image is fixed by fixing rollers 124 arranged in the fixing unit 123 before it is delivered to the outside of the image-forming apparatus.

The residual toner on the photosensitive member 101 is scraped off by cleaning blade 120 arranged in the cleaning unit 107. The cleaning unit 107 may additionally comprise a cleaning roller. After the cleaning operation, the electrostatic latent image remaining on the surface of the photosensitive member is erased by a conditioning light source 109.

Note that the image-forming apparatus of FIG. 1 is an analog image-forming apparatus, where the photosensitive member is positively electrified and negatively electrified toner is used.

In the case of a digital image-forming apparatus, light reflected by the original is transformed into a signal before the electrostatic latent image forming site 103 is exposed to reflected light. Light to be used may be coherent light such as a laser beam having a predetermined wavelength depending on the photosensitivity and other characteristics of the photosensitive member.

The polarity of the electrostatic charge, the polarity of toner, the process of electrostatic charging and the process of development as well as the process of transfer and the voltages to be used may be altered depending on the circumstances.

Cleaning Means

Figure 2:
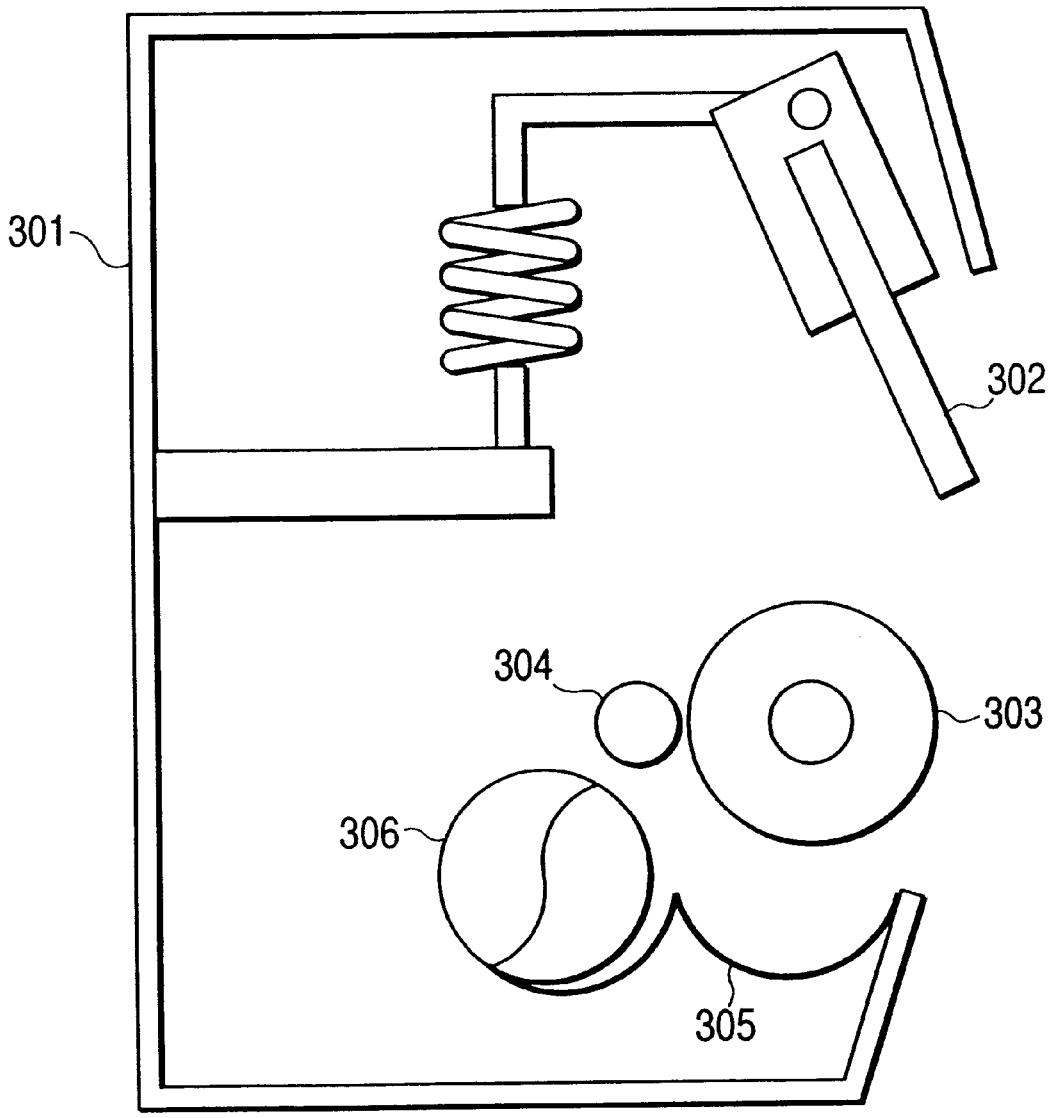
FIG. 2 is a schematic view of a cleaning unit that can be used for an image-forming apparatus, illustrating its configuration.
Figure 3A:
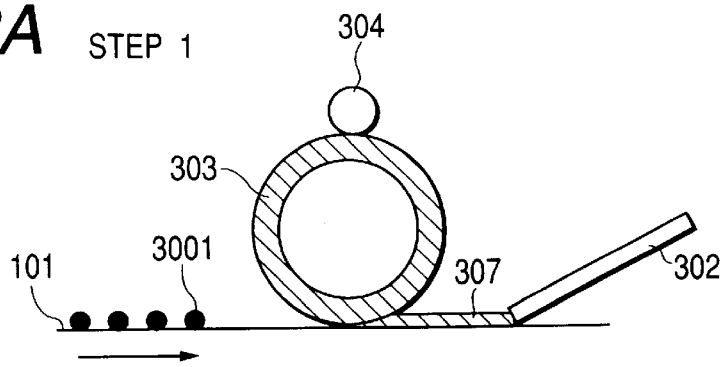
FIGS. 3A, 3B, 3C and 3D are schematic lateral views of a cleaning unit, illustrating a cleaning operation.
Figure 3B:
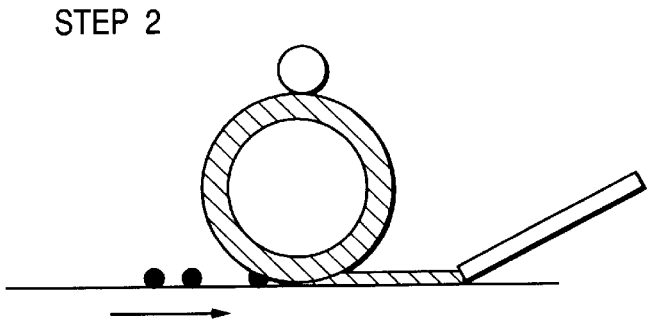
Figure 3C:
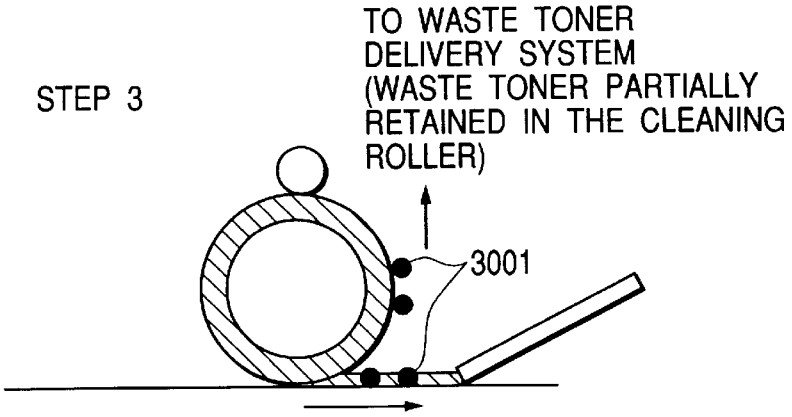
Figure 3D:
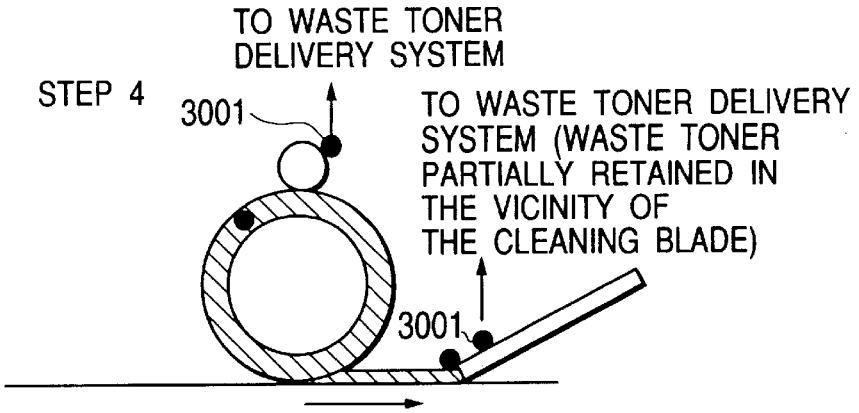

FIG. 2 schematically illustrates a cleaning unit that can be used for the purpose of the invention.

The cleaning unit 301 of FIG. 2 comprises a cleaning blade 302 typically made of urethane rubber, a cleaning roller 303 made of silicon rubber, sponge or a magnetic material, a doctor roller 304, a waste toner pool 305 and a waste toner delivery system 306.

Note that the cleaning unit may be replaced by a similar cleaning unit comprising some of the above listed components and/or some other components.

The cleaning blade 302 is arranged so as to uniformly abut the surface of the photosensitive member under appropriate abutment pressure or with an appropriate extent of intrusion. The cleaning blade 302 may be provided, if necessary, with an equalizing or shifting mechanism so as to improve the evenness of abutment between itself and the surface of the photosensitive member.

Additionally, if necessary, a cleaning roller 303 is arranged in the proximity of the cleaning blade 302. The cleaning roller 303 is made of an elastic material such as silicon rubber, a spongy material or a magnetic material and/or subjected to bias with the polarity opposite to that of toner.

The cleaning roller 303 is made to abut the photosensitive member directly or indirectly by way of magnetic powder such as toner that is made to adhere to the surface of the photosensitive member by magnetic force.

Additionally, a cleaning brush made of resin fiber or metal fiber may be used independently or in combination with a cleaning roller made of resin or a magnetic material.

Then, friction arises as the cleaning means including the urethane rubber made cleaning blade 302 located within the cleaning unit 301 is moved relative to the surface of the photosensitive member.

The adherers on the surface of the photosensitive member is scrubbed under the effect of the generated frictional force and scraped off. The scraped and collected toner (collected toner) is partly removed from the cleaning roller 303 by the doctor roller (or scraper) 304 and delivered to a waste toner storage container (not shown) by way of the waste toner pool 305 of the cleaning unit and the waste toner delivery system 306.

As pointed out above, a considerable load that is typically in the form of frictional force is required to scrub and remove the foreign objects on the surface of the photosensitive member.

Figure 4:
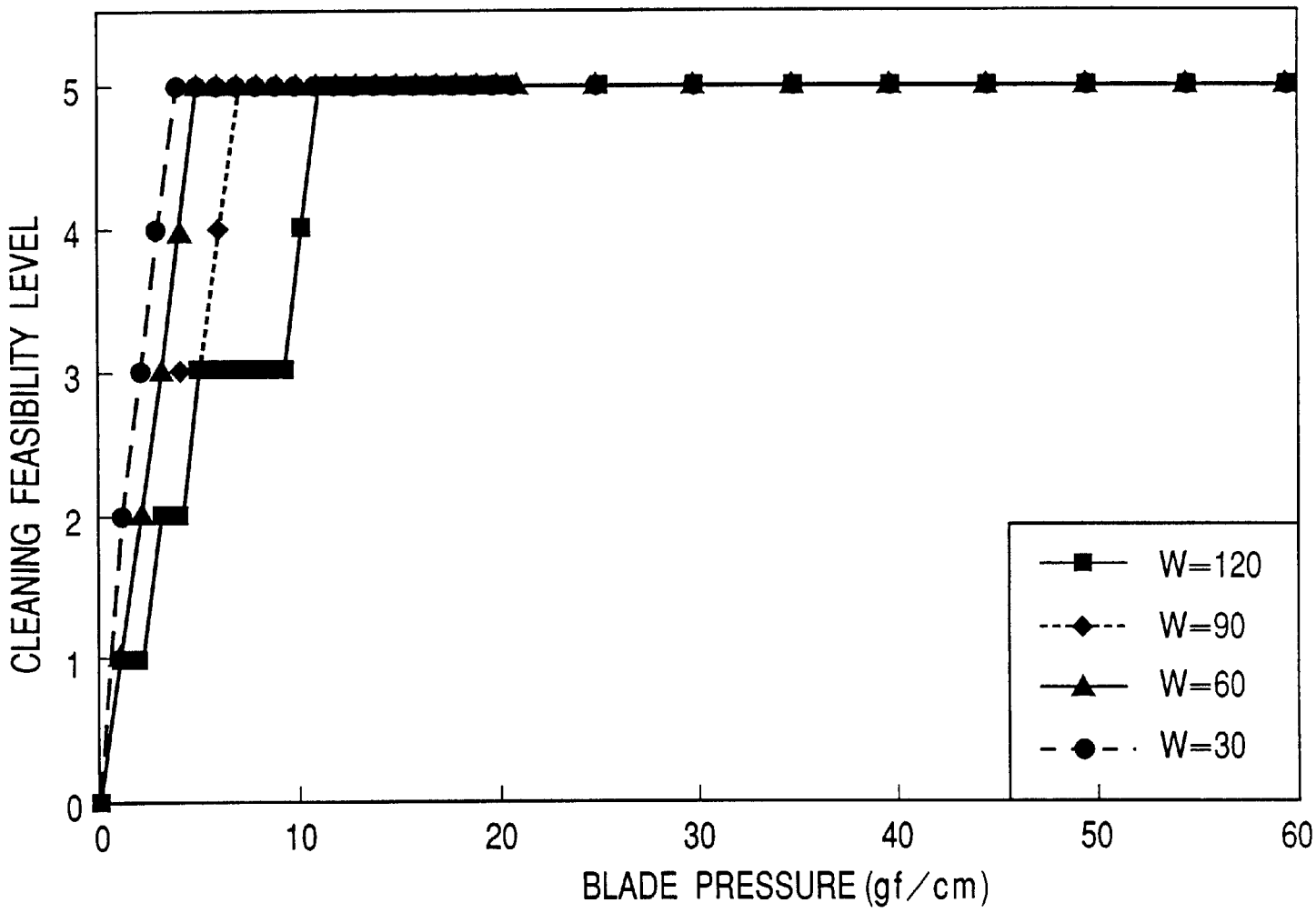
FIG. 4 is a graph illustrating the relationship between the linear pressure of a cleaning blade and the cleaning feasibility thereof.
Figure 5:
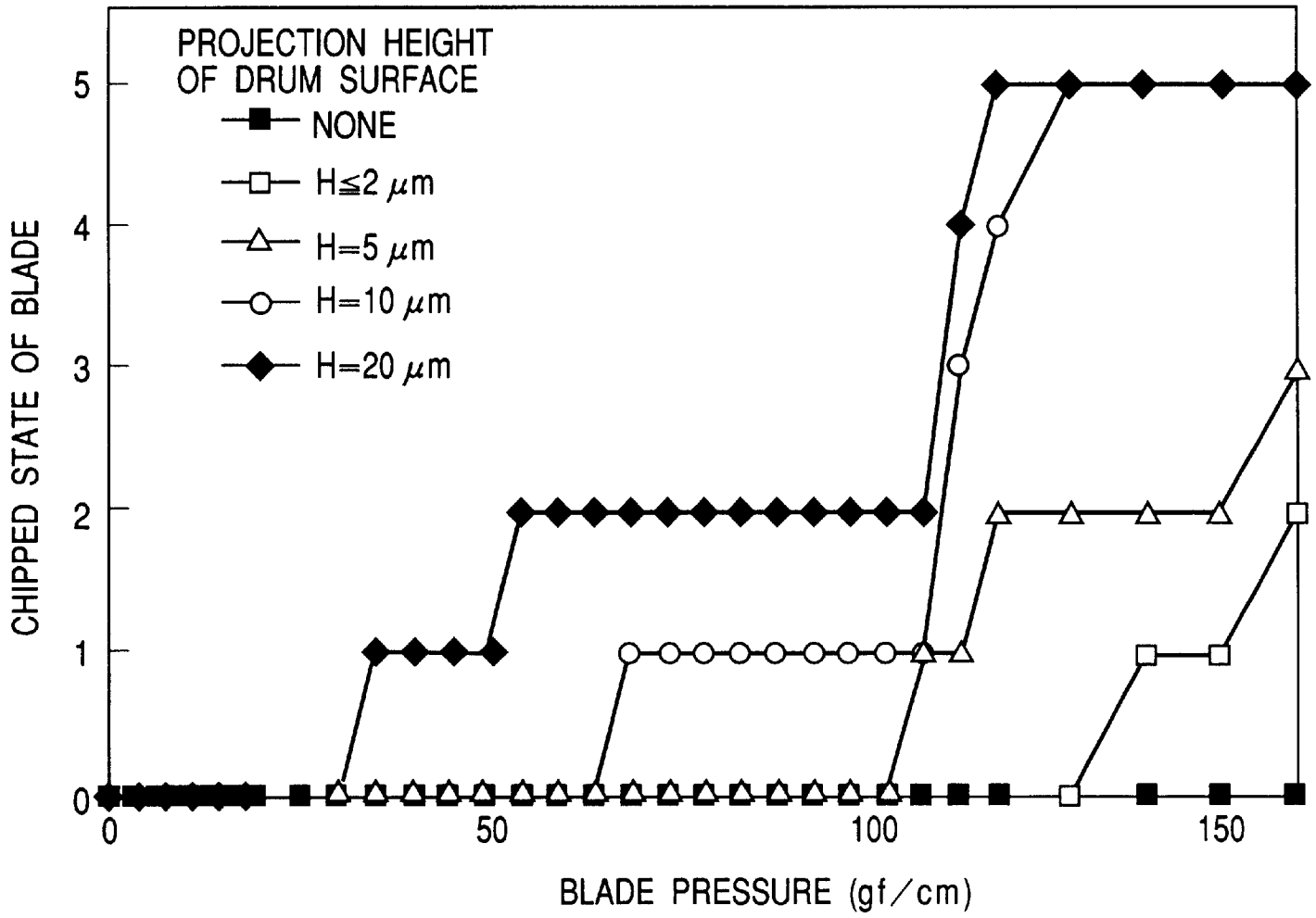
FIG. 5 is a graph illustrating the relationship between the linear pressure of a cleaning blade and the chipped state thereof.

The abutting pressure of the cleaning blade 302, or the pressure of the cleaning blade to be more simple, is preferably between 2 and 100 gf/cm, more preferably between 5 and 50 gf/cm, as seen from FIGS. 4 and 5 illustrating the relationship between the cleaning feasibility and the chipped state of the blade. FIG. 4 shows a graph illustrating the relationship between the linear pressure of a cleaning blade and the cleaning feasibility thereof (which will be described hereinafter in terms of evaluation thereof) when the nipping width (W) (the width of contact of the surface of the photosensitive member and the blade) is varied between 30 and 120 $\mu$m. FIG. 5 is a graph illustrating the relationship between the linear pressure of a cleaning blade and the chipped state thereof (which will be described hereinafter in terms of evaluation thereof) when the height (H) of the projections on the surface of the photosensitive member is varied between 0 and 20 $\mu$m.

Thus, the abutting pressure of the cleaning blade is selected within the above range depending on the material of the photosensitive member, the profile of the surface including projections and the relative speed of the surface of the photosensitive member.

On the other hand, the cleaning roller 303 is driven to rotate at a predetermined speed relative to the surface of the photosensitive member as it is held in direct or indirect abutment with the surface of the photosensitive member.

As described above, the cleaning roller 303 is arranged within the cleaning unit 301 with a doctor roller (or scraper) 304 held in abutment with it.

The cleaning roller 303 is driven to rotate in such a way that its surface moves at a predetermined speed relative to the surface of the photosensitive member so that its surface is made to scrub the surface of the photosensitive member.

The moving speed of the cleaning roller is expressed as positive (+) when it moves in the sense of movement of the photosensitive member (to be referred to as "forwardly" hereinafter). The moving speed is the relative speed with regard to the photosensitive member.

In order to eliminate uneven cleaning and local streaks, the relative speed is held greater than +100%, between +5% and +100% or between −4% and −80%.

Now, the relative speed will be described and defined.

"+100%" as used herein refers to a state where the cleaning roller is rotating forwardly at a speed same as the moving speed of the surface of the photosensitive member.

"−100%" as used herein refers to a state where the cleaning roller is rotating backwardly, or reversely, at a speed same as the moving speed of the surface of the cleaning roller.

When the cleaning roller is completely at a stand still, the relative speed is "0%".

When the cleaning roller is made to rotate backwardly relative to the surface of the photosensitive member at the abutting site, it can produce a good cleaning effect with a low rate of revolution if compared with a state where it is made to rotate forwardly.

This is significant when taking the drive motor of the cleaning roller 303 into consideration. However, a satisfactory cleaning effect may be obtained by driving the cleaning roller forwardly at an appropriate relative speed.

Additionally, the cleaning roller may be driven in any direction so long as it can scrub the surface of the photosensitive member.

For example, it may be moved not in the sense of rotation of the photosensitive member (in parallel with the sheet of FIG. 4 or 5) but in the sense of the axis of revolution of the photosensitive member (perpendicularly relative to the sheet of FIG. 4 or 5). Moreover, it may be moved in a direction obtained by appropriately combining the above two directions.

In any case, the relative speed should not be equal to 0% and, preferably, it should be found out of the range from −4% to +4%.

Otherwise, the cleaning roller 303 may be provided with a mechanism for regulating the distance between itself and the surface of the photosensitive member or the nipping width and the abutting pressure.

On the other hand, when a cleaning device utilizing magnetic force or Coulomb's force is used, the adherers on the surface of the photosensitive member are attracted and removed from the latter by the magnetic force or the Coulomb's force of the unit.

Such a cleaning device is preferably driven to move similarly as the above-discussed cleaning roller scrubbing the surface of the photosensitive member in order to deliver the collected foreign objects and retain the attracting effect of the cleaning roller surface.

The cleaning operation is, as discussed avobe, to remove the foreign objects on the surface of the photosensitive member including the residual toner with force greater than the force with which they are adhering to the surface.

Thus, the load of the cleaning operation can be reduced when the surface of the photosensitive member has a low adhesiveness or wetting potential. The adhesiveness of the surface of the photosensitive member can be detected in the form of surface free energy (synonym of surface tension).

Surface Free Energy

Now, surface free energy will be described below.

Foreign objects including the residual toner are made to adhere to the surface of the photosensitive member by intermolecular force (van der Waals force) that produces physical bonds.

Intermolecular force is generated on the uppermost surface of an object by surface free energy (γ).

An object is wetted roughly in any of three ways.

They are "adhesion wetting" with which object 1 adheres to object 2, "spread wetting" with which object 1 spreads on object 2 and "dip wetting" with which object 1 dips or sinks into object 2.

On "adhesion wetting".

As for surface free energy (γ) and wetting potential, the relationship between object 1 and object 2 is expressed by equation (1) below obtained from Young's equation:

$$\gamma_1=\gamma_2 \cos \theta_{12}+\gamma_{12} \tag{1}$$

where $\gamma_1$: surface free energy of the surface of object 1, $\gamma_2$: surface free energy of object 2, $\gamma_{12}$: interface free energy of object 1/object 2 and $\theta_{12}$: angle of contact of object 1/object 2.

On the other hand, the wettability of object 2 relative to object 1 as the latter adheres to the former to give rise to a phenomenon of "adhesion wetting" (hereinafter referred to as work of adhesion Wa) can be expressed by equation (2) below obtained from Dupre's equation:

$$\gamma_1+\gamma_2=Wa_{12}+\gamma_{12} \tag{2}$$

where $Wa_{12}$: work of adhesion of object 1/object 2 (synonym of "adhesiveness").

From equations (1) and (2), work of adhesion $Wa_{12}$ is expressed by equation (3) below:

$$Wa_{12}=\gamma_2\times(1+\cos \theta_{12}) \tag{3}$$

In the case of toner adhering to the photosensitive member of an image-forming apparatus, the photosensitive member is object 1 and toner is object 2 in the above equation.

From equation (3), the value of $\theta_{12}$ can be increased to reduce the wettability by reducing the work of adhesion $Wa_{12}$ of the photosensitive member and toner.

While the angle of contact $\theta_{12}$ between a solid object and a liquid object can be directly measured to determine the work of adhesion thereof, it is not possible to measure the angle of contact $\theta_{12}$ directly between two solid objects such as a photosensitive member and toner.

From the viewpoint of the present invention, both a photosensitive member and toner are solid and hence the angle of contact therebetween cannot be determined directly. Therefore, the work of adhesion of a photosensitive member and toner has to be determined by obtaining the related components of the surface free energy (γ) of each of the objects as will be discussed hereinafter.

Y. Kitazaki and T. Hata et al. reported in "Annual Report of Japan Association of Adhesion 8 (3)", pp.131–141 (1972) that the Forkes's theory on non-polar intermolecular force can be extended to components of polar or hydrogen bond type intermolecular force from the viewpoint of surface free energy (synonym of surface tension).

Then, on the basis of the extended Forkes's theory, surface free energy can be determined for different objects in terms of two or three components. A theory of adhesion wetting will be described below in terms of three components. This theory is based on the following assumption.

1. Rule of Additivity of Surface Free Energy ($\gamma$)

$$\gamma=\gamma^d+\gamma^p+\gamma^h \tag{4}$$

where $\gamma^d$: bipolar component (wetting due to polarity =adhesion), $\gamma^p$: dispersive component (non-polar wetting =adhesion) and $\gamma^h$: hydrogen bond component (wetting due to hydrogen bond=adhesion.

2. Rule of Additivity of Work of Adhesion ($Wa_{12}$)

$$Wa_{12}=Wa_{12}{}^d+Wa_{12}{}^p+Wa_{12}{}^h \tag{5}$$

where $Wa_{12}{}^d$: dipole component (wetting=adhesion due to polarity), $Wa_{12}{}^p$: dispersion component (wetting=adhesion due to non-polar factor) and $Wa_{12}{}^h$: hydrogen bond component (wetting=adhesion due to hydrogen bond.

3. Rule of Geometric Average of Work of Adhesion ($Wa_{12}$)

$$\left.\begin{aligned} Wa_{12}^d &= \sqrt{\gamma_1^d \times \gamma_2^d} \\ Wa_{12}^p &= \sqrt{\gamma_1^p \times \gamma_2^p} \\ Wa_{12}^h &= \sqrt{\gamma_1^h \times \gamma_2^h} \end{aligned}\right\} \tag{6}$$

4. Intermolecular Force

Surface free energy and work of adhesions of different components do not affect each other.

By applying this rule to the Forkes's theory, interface free energy $\gamma_{12}$ of two objects can be expressed by formulas (3) and (4) below.

$$\gamma_{12} = \gamma_1 + \gamma_2 - 2\cdot(\gamma_1^d\cdot\gamma_2^d)^{1/2} - 2\cdot(\gamma_1^p\cdot\gamma_2^p)^{1/2} - 2\cdot(\gamma_1^h\cdot\gamma_2^h)^{1/2} \tag{7}$$

$$\gamma_{12} = \left\{\sqrt{(\gamma_1^d)} - \sqrt{(\gamma_2^d)}\right\}^2 + \left\{\sqrt{(\gamma_1^p)} - \sqrt{(\gamma_1^p)}\right\}^2 - \left\{\sqrt{(\gamma_1^h)} - \sqrt{(\gamma_1^h)}\right\}^2 \tag{8}$$

From the above two equations and equation (2), the following equation can be obtained.

$$Wa_{12}=2\cdot(\gamma_1{}^d\cdot\gamma_2{}^d)^{1/2}+2\cdot(\gamma_1{}^p\cdot\gamma_2{}^p)^{1/2}+2\cdot(\gamma_1{}^h\cdot\gamma_2{}^h)^{1/2} \tag{9}$$

If objects 1 and 2 are respectively an photosensitive member and adherers including toner and other foreign objects, neither of them has to be liquefied to determine the surface free energy of each of them and hence the work of adhesion (Wa) thereof.

Thus, the surface free energy can be determined by using agents whose components p, d and h of surface free energy are known and measuring the adhesion of each of the agents.

In an example, pure water, methylene iodide and $\alpha$-bromonaphthalene were selected for agents, their respective contact angles on the surface of a photosensitive member were measured by means of contact angle gauge CA-S ROLL (tradename, available from Kyowa Kaimen) and then the surface free energy $\gamma$ was determined by means of computer software EG-11 for analyzing surface free energy (tradename, available from Kyowa Kaimen).

Any other agents where the components of p, d and h can be appropriately combined may also be used for the purpose of the invention. Likewise, any other generally applicable gauging technique such as Wilhelmy method and De Noui method may be used for the purpose of the invention.

As pointed out above, there are more than one types of "wetting". However, from the viewpoint of observing the adhesion or fusion/adhesion of toner onto the surface of a photosensitive member, the residual toner on the surface of the photosensitive member adheres to the photosensitive member and, as the latter is subjected to cleaning and electrostatically charging processes repeatedly, the toner spreads over the surface of the photosensitive member to become like film and firmly sticks thereto to give rise to a wetting phenomenon. Thus, "adhesion wetting" takes a vital role for the residual toner to adhere to the surface of a photosensitive member.

Additionally, foreign objects such as debris of paper, rosin and talc that are adhering to the surface of the photosensitive member eventually enlarge the area of contact with the photosensitive member (hereinafter referred to as "interface") to cause strong wetting.

When the foreign objects that have adhered to the surface of the photosensitive member can become literally "wetted" by moisture, it sits directly on the surface of the photosensitive member to make the image on the surface of the photosensitive member burred, which is a phenomenon referred to as "dense moisture smudging".

In the image-forming process of electrophotography, various substances including toner come to adhere, if temporarily, to the surface of the photosensitive member.

Of these substances, the toner that has not been transferred to the copying paper, or so-called "residual toner" and other foreign objects have to be cleaned and removed within a given period of time.

A given period of time as used herein refers to a period of time from the time when various substances adhere, if temporarily, to the surface of the photosensitive member to the time when the adherers are repeatedly subjected to a spread and/or further adhesion cycle to increase the area of the interface between them and the surface of the photosensitive member.

When the photosensitive member is cleaned under such conditions, the "adhesion wetting" and the "spread wetting" of foreign objects vitally affect the cleaning feasibility of the photosensitive member as well as the service life of the cleaning unit and that of the photosensitive member.

Therefore, the inventors of the present invention came to believe that an electrophotography apparatus can be made durable and produce high quality images by controlling the work of adhesion (Wa) as defined above and, as a result of intensive research efforts, succeeded in inventing such an electrophotography apparatus.

In particular, object 2 that represents foreign objects includes various objects of different types such as toner, debris of paper, moisture and silicone oil as well as many other substances.

Control

As described above, the cleaning feasibility of the photosensitive member, the load of cleaning the photosensitive member in particular, should be controlled to provide high quality images on a stable basis.

As a result of intensive research efforts, the inventors of the present invention came to find that both the load of the photosensitive member and that of the cleaning unit can be reduced by controlling the adhesion work (Wa) out of the wetting work of the photosensitive member and adherers, toner in particular (hereinafter simply referred to as work of adhesion (W)), to a value between 60 and 110 mN/m, preferably between 75 and 95 mN/m.

Toner and Development

Figure 6:
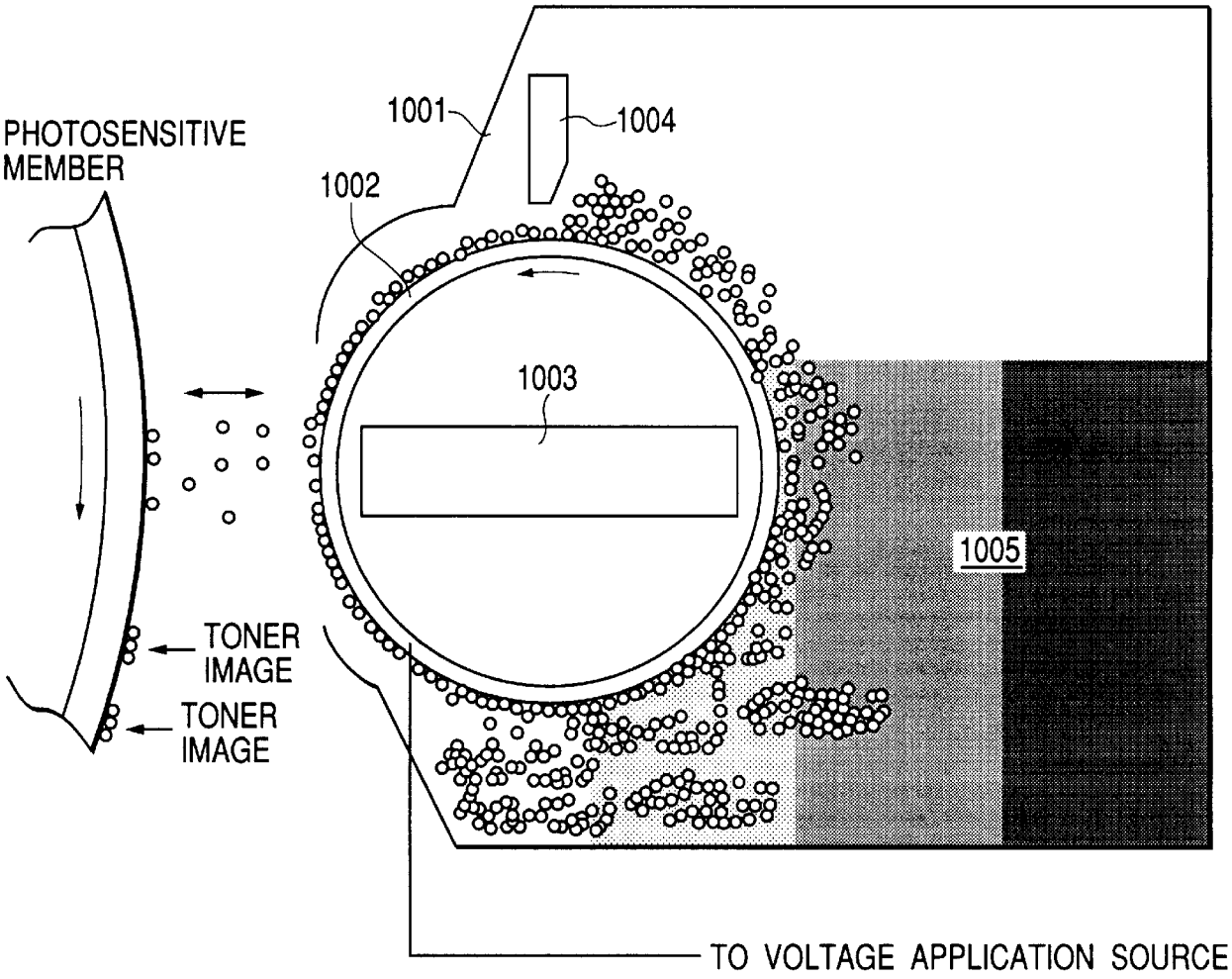
FIGS. 6 and 7 are schematic views of a developing unit and the behavior of toner.
Figure 7:
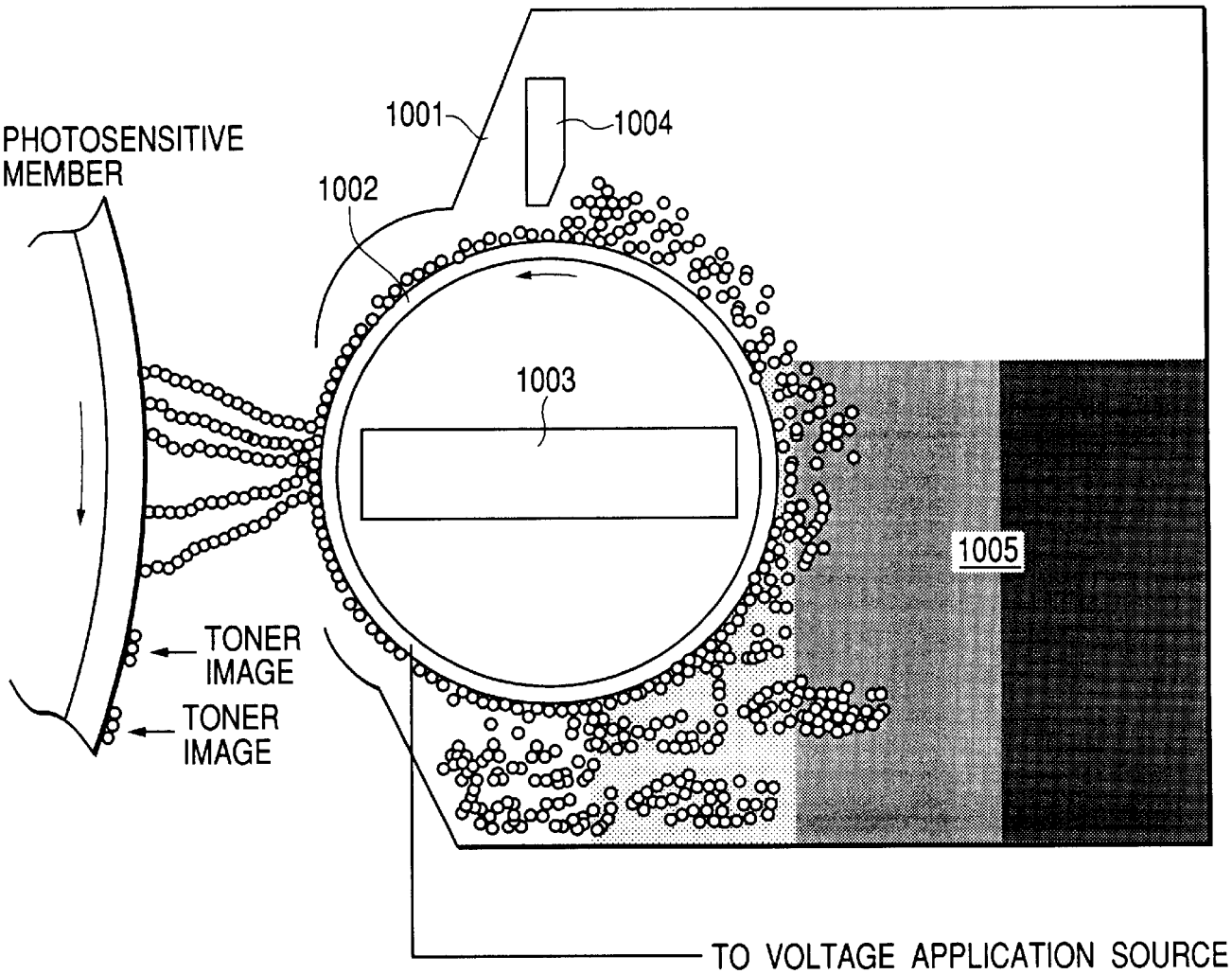

FIGS. 6 and 7 schematically illustrate part of a developing unit and the behavior of toner.

The developing unit 1001 of FIGS. 6 and 7 contains a magnetic material 1003 therein and comprises a developing sleeve 1002 for moving toner close to the surface of the photosensitive member, a doctor blade 1004 for controlling the amount of toner coated on the cylinder of the developing unit 1001, a voltage application means (not shown) for applying a developing bias voltage to the developing sleeve 1002 and a toner pool 1005 for storing toner.

A developing bias voltage (ac+dc) is applied to the developing sleeve 1002 in the developing unit 1001 for a development process.

There are two types of toner, 1-component toner (magnetic toner) and 2-component toner (toner+carrier). Toner behaves differently between the developing sleeve 1002 and the photosensitive member as a function of the composition of the toner.

In the case of 1-component toner, as shown in FIG. 6, toner reciprocates at high speed between the developing sleeve 1002 and the photosensitive member, constantly jumping, as a function of the correlation of the developing bias, its ac component in particular, and the magnetic body 1003 in the developing unit 1001.

Then, the toner is developed on the surface of the photosensitive member as a function of the correlation of the developing bias, its dc component in particular, the electric potential of the surface of the photosensitive member and the magnetic force of the magnetic body 1003 in the developing unit 1001.

In the case of 2-component toner, as shown in FIG. 7, toner extends from the developing sleeve 1002 to the surface of the photosensitive member, taking the form of chains, and contact the surface in a manner like a magnetic brush. The toner is developed on the surface of the photosensitive member as a function of the correlation of the developing bias, its dc component in particular, the electric potential of the surface of the photosensitive member and the magnetic force of the magnetic body 1003 in the developing unit 1001.

It is desirable to appropriately regulate the developing conditions including the developing bias and select suitable toner according to the type and the permittivity of the photosensitive member, the processing speed and other factors.

Generally, toner contains an additive added to the surface of the particles of the classified product (hereinafter referred to as outer additive) and, in the case of 2-component type toner, a material referred to as carrier is further added thereto.

The outer additive is normally supplied in the form of fine particles with a diameter between tens of several angstroms and several thousand angstroms (Å) that is smaller than the diameter of particles of the classified product and that of particles of the carrier.

In an experiment, the particle diameter and the diameter distribution of toner were observed by means of laser diffraction type particle size distribution gauge HEROS (tradename, available from JEOL). In the actual measurement, the range between 0.05 and 200 μm was put to 32 logarithmic division and 50% average particle diameter was used as average particle diameter. Unless noted otherwise, the toner particle diameter as used herein refers to the particle diameter of the classified product and the carrier, the outer additive being excepted.

For the overall average particle diameter, alternatively, more than 100 particle specimens may be randomly picked up by means of an optical microscope or a scanning electron microscope and the largest horizontal chordal length may be used as average particle diameter.

While the average particle diameter is preferable as small as possible from the viewpoint of image quality, it is preferably between 1 and 50 μm from the viewpoint of cleaning feasibility and ease of manufacturing. More preferably, the average particle diameter is between 2 and 20 μm.

For the purpose of the invention, a plurality of classified toner products and/or a plurality of carriers may be mixed for use if they show an average particle diameter found within the above defined range.

For the purpose of the invention, toner particles are not necessarily spherical and may show surface undulations so long as they show an average particle diameter found within the above defined range.

Preferably, the distance between the surface of the photosensitive member and the sleeve (hereinafter referred to as "SD gap") is made small from the viewpoint of jumping motion of toner, chain contact of toner and prevention of scattering of toner within the developing unit.

If the SD gap is too small, on the other hand, electric discharges can occur between the photosensitive member and the developing means such as toner and the developing sleeve to adversely affect the latent image and additionally the free motion of toner can be obstructed to damage the photosensitive member and the developing means.

Therefore, for the purpose of the invention, the SD gap is held generally between 50 and 1,000 μm, preferably 100 and 600 μm.

Photosensitive Member

For the purpose of the invention, the photosensitive member of an electrophotography apparatus is preferably an inorganic photosensitive member, an amorphous silicon type photosensitive member (hereinafter referred to as "a-Si photosensitive member") prepared by using amorphous silicon as principal material in particular, or an organic photosensitive member (OPC) made of an organic semiconductor material.

A-Si photosensitive members are suitably used in medium to high speed copying machines and operate stably with a long service life if used very frequently.

For image-forming apparatus comprising such an electrophotographic photosensitive member, the cleaning step in the electrophotography process takes a very significant role in realizing a high efficiency and a prolonged service life for the apparatus.

On the other hand, OPCs are mostly and suitably used in cartridges of LBPs and low to medium speed copying machines.

An OPC is a photosensitive member that can provide high quality images. An OPC does not have a surface as hard as that of an a-Si type photosensitive member.

Therefore, the film thickness of the photosensitive layer of the OPC can be reduced to by turn reduce the service life of the photosensitive member and hence that of the cartridge containing it as the surface is scrubbed by a cleaning blade.

However, as pointed out above, the service life of the photosensitive member can be prolonged by reducing the load including the linear pressure of the cleaning blade to reduce the rate of decrease of the film thickness of the photosensitive member. A-Si Type Photosensitive Member While an a-Si type photosensitive member to be used for the purpose of the invention may be that of a known ordinary type comprising an electroconductive substrate and a photosensitive layer including a photoconductive layer made of a non-single-crystal material containing silicon atoms operating as parent member, to which, when necessary, hydrogen (H) or halogen (X) will be added (may sometimes be referred to as "a-Si:H,X" hereinafter), the performance of the photosensitive member will be improved by appropriate means whenever necessary. If necessary, the photosensitive layer may comprise a surface layer and a charge-injection impeding layer (barrier layer) in addition to the photoconductive layer.

In an a-Si type photosensitive member showing an improved performance for the purpose of the invention, the photoconductive layer preferably contains hydrogen by 10 to 30 atomic % and shows a characteristic energy level of 50 to 60 meV at the exponential Urbach's tail of the photoabsorption spectrum and a localized state density of $1\times10^{14}$ to $1\times10^{16}$ $cm^{-3}$.

A photosensitive member to be used for an image-forming apparatus that is configured in the above described manner shows excellent properties in terms of electric, optical and photoconductive performance, image quality, durability and environmental adaptability, including temperature dependency of the bearability of its electrostatic charge.

Now, the photoconductive member to be used for the purpose of the invention will be discussed in greater detail by referring to the related drawings.

FIGS. 8A through 8F are schematic cross sectional views of photosensitive members that can be used for an image-forming apparatus according to the invention.

Figure 8A:
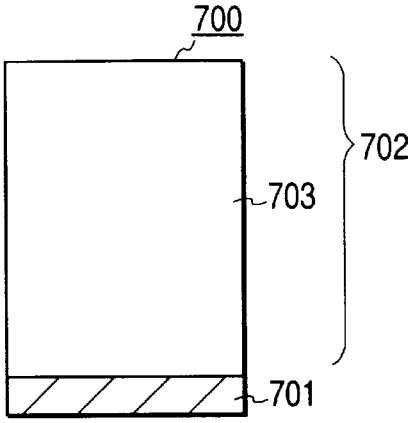
FIGS. 8A, 8B, 8C, 8D, 8E and 8F are schematic cross sectional views of photosensitive members, illustrating the layered structure thereof.

The photosensitive member 700 to be used for an image-forming apparatus as shown in FIG. 8A comprises a photosensitive layer 702 arranged on a substrate 701 operating for the photosensitive member. The photosensitive layer 702 comprises a photoconductive layer 703 made of a-Si:H,X.

Figure 8B:
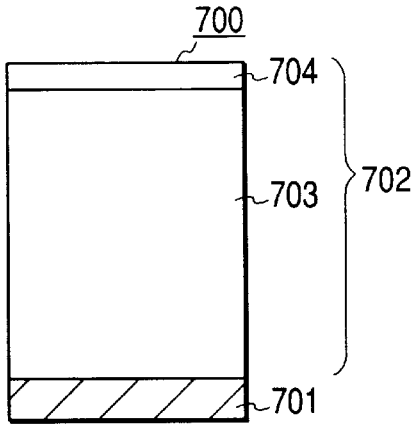

The photosensitive member 700 to be used for an image-forming apparatus as shown in FIG. 8B also comprises a photosensitive layer 702 arranged on a substrate 701 operating for the photosensitive member. The photosensitive layer 702 comprises a photoconductive layer 703 made of a-Si:H,X and an amorphous silicon type (or non-monocystalline carbon (e.g., amorphous carbon)) surface layer 704.

Figure 8C:
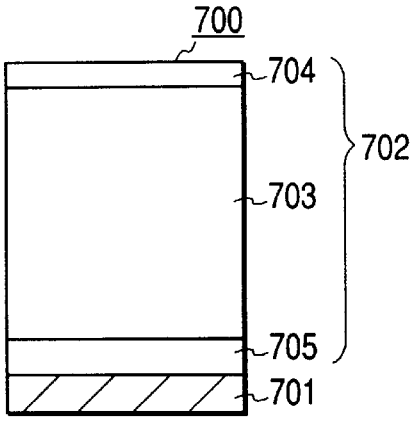

The photosensitive member 700 to be used for an image-forming apparatus as shown in FIG. 8C also comprises a photosensitive layer 702 arranged on a substrate 701 operating for the photosensitive member. The photosensitive layer 702 comprises a photoconductive layer 703 made of a-Si:H,X, an amorphous silicon type (or amorphous carbon type) surface layer 704 and an amorphous silicon type charge-injection impeding layer 705.

Figure 8D:
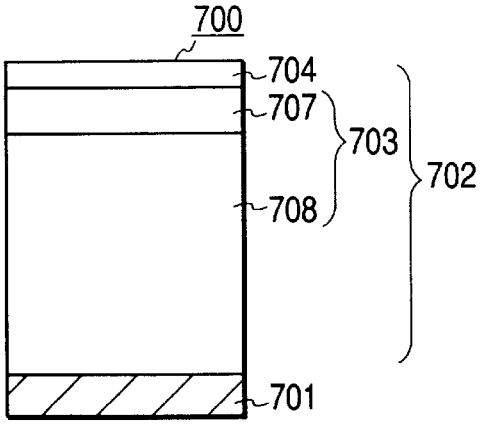
Figure 8E:
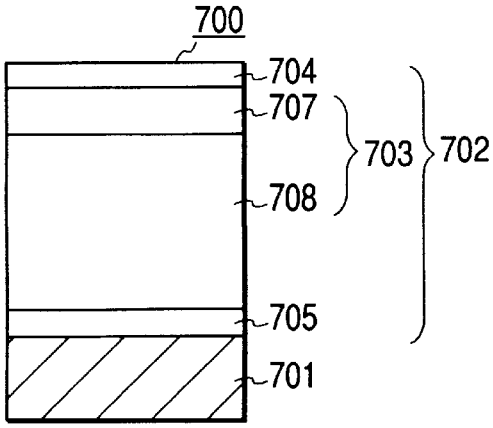

Both of the photosensitive members 700 to be used for an image-forming apparatus as shown in FIGS. 8D and 8E also comprise a photosensitive layer 702 arranged on a substrate 701 operating for the photosensitive member. The photosensitive layer 702 comprises a charge-generating layer 707 made of a-Si:H,X, a charge-transporting layer 708, said charge-generating layer 707 and said charge-transporting layer 708 constituting a photoconductive layer 703, and an amorphous silicon type (or amorphous carbon type) surface layer 704. The photosensitive member 700 for an image-forming apparatus as shown in FIG. 8E additionally comprises an amorphous silicon type charge-injection impeding layer 705 sandwiched by the charge-transport layer 708 and the substrate 701.

Figure 8F:
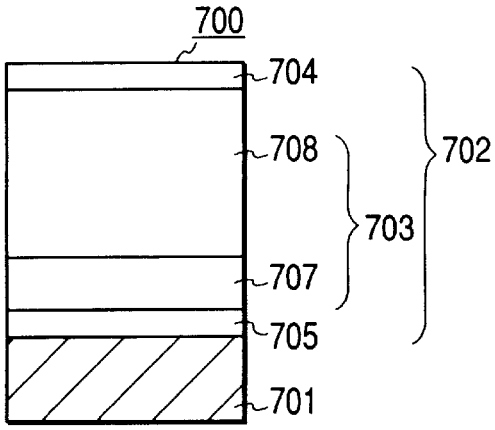

The photosensitive member 700 to be used for an image-forming apparatus as shown in FIG. 8F differs from its counterpart of FIG. 8E in terms of order of arrangement of the charge-generating layer 707 and the charge-transporting layer 708 as viewed from the substrate 701. Thus, in the photosensitive member of FIG. 8F, the charge-generating layer 707 and the charge-transporting layer 708 are sequentially laid on the amorphous silicon type charge-injection impeding layer 705 in the above mentioned order.

Substrte 701

The substrate may be electroconductive or electrically insulating. If it is electroconductive, materials that can be used for preparing it include metals such as Al, Cr, Mo, Au, In, Nb, Te, V, Ti, Pt, Pd and Fe and alloys of any of them such as stainless steel. An electrically insulating substrate made of a film or a sheet of synthetic resin such as polyester, polyethylene, polycarbonate, cellulose acetate, polypropylene, polyvinylchloride, polystyrene or polyamide, glass or ceramic and having a surface treated for electroconductivity at least on the side for forming a photosensitive layer may alternatively be used.

The substrate 701 may take a cylindrical shape or the shape of an endless belt with a smooth or undulated surface. While its thickness may be so selected as to produce a photosensitive member 700 that can appropriately be used for an image-forming apparatus, it is normally greater than 10 $\mu$m from the viewpoint of convenience of manufacturing and handling and that of mechanical strength.

Particularly if the photosensitive member is used for recording images by means of coherent light such as a laser beam, the substrate 701 may carry undulations on the surface within a limit that does not substantially reduce the number of photogenerated carriers in order to effectively eliminate the possibility of producing defective images due to interference fringes that appear on visible images. Japanese Patent Applications Laid-Open Nos. 60-168156, 60-178457, 60-225854 and 61-231561 describe known methods for producing undulations on a substrate 701 that can be used for the purpose of the invention.

As an alternative technique for effectively eliminating the possibility of producing defective images due to interference fringes that can appear when coherent light such as a laser beam is used, a light absorbing layer or an anti-interference layer or region may be formed in or under the photosensitive layer 702.

The fineness/coarseness of the surface of the photosensitive member can be controlled by forming fine scars on the surface of the substrate. Such scars can be formed by means of a polishing material or by way of chemical etching, dry etching to be conducted in plasma or sputtering. The depth of the scars may be such that it does not substantially reduce the number of photogenerated carriers.

Photoconductive Layer 703

For the purpose of the invention, the photoconductive layer 703 is formed as part of the photosensitive layer 702 on the substrate 701 with, if necessary, an underlayer (not shown) interposed therebetween typicality by means of a vacuum deposition film forming technique with parameter values appropriately selected for obtaining desired characteristics. Specific thin film deposition techniques that can be used for the purpose of invention include glow discharge techniques (AC discharge CVD techniques such as low frequency CVD, high frequency CVD and microwave CVD as well as DC discharge CVD techniques), sputtering, vacuum evaporation, ion plating, photo assisted CVD and thermal CVD.

While an appropriate one will be selected from the above listed thin film deposition techniques depending on the manufacturing conditions, the capital investment, the manufacturing scale, the characteristics expected to the products of photosensitive members to be used for image-forming apparatus and other factors, the use of a glow discharge technique, particularly a high frequency glow discharge technique using a supply frequency found in the RF band, the $\mu$W band or the VHF band is preferable because of the ease of controlling the manufacturing condition.

For preparing a non-single-crystal silicon photoconductive layer 703 by means of a glow discharge technique, a source gas adapted to supplying Si in the form of silicon atoms (Si), a source gas adapted to supplying H in the form of hydrogen atoms (H) and/or a source gas adapted to supplying X in the form of halogen atoms (X) are held to a desired gaseous state and introduced into a reaction vessel whose internal pressure can be reduced in order to give rise to a glow discharge within the reaction vessel. As a result, a layer of a-Si:H,X is formed on the substrate 701 arranged in a predetermined position in the reaction vessel.

It is necessary for the photoconductive layer 703 to contain hydrogen atoms and/or halogen atoms in order to compensate the dangling bonds of silicon atoms and improve the quality of the layer particularly in terms of photoconductivity and charge bearing performance. From this point of view, the content of hydrogen atoms and halogen atoms, or the sum of the amount of hydrogen atoms and that of halogen atoms, is preferably 10 to 30 atomic %, more preferably 15 to 25 atomic %, relative to the sum of the amount of silicon atoms and that of hydrogen atoms and/or halogen atoms.

Additionally, it is preferable to form the photoconductive layer by adding $H_2$ and/or He or a gas of a silicon compound also containing hydrogen atoms to a desired ratio to the above gases so that hydrogen atoms may be structurally introduced into the photoconductive layer 703 being formed in order to improve the controllability of the content of introduced hydrogen atoms and obtain the desired film characteristics for the purpose of the invention. The above listed gases may be used either independently or as a mixture that shows a desired mixing ratio.

Source gas for supplying halogen atoms that can be used for the purpose of the invention may be halogen gas, one or more than one gaseous halides, one or more than one gaseous interhalogen compounds containing halogen or one or more than one gaseous or gasifiable halogen compounds of halogen-substituted silane derivatives. Additionally, one or more than one gaseous or gasifiable hydrogenated silicon compounds containing silicon atoms and halogen atoms as component elements may also be used. Specific examples of halogen compounds that can preferably be used for the purpose of the invention includes fluorine gas ($F_2$) and interhalogen compounds such as BrF, ClF, $ClF_3$, $BrF_3$, $BrF_5$, $IF_3$ and $IF_7$.

Specific examples of silicon compounds containing halogen atoms or halogen-substituted silane derivatives includes silicon fluorides such as $SiF_4$ and $Si_2F_6$.

For the purpose of the invention, the content of hydrogen atoms and/or halogen atoms contained in the photoconductive layer 703 can be controlled by controlling the temperature of the substrate 701, the rate at which the source material to be used for containing hydrogen atoms and/or halogen atoms is introduced into the reaction vessel and/or the rate of supply of discharge power.

For the purpose of the invention, if necessary, the photoconductive layer 703 is made to contain atoms adapted to controlling the conductivity. Atoms to be used for controlling the conductivity may be evenly and uniformly distributed in the photoconductive layer 703 or partly unevenly distributed in the direction of the film thickness.

Atoms that can be used for controlling the conductivity may be those of so-called impurity elements that are used in the technological field of semiconductors such as those of the IIIa group of the periodic table showing the p conduction type (hereinafter referred to as "IIIa group atoms") and those of the Va group of the periodic table showing the n conduction type (hereinafter referred to as "Va group atoms"). Specific examples of IIIa group atoms include atoms of boron (B), aluminum (Al), gallium (Ga), indium (In) and thallium (Tl), of which B, Al and Ga, particularly B, may most suitably be used. Specific examples of Va group atoms include atoms of phosphor (P), arsenic (As), antimony (Sb) and bismuth (Bi), of which P and As may most suitably be used.

The content of atoms contained in the photoconductive layer 703 for controlling the conductivity is preferably between $1\times10^{-2}$ and $1\times10^{4}$ atomic ppm, more preferably between $5\times10^{-2}$ and $5\times10^{3}$ atomic ppm, most preferably between $1\times10^{-1}$ and $1\times10^{3}$ atomic ppm.

IIIa group atoms or Va group atoms can be structurally introduced to control the conductivity for the purpose of the invention by introducing a source material adapted to introduce IIIa group atoms or Va group atoms into the reaction vessel in a gaseous state along with other gases for forming the photoconductive layer 703 in the step of forming the layer. It is preferable that the source material adapted to introduce IIIa group atoms or Va group atoms takes the form of gas at room temperature under the atmospheric pressure or can easily be gasified at least under the layer-forming conditions.

Specific examples of source materials adapted to be used for introducing IIIa group atoms include hydrogenated borons such as $B_2H_6$, $B_4H_{10}$,$B_5H_9$, $B_5H_{11}$, $B_6H_{10}$, $B_6H_{12}$ and $B_6H_{14}$ and halogenated borons such as $BF_3$, $BCl_3$ and $BBr_3$ as well as $AlCl_3$, $GaCl_3$, $Ga(CH_3)_3$, $InCl_3$ and $TlCl_3$.

Specific examples of source materials adapted to be used for introducing Va group atoms include hydrogenated phosphors such as $PH_3$ and $P_2H_4$ and halogenated phosphors such as $PH_4I$, $PF_3$, $PF_5$, $PCl_5$, $PBr_3$, $PBr_5$ and $PI_3$ for introducing phosphor atoms. Additionally, compounds such as $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$ may also be used as starting materials for introducing Va group atoms.

Any of the above listed source materials for introducing atoms in order to control the conductivity may be diluted by $H_2$ and/or He for use.

For the purpose of the invention, it is effective to make the photoconductive layer 703 contain carbon atoms, oxygen atoms and/or nitrogen atoms. The content of carbon atoms, oxygen atoms and/or nitrogen atoms relative to the sum of silicon atoms, carbon atoms, oxygen atoms and nitrogen atoms is preferably between $1\times10^{-5}$ to 10 atomic %, more preferably between $1\times10^{-4}$ to 8 atomic %, most preferably between $1\times10^{-3}$ to 5 atomic %. The carbon atoms, oxygen atoms and/or nitrogen atoms may be evenly and uniformly distributed in the photoconductive layer 703 or partly unevenly distributed in the direction of the film thickness so as to show a varying content.

For the purpose of the invention, the thickness of the photoconductive layer 703 is appropriately determined by taking the effect on the electrophotographic performance and the electric capacity under the operating conditions as defined above and the economic feasibility into consideration, although it is preferably between 20 and 50 μm, more preferably between 23 and 45 μm, most preferably between 25 and 40 μm. While the temperature of the substrate 701 in the operation of forming the photoconductive layer may be selected appropriately within an optimal range as defined in the design phase, it is preferably between 200 and 350° C., more preferably between 230 and 330° C., most preferably between 250 and 310° C.

It should be noted that the temperature of the substrate and the gas pressure during the operation of forming the photoconductive layer are normally determined not independently but by taking the mutual organic relations into consideration so that the produced photosensitive member may show intended characteristics.

Surface Layer 704

For the purpose of the invention, a surface layer 704 is preferably formed on the photoconductive layer 703 that is formed on the substrate 701 in a manner as described above. The surface layer 704 has a free surface and is used to provide appropriate characteristics to the produced photosensitive member particularly in terms of moisture resistance, adaptability to continuously repeated use, withstand voltage, adaptability to harsh operating conditions and durability. It is preferably made of a highly hard material such as an amorphous silicon type material that shows appropriate electric and optical characteristics.

While the surface layer 704 may be made of any amorphous silicon type material, the material is preferably selected from amorphous silicon materials containing hydrogen atoms (H) and/or halogen atoms (X) and additionally carbon atoms (hereinafter referred to as "a-SiC:H,X"), amorphous silicon materials containing hydrogen atoms (H) and/or halogen atoms (X) and additionally oxygen atoms (hereinafter referred to as "a-SiO:H,X"), amorphous silicon materials containing hydrogen atoms (H) and/or halogen atoms (X) and additionally nitrogen atoms (hereinafter referred to as "a-SiN:H,X") and amorphous silicon materials containing hydrogen atoms (H) and/or halogen atoms (X) and additionally carbon atoms, oxygen atoms and/or nitrogen atoms (hereinafter referred to as "a-Si(C,O,N):H,X".

Specific thin film deposition techniques that can be used for forming the surface layer 704 include glow discharge techniques (AC discharge CVD techniques such as low frequency CVD, high frequency CVD and microwave CVD as well as DC discharge CVD techniques), sputtering, vacuum evaporation, ion plating, photo assisted CVD and thermal CVD. While an appropriate one will be selected from the above listed thin film deposition techniques depending on the manufacturing conditions, the capital investment, the manufacturing scale, the characteristics expected to the products of photosensitive members to be used for image-forming apparatus and other factors, the use of the deposition technique same as the one used for forming the photoconductive layer is preferable from the viewpoint of productivity of manufacturing photosensitive members.

For preparing a surface layer 704 of a-SiC:H,X by means of a glow discharge technique, a source gas adapted to supplying Si in the form of silicon atoms (Si), a source gas adapted to supplying C in form of carbon atoms (C), a source gas adapted to supplying H in form of hydrogen atoms (H) and/or a source gas adapted to supplying X in the form of halogen atoms (X) are held to a desired gaseous state and introduced into a reaction vessel whose internal pressure can be reduced in order to give rise to a glow discharge within the reaction vessel. As a result, a layer of a-SiC:H,X is formed on the substrate 701 arranged in a predetermined position in the reaction vessel and already carrying the photoconductive layer 703 thereon. While halogen atoms (X) used for the photoconductive layer may also be used for the surface layer, the use of fluorine atoms is a preferable choice.

The carbon content of the surface layer is preferably between 30 and 90% relative to the sum of the silicon content and the carbon content when the layer is made of a material containing a-SiC as principal ingredient.

A very hard surface layer will be produced and the electric characteristics and the adaptability for high speed continuous operation of the produced photosensitive member will be remarkably improved by limiting the hydrogen content of the surface layer between 30 and 70 atomic %.

The hydrogen content of the surface layer can be controlled by controlling the flow rate of $H_2$ gas, the temperature of the substrate, the discharge power and the gas pressure.

For the purpose of the invention, the content of hydrogen atoms and/or halogen atoms contained in the surface layer 704 can be controlled by controlling the temperature of the substrate 701, the rate at which the source material to be used for containing hydrogen atoms and/or halogen atoms is introduced into the reaction vessel and/or the rate of supply of discharge power.

Carbon atoms, oxygen atoms and/or nitrogen atoms may be evenly and uniformly distributed in the surface layer or partly unevenly distributed to show a varying content in the direction of the film thickness.

For the purpose of the invention, if necessary, the surface layer 704 may contain atoms adapted to controlling the conductivity. Atoms to be used for controlling the conductivity may be evenly and uniformly distributed in the surface layer 704 or partly unevenly distributed in the direction of the film thickness.

Atoms that can be used for controlling the conductivity may be those of so-called impurity elements that are used in the technological field of semiconductors such as "IIIa group atoms" and "Va group atoms".

Any of the above listed source materials for introducing atoms in order to control the conductivity may be diluted by gas such as $H_2$, He, Ar and/or Ne for use.

For the purpose of the invention, the film thickness of the surface layer 704 is preferably between 0.01 and 3 μm, more preferably between 0.05 and 2 μm, most preferably between 0.1 and 1 μm. If the film thickness is less than 0.01 μm, the surface layer can eventually be abraded and become lost while the photosensitive member is held in use. If, on the other hand, the film thickness is more than 3 μm, the electrophotography characteristics of the photosensitive member can become degraded by an increased residual potential.

Alternatively, the surface layer may be made of amorphous carbon film containing carbon as principal ingredient (hereinafter referred to as "a-C:H") or amorphous carbon film containing a-C:H as principle ingredient and having bonds with fluorine in the inside and/or on the uppermost surface.

An a-C:H or a-C:H:F surface layer shows a hardness equal to or greater than a-SiC and is highly water-repelling and lowly frictional. It can effectively prevent smeared images in a highly humid environment if an environment protection heater is not provided. It also can protect the photosensitive member against damages due to mechanical friction caused by toner particles.

A surface layer 704 made of a-C:H:F will be described below in greater detail. Hydrogen carbide is used as source gas and will be decomposed by glow discharge using a high frequency power. Since the surface protection layer should be made highly transparent in order to avoid any loss of photosensitivity, hydrogen gas, helium gas or argon gas is appropriately mixed with the source gas. The substrate temperature will be regulated appropriately between room temperature and 350° C.

Substances that can supply carbon for the purpose of the invention include gaseous or gasifiable substances that can effectively provide hydrogen carbide for used such as $CH_4$, $C_2H_6$, $C_3H_8$ and $C_4H_{10}$, particularly $CH_4$, $C_2H_6$, which are advantageous in terms of easy handling during the process of forming the layer and the efficiency of supplying carbon. Any of the above listed source materials for supplying carbon may be diluted, if necessary, by gas such as $H_2$, He, Ar, $N_2$ and/or Ne for use.

While high frequency power for the above process is preferably as strong as possible from the viewpoint of thoroughly decomposing hydrogen carbide, abnormally discharges can occur to degrade the performance of the produced electrophotographic photosensitive member if power is too strong. Therefore, the level of power should be selected so as not to give rise to abnormal discharges. Specifically, the level of power is preferably more than 10 W/cc for source gas containing hydrogen carbide.

The pressure of the space where electric discharges are produced is preferably less than 15 Pa, more preferably less than 6.5 Pa, most preferably less than 1.5 Pa. The lower limit of the pressure will be such that electric discharges are produced stably under the pressure.

To produce a region where fluorine atoms are bound to the film, after forming a surface protection layer typically made of a-C:H, fluorine-containing gas may be introduced to generate plasma by means of appropriate high frequency power and etch the surface protection layer. With this process, the surface protection layer comes to contain fluorine atoms in it. The level of power to be used for this process may be somewhere between 10 W and 5,000 W depending on the etching rate. Similarly, the level of pressure may be selected as a function of the etching rate within a range between 0.1 Pa and several Pa.

Fluorine type gases that can be used for the purpose of the invention include $CF_4$, $CHF_3$, $C_2F_6$, $ClF_3$, $CHClF_2$, $F_2$, $C_3F_8$, $C_4F_{10}$ and other fluorine-containing gases.

The depth by which the film is etched is at least 20 Å for the purpose of the invention. The reproducibility and the uniformity will be advantageously improved when the film is etched by more than 100 Å. While the etching depth may be more than 20 Å, preferably more than 100 Å, for the purpose of the invention, an etching depth less than 5,000 Å, preferably less than 1,000 Å, will be highly advantageous from the viewpoint of controllability of the process and industrial productivity.

When forming an a-C:H surface layer 704, the above described process should be conducted without using fluorine and source gas for supplying fluorine.

For preparing a surface layer 704 that performs satisfactorily for the purpose of the invention, the temperature of the substrate 701 and the gas pressure within the reaction vessel have to be selected appropriately.

It should be noted that the temperature of the substrate and the gas pressure during the operation of forming the surface layer are normally determined not independently but by taking the mutual organic relations into consideration so that the produced photosensitive member may show intended characteristics.

For the purpose of the invention, the charge bearability of the photosensitive member can be improved by arranging a blocking layer (lower surface layer) containing carbon atoms, oxygen atoms and nitrogen atoms to a lesser extent than the surface layer between the photoconductive layer and the surface layer.

Additionally, there may be arranged regions between the surface layer 704 and the photoconductive layer 703 where the content of carbon atoms, oxygen atoms and/or nitrogen atoms decreases towards the photoconductive layer 703. With such an arrangement, the adhesion of the surface layer and the photoconductive layer can be improved to reduce the risk of interference of light reflected by the interface of the two layers.

Charge-Injection Impeding Layer 705

The performance of a photosensitive member to be used for an image-forming apparatus according to the invention can be effectively improved by arranging a charge-injection impeding layer 705 adapted to block the electric charge injected from the side of the electroconductive substrate 701 between the electroconductive substrate 701 and the photoconductive layer 703. Such a charge-injection impeding layer 705 effectively blocks the electric charge injected from the side of the substrate 701 towards the side of the photoconductive layer 703 when the free surface of the photosensitive layer 702 is subjected to an electrostatically charging process to show a given polarity but does not block the charge when the photosensitive layer 702 is subjected to an electrostatically charging process to show the opposite polarity. In other words the charge-injection impeding layer 705 shows polarity dependency. In order to provide the charge-injection impeding layer 705 with polarity dependency, it is made to contain conductivity controlling atoms to a greater extent than the photoconductive layer 703.

Atoms to be used for controlling the conductivity in the charge-injection impeding layer 705 may be evenly and uniformly distributed in the surface layer 704 or partly unevenly distributed in the direction of the film thickness. If the layer shows an uneven distribution pattern, atoms preferably be distributed more densely in areas closer to the substrate. In any case, it is necessary to realize a uniform distribution pattern in any plane parallel to the surface of the substrate in order to make the layer show uniform intraplanar characteristics.

Atoms that can be used for controlling the conductivity in the charge-injection impeding layer 705 may be those of so-called impurity elements that are used in the technological field of semiconductors such as "IIIa group atoms" and "Va group atoms".

For the purpose of the invention, the film thickness of the charge-injection impeding layer 705 is preferably between 0.1 and 5 $\mu$m, more preferably between 0.3 and 4 $\mu$m, most preferably between 0.5 and 3 $\mu$m from the economic point of view.

For the purpose of the invention, while the mixing ratio of dilute gases to be used, the gas pressure, the discharge power and the temperature of the substrate for forming the charge-injection impeding layer 705 may be appropriately selected from the respective ranges of values as cited above, these factors for forming the layer are normally determined not independently but by taking the mutual organic relations into consideration so that the produced photosensitive member may show intended characteristics.

Additionally, in a photosensitive member to be used for an image-forming apparatus according to the invention, an adhesion layer made of an amorphous material containing $Si_3N_4$, $SiO_2$, SiO or silicon as base substance and additionally hydrogen atoms and/or halogen atoms as well as carbon atoms, oxygen atoms and/or nitrogen atoms may be formed between the substrate 701 and the photoconductive layer 703 or the charge-injection impeding layer 705 in order to improve the adhesion of the layers. Still additionally, a light absorption layer may be provided to prevent appearance of interference fringes due to light reflected by the substrate.

Figure 9:
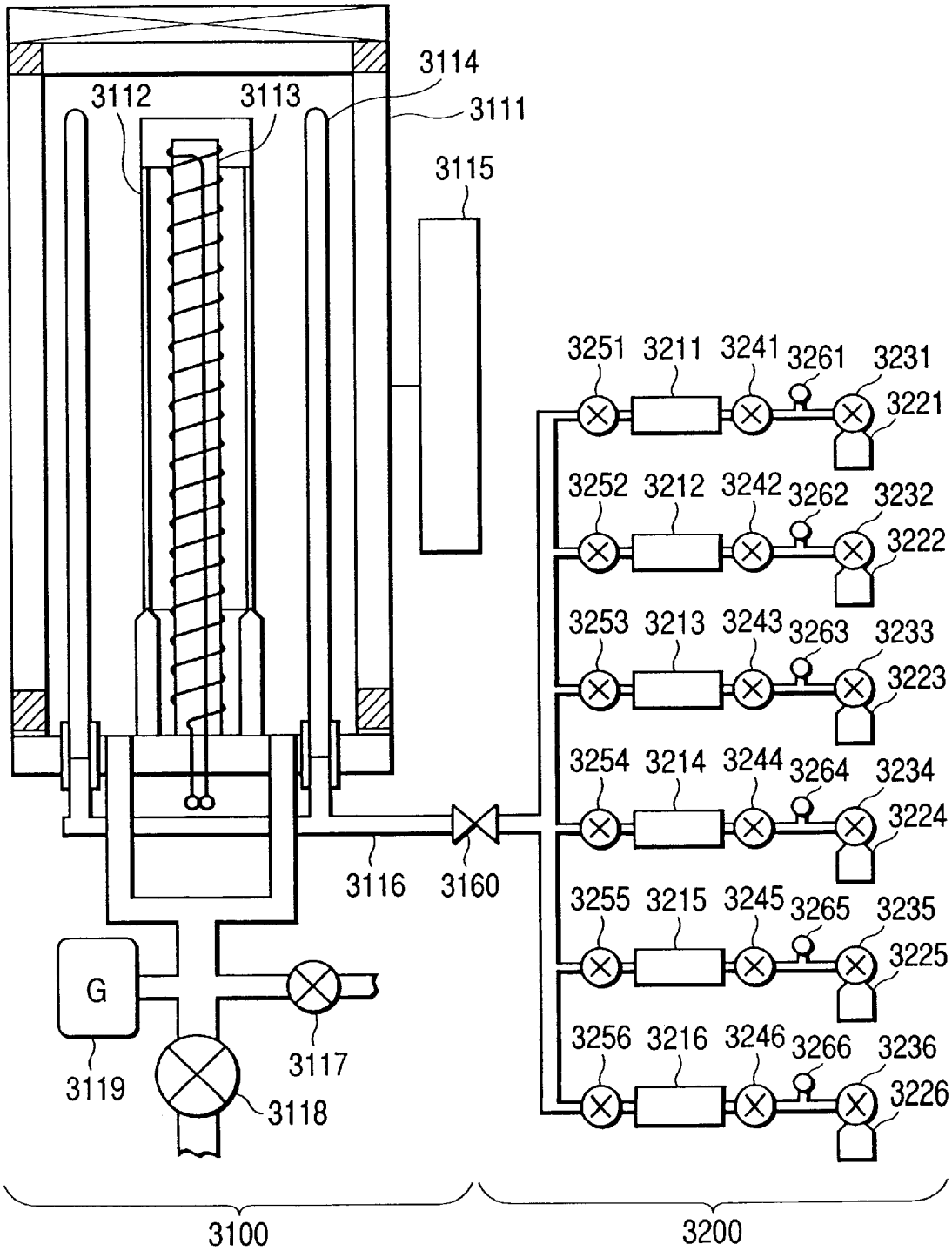
FIG. 9 is a schematic view of an apparatus for manufacturing a photosensitive member to be used for an image-forming apparatus.

The above layers are formed by means of a known appratus as shown in FIG. 9 and a known film forming method.

FIG. 9 is a schematic view of an apparatus that can be used for manufacturing a photosensitive member to be used for an image-forming apparatus by means of high frequency plasma CVD using an RF band for power supply frequency (hereinafter referred to as "RF-PCVD).

The apparatus roughly comprises a deposition unit (3100), a source gas supply unit (3200) and an exhaust system (not shown) for reducing the pressure inside the reaction vessel (3111). The reaction vessel (3111) located inside the deposition unit (3100) is provided with a cylindrical substrate (3112), a substrate heater (3113) and a source gas inlet pipe (3114) arranged within the reaction vessel and is connected to a high frequency matching box (3115).

The source gas supply unit (3200) includes source gas cylinders (3221 through 3226) containing respective sources gases such as $SiH_4$, $GeH_4$, $H_2$, $CH_4$, $B_2H_6$ and $PH_3$, valves (3231 through 3236, 3241 through 3246, 3251 through 3256) and mass flow controllers (3211 through 3216) and the cylinders of respective source gases are connected to the gas inlet pipe (3114) within the reaction vessel (3111) by way of a valve (3160) and a piping system (3116).

Figure 10:
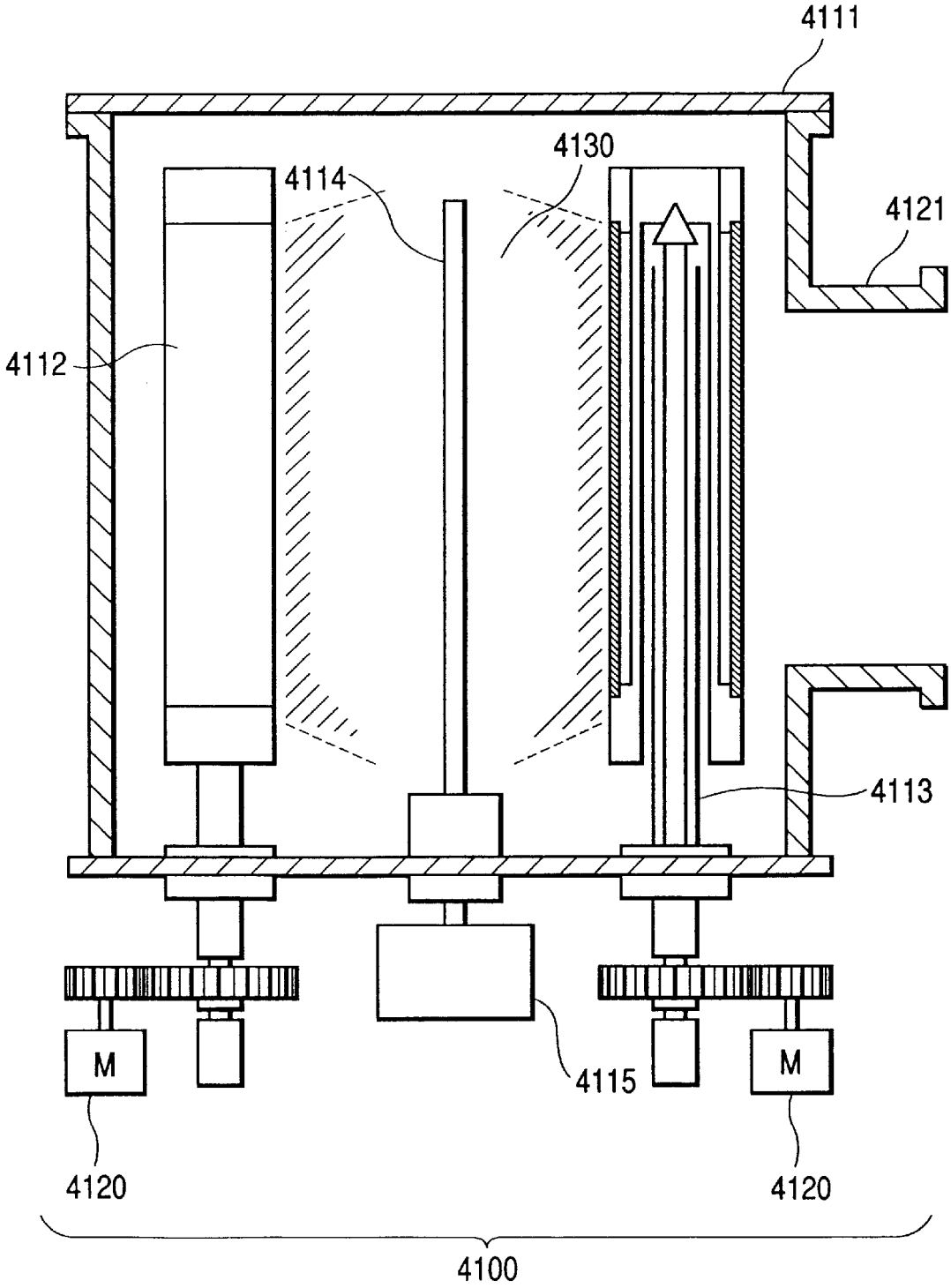
FIG. 10 is a schematic view of another apparatus for manufacturing a photosensitive member to be used for an image-forming apparatus.

An apparatus that can be used for manufacturing a photosensitive member to be used for an image-forming apparatus by means of high frequency plasma CVD using a VHF band for power supply frequency (hereinafter referred to as "VHF-PCVD) can be obtained by replacing the deposition unit (3100) of the apparatus of FIG. 9 adapted to RF-PCVD with a deposition unit (4100) as shown in FIG. 10 and connecting it to the gas supply unit (3200).

The obtained apparatus roughly comprises a reaction vessel (4111), a source gas supply unit (3200) and an exhaust system (not shown) for reducing the pressure inside the reaction vessel (4111). The reaction vessel (4111) is provided in the inside thereof with cylindrical substrates (4112) adapted to be rotated by motors (4120), a substrate heater (4113) and an electrode (4114) operating also as source gas inlet pipe arranged and connected to a high frequency matching box (4115). The inner space of the reaction vessel (4111) is connected to a diffusion pump (not shown) by way of an exhaust pipe 4121.

The source gas supply unit (3200) includes source gas cylinders (3221 through 3226) containing respective sources gases such as $SiH_4$, $GeH_4$, $H_2$, $CH_4$, $B_2H_6$ and $PH_3$, valves (3231 through 3236, 3241 through 3246, 3251 through 3256) and mass flow controllers (3211 through 3216) and the cylinders of respective source gases are connected to the gas inlet pipe (4114) within the reaction vessel (4111) by way of a valve (3160). The space (4130) surrounded by the cylindrical substrates (4112) provides a discharge space.

Organic Photoconductor (OPC)

Figure 11:
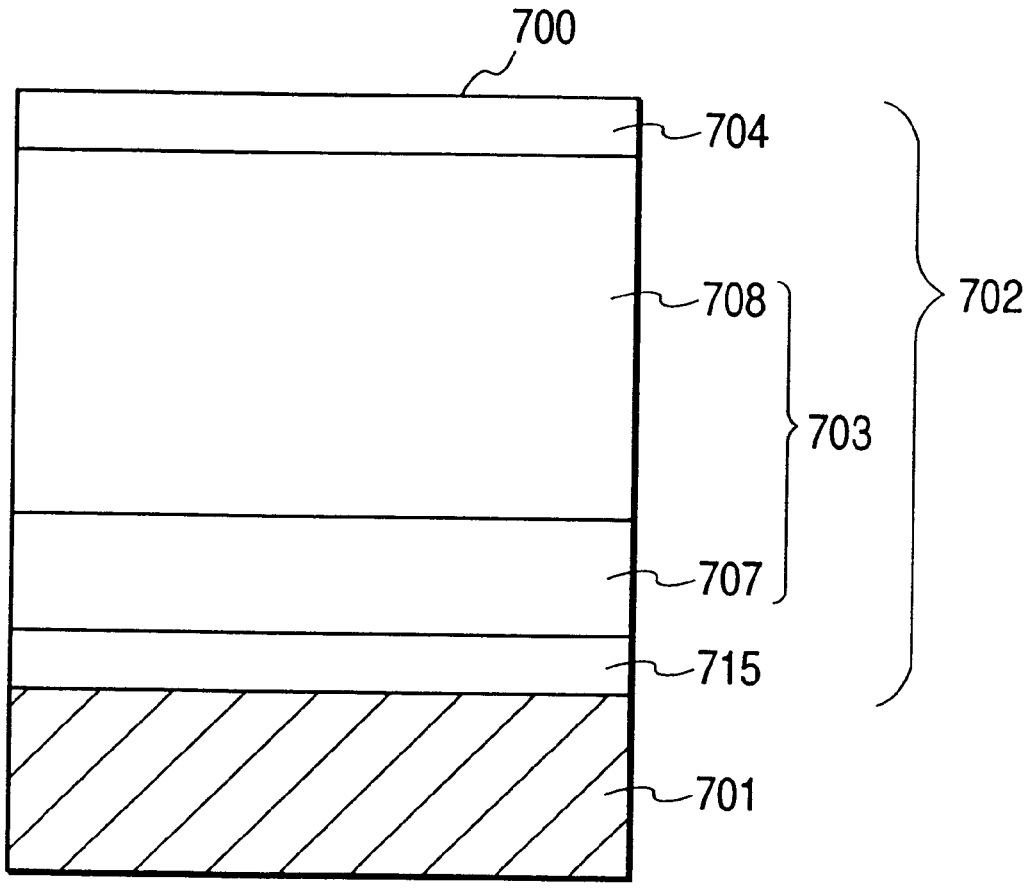
FIG. 11 is a schematic cross sectional view of a photosensitive member, illustrating the layered structure thereof.

Now, an OPC photosensitive member will be discussed as a variety of photosensitive member according to the invention. FIG. 11 is a schematic cross sectional view of an OPC photosensitive member to be used for an image-forming apparatus according to the invention, illustrating the layered structure thereof.

The OPC photosensitive member 700 of FIG. 11 comprises a photosensitive layer 702 arranged on a substrate 701 operating for the photosensitive member. The photosensitive layer 702 comprises a charge-generating layer 707 and a charge-transporting layer 708. When necessary, it also comprises a protective layer or surface layer 704 and an intermediary layer 715 between appropriate layers such as between the substrate 701 and the charge-generating layer 707.

Of the surface layer 704, the photoconductive layer and the intermediary layer 715, which is provided if necessary, of the OPC photosensitive member of the invention, the surface layer may be formed in a known manner, although it may be mixed or coated with a fluorine containing material such as polytetrafluoroethylene (hereinafter referred to as PTFE) in order to improve the durability.

While a photosensitive member having a surface not containing fluorine atoms nor coated with a fluorine-containing layer may be free from problems in terms of water-repellency and cleaning feasibility, the provision of a surface containing fluorine atoms and/or coated with a fluorine-containing layer is more advantageous because it is more water-repellent, smooth and durable.

Example of Resin

Examples of resin that can be used for forming the surface layer, the photoconductive layer, the charge-transporting layer and the charge-generating layer of a electrophotographic photosensitive member for the purpose of the invention will be discussed below.

Polyester is a coupled polymer of an acid component and an alcohol component that can be obtained by condensing dicarboxylic acid and glycol or the hydroxy group of hydroxybenzoic acid and a compound having a carboxyl group.

Acids that can be used for the acid component include aromatic dicarboxylic acids such as terephthalic acid, isophthalic acid and naphthalenedicarboxylic acid, aliphatic dicarboxylic acids such as succinic acid, adipic acid and sebacic acid, alicyclic dicarboxylic acids such as hexahydroterephthalic acid and oxycarboxylic acids such as hydroxyethoxybenzoic acid.

Glycols that can be used for the glycol component include etheyleneglycol, trimethyleneglycol, tetramethyleneglycol, hexamethyleneglycol, cyclohexanedimethylol, polyethyleneglycol and polypropyleneglycol.

Within the extent to which polyester resin is substantially linear, a multifunctional compound selected from a group including pentaerythritol, trimethylolpropane, pyromellitic acid and their ester forming derivatives may be copolymerized.

For the purpose of the invention, high melting point polyester resin will be used.

High melting point polyester resin that can be used for the purpose of the invention shows a limiting viscosity preferably greater than 0.4 dl/g, more preferably greater than 0.5 dl/g, most preferably greater than 0.65 d/g when measured in orthochlorophenol at 36° C.

High melting point polyester resin that can advantageously be used for the purpose of the invention is polyalkyleneterephthalate type resin. Polyalkyleneterephthalate type resin principally comprises terephthalic acid as acid component and alkyleneglycol as glycol component.

Specific examples of such resin include polyethyleneterephthalate (PET) principally comprising terephtalic acid and ethyleneglycol as components, polybutyleneterephthalate (PBT) principally comprising terephthalic acid and 1,4-tetramethyleneglycol (1,4-butyleneglycol) and polycyclohexyldimethyleneterephthalate (PCT) principally comprising terephthalic acid and cyclohexanedimethylol.

Another example of high molecular polyester resin that can advantageously be used for the purpose of the invention is polyalkylenenaphthalate type resin. Polyalkylenenphthalate type resin comprises naphthalenedicarboxylic acid as acid component and alkyleneglycol as glycol component. Specific examples include polyethylenenaphthalate (PEN) principally comprising naphthalanedicarboxylic acid and ethyleneglycol.

High melting point polyester resin that can be used for the purpose of the invention shows a melting point preferably higher than 160° C., more preferably higher than 200° C.

For the purpose of the invention, acrylic resin may be used in place of polyester resin. Additionally, di-functional acryl, hexa-functional acryl or phosphazene may be used as binder.

Such resins show a relatively high crystallinity and presumably hardened resin polymer chains and high melting point polymer chains are mutually entangled in the resin to produce a uniform, dense and durable surface layer. Since low melting point polyester resin shows a relatively low crystallinity, presumably the entanglement of hardened resin polymer chains takes place only highly unevenly to make the surface poorly durable.

For the purpose of the invention, resin is used to show a selected extent of dispersion and controlled for charge bearability and photosensitivity as a function of operating conditions.

Note, as mentioned above, that the surface of the photosensitive member may be coated with PTFE resin or not.

Toner/Inorganic Fine Powder

Toner to be used for the purpose of the invention should preferably be selected so that it cannot easily stick onto the surface of the photosensitive member and it can easily be collected by the cleaning unit; i.e., within a predetermined range of the work of adhesion therebetween.

Toner is typically prepared by using binder resin, acid anhydride or the like as described below.

A 200 weight portions of toluene is put into a reaction vessel and heated to reflux temperature. Then, a mixture of a 77 weight portions of styrene monomer, a 13 weight portions of n-butyl acrylate, a 10 weight portions of monobutyl maleate and a 6 weight portions of di-tert-butylperoxide is dropped into the refluxed toluene for 4 hours.

Polymerization is made to complete in the refluxed toluene (120 to 130° C.) and the toluene is removed to obtain styrene type copolymer.

Then, a 30 weight portions of the styrene type copolymer into a mixture of the following monomers to finish the mixing.

A 42 weight portions of styrene monomer, a 12 weight portions of n-butyl acrylate, a 12 weight portions of n-butyl methacrylate, a 4 weight portions of monobutyl maleate, a 0.4 weight portions of divinylbenzene and a 1.6 weight portions of benzoyl peroxide are mixed and a 170 weight portions of water containing a 0.1 weight portions of partially saponified polyvinylalcohol dissolved therein is added to the mixture to produce a dispersed suspension.

The above dispersed suspension is put into the reaction vessel containing a 15 weight portions of water under the nitrogen-replaced atmosphere to cause a suspension polymerizing reaction to take place at reaction temperature between 70 and 95° C. for 6 hours. After the reaction and a subsequent filtration/dehydration/drying operation, a resin composition is obtained.

As for the molecular weight distribution of the obtained resin composition, the main peak of molecular weight is at 7500 and a shoulder is found at molecular weight of 35000, while Tg is 60° C. and JIS acid value is 22.0.

Toner is prepared by using such resin, a magnetic substance such as ferrite, appropriate oil, a finely powdery inorganic substance such as finely powdery silica processed for hydrophobicity and an appropriate outer additive.

The particle diameter and the composition of toner is then regulated by taking the operating conditions of the image-forming apparatus with which it is used.

The surface free energy ($\gamma$) of toner can be determined by molding a specimen of the toner to a form having a flat surface typically by means of compression molding or hot compression molding, measuring the contact angle of the agent relative to the flat surface of the specimen in the above described manner and conducting the above described arithmetic computations on the obtained value.

The molded specimen can become tacky or otherwise dissolved at the surface within several minutes depending on the type of agent used. Therefore, it is important to select different observation sites for different agents and complete the measurement of the contact angle within a short period of time after dropping the agent.

The residual toner on the surface of the photosensitive member can be effectively collected and any possible problems that can occur due to the toner that is firmly adhering to the surface can be prevented by selecting an appropriate combination of a photosensitive member and toner that makes the relative adhesiveness or the work of adhesion W of the surface of the photosensitive member and the toner arithmetically determined from the obtained surface free energy values to be found within a specified range.

Additionally, appropriate transfer means and/or separation means for efficiently transferring the developed toner onto copy paper as well as a preliminary process for improving the transfer efficiency such as a process of applying an electric field to the toner prior to the transfer may be introduced for the purpose of the invention.

It has been found that the heater of the photosensitive member of an image-forming apparatus can be replaced by a heater with a reduced capacity or totally eliminated and any possible fusion of toner can be prevented when a photosensitive member, an a-Si type photosensitive member in particular, having improved temperature characteristics and an improved surface condition is used.

Thus, the cleaning feasibility of the photosensitive member and the durability of the cleaning unit and the surface of the photosensitive member can be improved by using any of the above described means and effects of solving the problems of existing photosensitive members independently or in combination. Then, the cleaning unit and hence the image-forming apparatus can be down-sized.

The nipping width of the photosensitive member and the cleaning roller or the cleaning brush should be held to a predetermined level in order to keep the cleaning feasibility to a constant level and prevent problems such as an excessive local abutment of the photosensitive member and the cleaning roller or brush and an abraded photosensitive member.

The mechanism for holding the abutment of the photosensitive member and the cleaning roller or the cleaning brush may comprise rollers abutting outside the imaging area. Alternatively, the cleaning roller may simply be pressed against the photosensitive member under pressure of a predetermined level. The thickness of the toner coat can be regulated by using a cleaning roller of a magnetic material.

For instance, the developing agent (toner) to be used may be made to contain wax by means of a known technique.

Additionally, the hydrocarbon type wax and the particle diameter of the finely particulate resin may be regulated by means of a technique as described in Japanese Patent Application Laid-Open No. 09-068822 and particles of the resin may be surface-treated also by means of a technique described in the patent document.

Thus, according to the invention, the surface free energy is determined for both the surface of the photosensitive member and the toner to be used and the adhesion work W is obtained through arithmetic computations using the surface free energy values. For the purpose of the invention, a combination of a photosensitive member and toner that makes the value of W to be found within a range between 60 and 110 [mN/m] will be used.

The developing bias and the intensity of light of exposure are preferably regulated depending on the photosensitive member and the toner.

Now, the present invention will be further described non-limitatively by way of experiments and examples.

EXPERIMENT 1 a-Si/SiC Eu, D. O. S.

In this experiment, a film forming apparatus adapted to use an RF-PCVD technique as shown in FIG. 9 was used to prepare a photosensitive member to be used for an image-forming apparatus. Firstly, an aluminum cylinder with a diameter of ϕ80 that had been mirror-polished and another aluminum cylinder also with a diameter of ϕ80 but whose surface had been processed to produce undulations by the above described known technique were used. Then, a charge-injection impeding layer, a photoconductive layer and a surface layer were formed on each of the cylinders under the conditions listed in Table 1 below.

TABLE 1

| | Charge-injection impeding layer | Photo-conductive layer | Surface layer |
|---|---|---|---|
| Gas Flow Rate | | | |
| $SiH_4$[SCCM] | 100 | 200 | 10 |
| $H_2$[SCCM] | 300 | 800 | |
| $B_2H_6$[PPM] (Based on $SiH_4$) | 2000 | 2 | |
| NO[SCCM] | 50 | | |
| $CH_4$[SCCM] | | | 500 |
| Substrate Temperature [° C.] | 290 | 290 | 290 |
| Inner Pressure [Pa] | 50 | 65 | 65 |
| Power [W] | 500 | 800 | 300 |
| Film Thickness [μm] | 3 | 30 | 0.5 |

Additionally, various specimens of photosensitive member were prepared by varying the mixture ratio of $SiH_4$ and $H_2$ of the photoconductive layer and the discharge power. If necessary, the surface of any of the obtained specimens was polished to remove the projections of the surface or subjected to a process of roughing the surface by using powdery SiC or diamond.

The prepared specimens of photosensitive member were mounted on respective image-forming apparatus (NP6750: tradename, available from Canon; modified for the test) and tested for the temperature dependency of the charge bearability (temperature characteristics), the optical memory and defective images.

For each specimen, the surface potential of the photosensitive member was observed by arranging the drum surface potential sensor contained in the Canon's NP6750 at a position of the developing unit of the image-forming apparatus in the test of evaluating the electric characteristics of each specimen without actually forming an image and at a position between the corona unit and the developing unit in the sense of rotation of the photosensitive member that is not practically affected by electric discharges and does not affect the process of exposure. The distance between the sensor and the surface of the photosensitive member was made equal to the SD gap.

After arranging the potential sensor, the characteristic values are observed. The average potential in the peripheral direction taken at the middle in the axial direction was used as reference surface potential Vd of the photosensitive member. The unevenness of potential in the peripheral direction $\Delta V_{d_rot}$ and the unevenness of potential in the axial direction $\Delta V_{d_ax}$ of the photosensitive member were also evaluated.

After exposing the specimen to conditioning light from the conditioning light source 109, a given voltage was applied by means the corona unit and the corona current, the corona voltage and the surface potential of the photosensitive member were observed, while idly rotating the photosensitive member without feeding copy paper. The electric characteristics of the photosensitive member were measured before and after a long running test for observing the durability.

Unevenness of Potential

Of the specimens of photosensitive member, those whose $\Delta V_{d_rot}$ and $\Delta V_{d_ax}$ were both less than 20 V were used for the durability test.

Temperature Characteristic

The temperature dependency of the charge bearability (hereinafter referred to as "temperature characteristic") was evaluated by measuring the surface potential of the photosensitive member (darkness potential: Vd) when no image exposure signal was irradiated onto the surface of the photosensitive member, while changing the surface temperature of the photosensitive member from room temperature to 45° C., to see the variation of Vd per 1° C. Specimens with 2 V/deg or less were evaluated as good.

Imaging Conditions

Characteristic values were evaluated by an imaging test using the specimens of toner prepared by means of the above described process.

Imaging effect was evaluated by a continuous imaging test conducted under the following conditions:

- Environment of 35±2° C., 85±10% RH (hereinafter referred to environment H/H)
- Environment of 25±2° C., 45±5% RH (hereinafter referred to environment N/N)
- Environment of 25±2° C., 10±5% RH (hereinafter referred to environment N/L)
- Environment of 15±2° C., 10±5% RH (hereinafter referred to environment L/L)

Judgment on Defective Cleaning

To evaluate the defective cleaning by seeing the presence or absence of "fog" produced on flat white by toner by means of Tricolor [black/half tone/white] Test Chart (FY-9-9017-000: tradename, available from Canon) and NA-7 Test Chart (FY-9-9060-000: tradename, available from Canon).

If the produced images were differentiated due to the environmental difference, the image with the worst image quality was used for the evaluation.

More specifically, the tricolor chart was used for imaging in the different environments and the obtained image was evaluated by seeing the clearness of the boundaries of different colors, the presence or absence of stripes of leaked toner running in the sense of rotation of the photosensitive member and fog.

The fog on the image was evaluated by using a reflection densitometer (Reflectometer Model TC-6DS: tradename, available from Tokyo Denshoku) and obtained the value of Ds-Dr, where Ds represents the worst reflected density of white of copy paper after the imaging and Dr represents the average reflected density of white of copy paper before the imaging.

The following rating standards in terms of fogging were used.

1. excellent: Ds-Dr less than 1.0%
2. good: Ds-Dr between 1.0 and 1.3%
3. fairly good: Ds-Dr between 1.3 and 1.7%
4. usable: Ds-Dr between 1.7 and 2.0%
5. fairly usable: Ds-Dr more than 2.0%

In the examples, the specimens evaluated as the rating of 3 or above were used.

Before and after the durability test and also after testing every thousands specimens, the cleaning unit was taken out and observed for the presence or absence of chippings of the cleaning blade through a microscope and it was also evaluated by measuring the density of the produced images.

The photosensitive member was also taken out to observe the presence or absence of residual toner on the surface before and after the durability test and also after testing every thousands specimens.

The image density was determined by means of a SPI filter, using a Macbeth Density Meter RD-918 (tradename, available from Macbeth).

Firstly, the above chart was used for sampling the images and the presence or absence of black stripes was checked in the sense of rotation of the photosensitive member.

Secondly, a piece of adhesive such as sticky tape was applied to the surface of the photosensitive member at a position that had passed by the cleaning unit and the adhesive was made to stick to the copy paper. Then, the reflection density of the adhesive was measured by means of a reflection densitometer as in the case of fog evaluation. The average of the measured values is expressed by Dt.

On the other hand, the surface of the photosensitive member was wiped clean by dry wiping or wet wiping using alcohol to remove the residual toner and a same test was conducted to evaluate the effect of the cleaning operation. The value obtained by the reflection densitometer is expressed by Dn.

As in the case of fog evaluation the cleaning was evaluated as defective when Dt-Dn is greater than 2.0% or when black stripes were produced on the image by toner and running in the sense of rotation of the photosensitive member.

The following rating standards in terms of defective cleaning were used to evaluate defective cleaning.

5. excellent (no black stripes due to the blade and Dt-Dn less than 1.0%)
4. good (no black stripes due to the blade and Dt-Dn between 1.0 and 1.3%)
3. fairly good (less than three black stripes less than 1.5 mm long and Dt-Dn between 1.3 and 1.7%)
2. usable (less than five black stripes less than 2.0 mm long and Dt-Dn between 1.7 and 2.0%)
1. fairly usable (black stripes exceeding the above definition and Dt-Dn greater than 2.0%)

Optical Memory

A half tone chart (Test Chart FY9-9042-000 or FY9-9098-000: tradename, available from Canon) and a ghost chart (FY9-9040-000: tradename, available from Canon) were used to evaluate the optical memory.

As for optical memory, the quantity of optical memory was determined by observing the image in various different environments by means of a reflection densitometer (available from Macbeth) and then, after forming an image, the average reflection density of the half tone section was subtracted from the average reflection density of the optical memory section on the half tone (Dm-Dr). The obtained results were regulated by visual observation and rated as follows.

1. excellent
2. good
3. fairly good
4. usable
5. fairly usable

The standards used for the rating of optical memory were as follows.

1. quantity of optical memory: less than 0.05 and visually unrecognizable (excellent)
2. quantity of optical memory: not less than 0.05 and less than 0.10; no difference of density visually observable (good)
3. quantity of optical memory: not less than 0.10 and less than 0.15; difference of density visually slightly observable (fairly good)
4. quantity of optical memory: not less than 0.15 and less than 0.20; difference of density observable (usable)
5. quantity of optical memory: not less than 0.35; difference of density visually observable (fairly usable)

Smeared Image

To evaluate the extent of smear of images formed by each of the specimens, the image-forming apparatus carrying the specimen of photosensitive member and toner was left in an H/H environment for an appropriate period exceeding 72 hours to make the inside of the apparatus sufficiently and stably exposed to the environment. Thereafter, a running durability test operation was conducted by using 50,000 sheets of copy paper. Then, the power was turned off and the apparatus was left idle for 24 hours. Subsequently, an imaging test was conducted continuously on 100 sheets of copy paper by using the charts listed below and the produced images were evaluated.

While the tested specimens carried an environment protection heater (drum heater) depending on the type thereof, the experiment was conducted without using the heater.

The following imaging charts were used:

ABC Chart (FY9-9058-000: tradename, available from Canon) and

NA-7 Chart (FY9-9060-000: tradename, available from Canon).

The extent of smear of the images was evaluated by visual observation including observation through a microscope and rated by using the following rating system.

1. excellent
2. good
3. fairly good
4. usable
5. fairly usable

The standards used for the rating of smeared image were as follows.

1. the extent of blurred gaps separating fine lines: not less than 9.0 and visually unrecognizable (excellent)
2. the extent of blurred gaps separating fine lines: not less than 7.1 and visually substantially unrecognizable (good)
3. the extent of blurred gaps separating fine lines: not less than 5.0 and visually substantially unrecognizable (fairly good)
4. the extent of blurred gaps separating fine lines: not less than 4.5 and visually recognizable (usable)
5. the extent of blurred gaps separating fine lines: less than 4.0 and visually recognizable (fairly usable)

Coarseness of Image

To evaluate the coarseness of images formed by each of the specimens, the image-forming apparatus carrying the specimen of photosensitive member and toner was left in an appropriate environment for an appropriate period exceeding 72 hours to make the inside of the apparatus sufficiently and stably exposed to the environment. Thereafter, a running durability test operation was conducted by using 50,000 sheets of copy paper. Then, the power was turned off and the apparatus was left idle for 24 hours. Subsequently, an imaging test was conducted continuously on 100 sheets of copy paper by using the charts listed below and the produced images were evaluated.

While the tested specimens carried an environment protection heater (drum heater) depending on the type thereof, the experiment was conducted without using the heater.

The following imaging charts were used:

NA-7 Chart (FY9-9060-000: tradename, available from Canon) and Half Tone Test Chart (FY9-9042-000 or FY9-9098-000: Tradename, available from Canon).

The extent of coarseness of the images were evaluated by visual observation including observation through a microscope and rated by using the following rating system.

1. excellent
2. good
3. fairly good
4. usable
5. fairly usable

The standards used for the rating of coarse image were as follows.

1. the extent of gaps separating broken fine lines: not less than 9.0 and visually unrecognizable (excellent)
2. the extent of gaps separating broken fine lines: not less than 7.1 and visually substantially unrecognizable (good)
3. the extent of gaps separating broken fine lines: not less than 5.0 and visually substantially unrecognizable (permissible)
4. the extent of gaps separating broken fine lines: not less than 4.5 and visually recognizable (usable)
5. the extent of gaps separating broken fine lines: not more than 4.0 (less than 4.5) and visually recognizable (poorly usable)

Spot Level

Additionally, the obtained images were evaluated for white spots and black spots as well as other defects. More specifically, the size and the number of the spots were determined by using:

Flat Black Test Chart (FY9-9073-000: tradename, available from Canon),

Half Tone Test Chart (FY9-9042-000: tradename, available from Canon) and White Paper (copy paper).

Additionally a running durability test was conducted by using TC-Al Test Chart (FY9-9045-000: tradename, available from Canon) as original. During this test, the above test charts were used to produce imaging samples be every appropriate number of sheets.

D. O. S., Eu

On the other hand, a 1 $\mu$m thick a-Si film was formed by deposition on a glass substrate (7059: tradename, available from Coning) and an Si wafer arranged in a cylindrical sample holder under the conditions of preparing a photoconductive layer. Then, a comb-shaped Al electrode was formed by evaporation on the deposition film on the glass substrate and the characteristic energy at the exponential Urbach's tail (Eu) and the localized state density (D. O. S.) were observed by means of CPM, whereas the hydrogen content of the deposition film on the Si wafer was measured by means of FT-IR (Fourier transform infra-red absorption).

Figure 12:
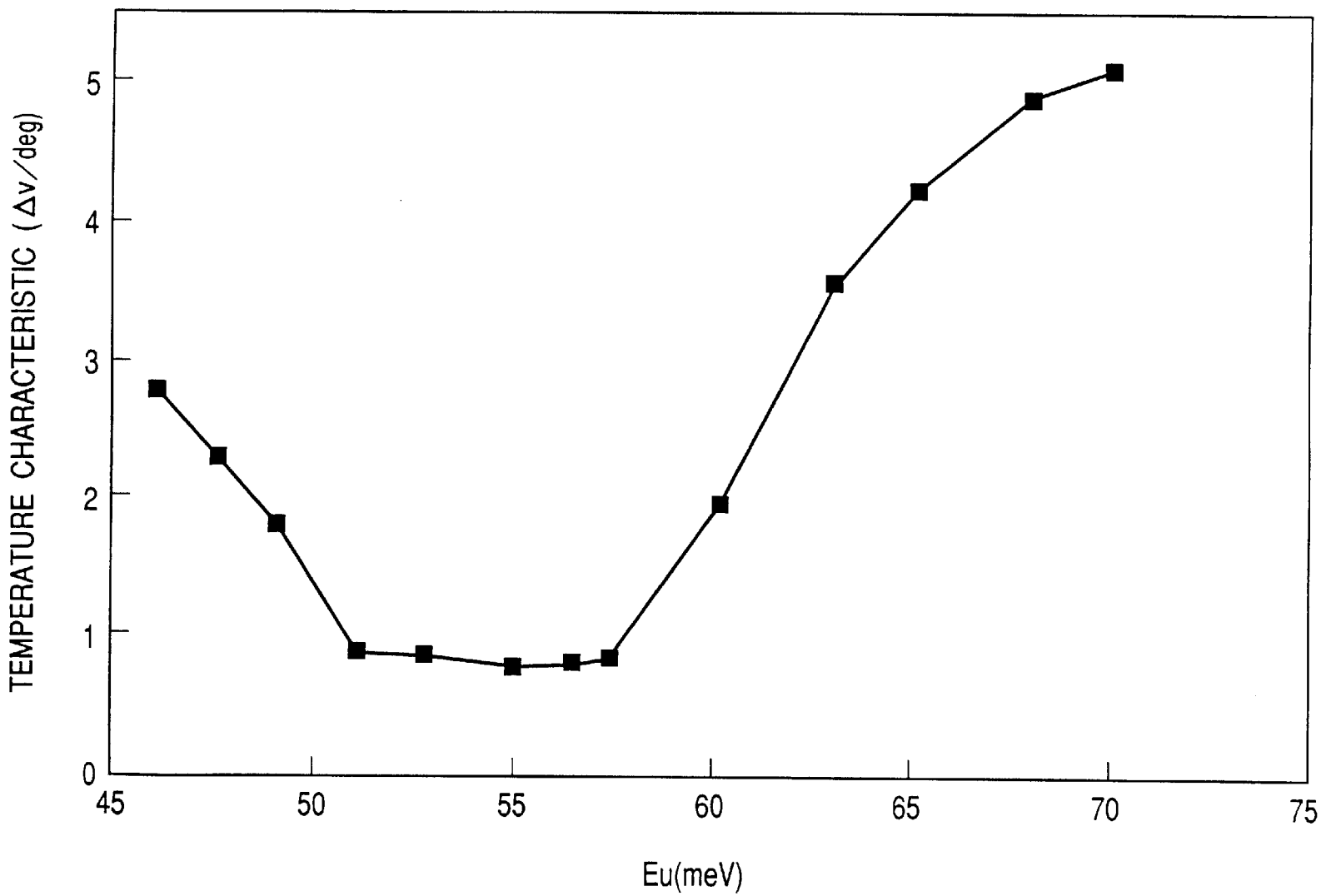
FIG. 12 is a graph illustrating the relationship between Eu and the temperature characteristic of a photosensitive member.
Figure 13:
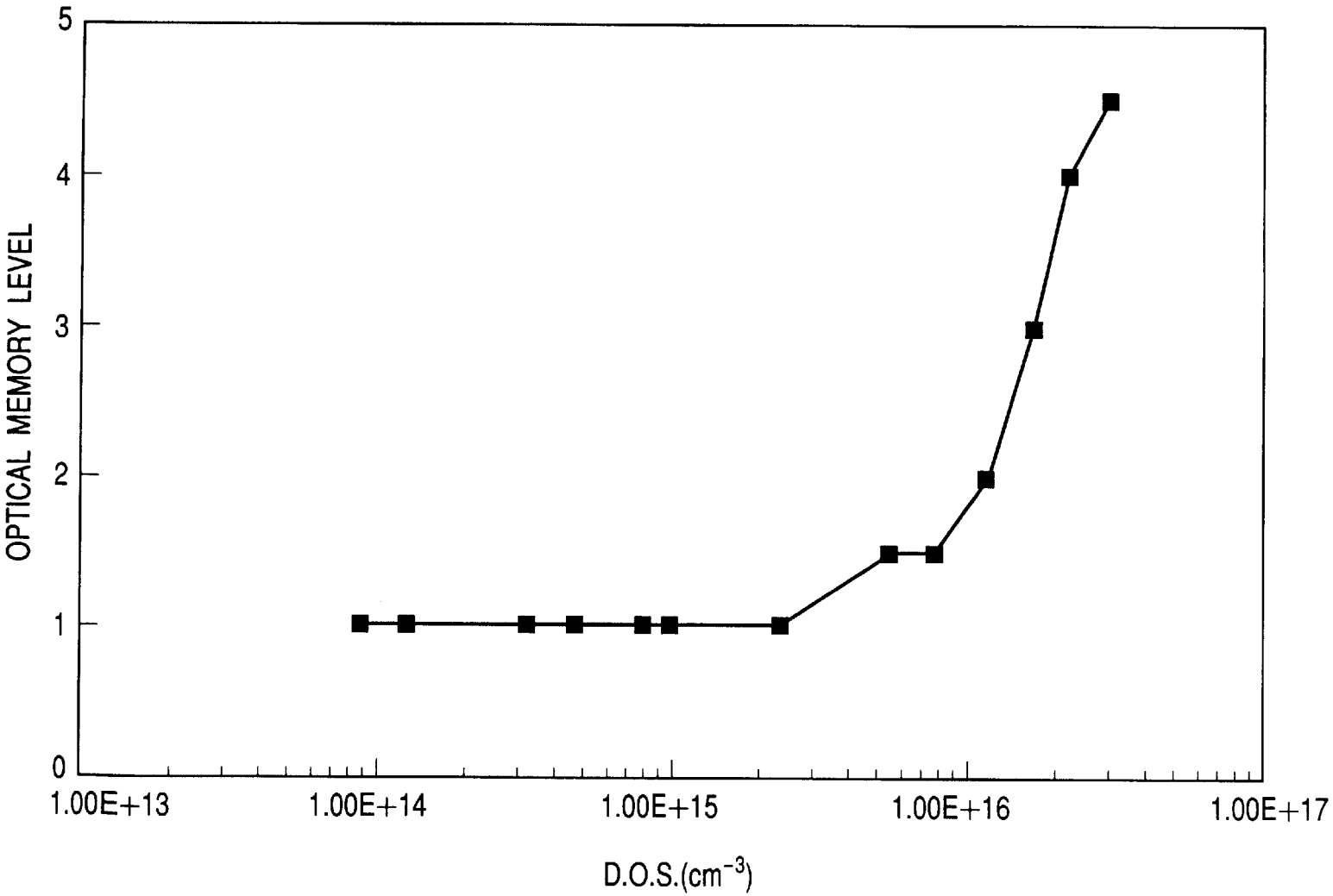
FIG. 13 is a graph illustrating the relationship between D.O.S. and the optical memory level of a photosensitive member.
Figure 14:
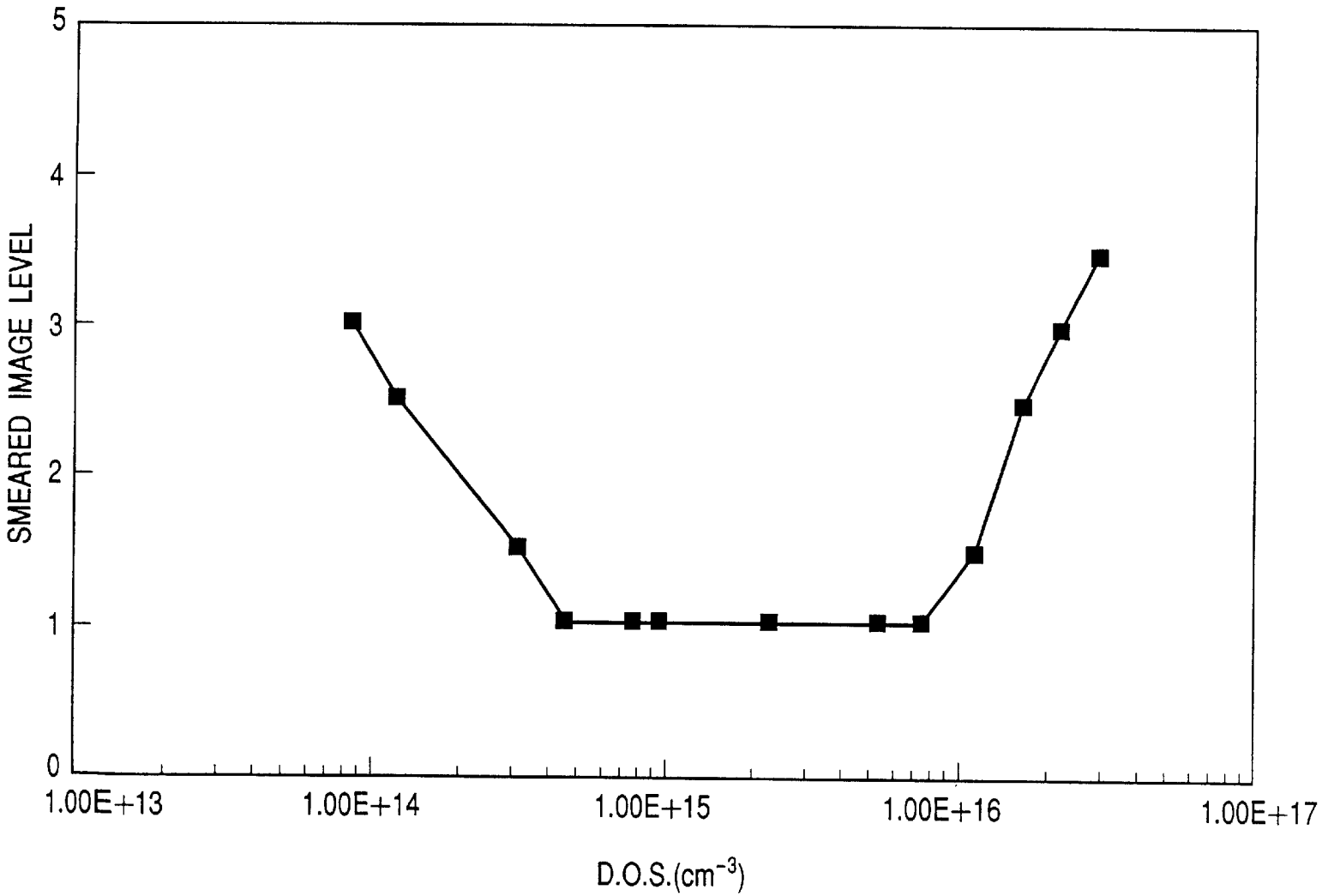
FIG. 14 is a graph illustrating the relationship between D.O.S and the smeared image level of a photosensitive member.
Figure 15:
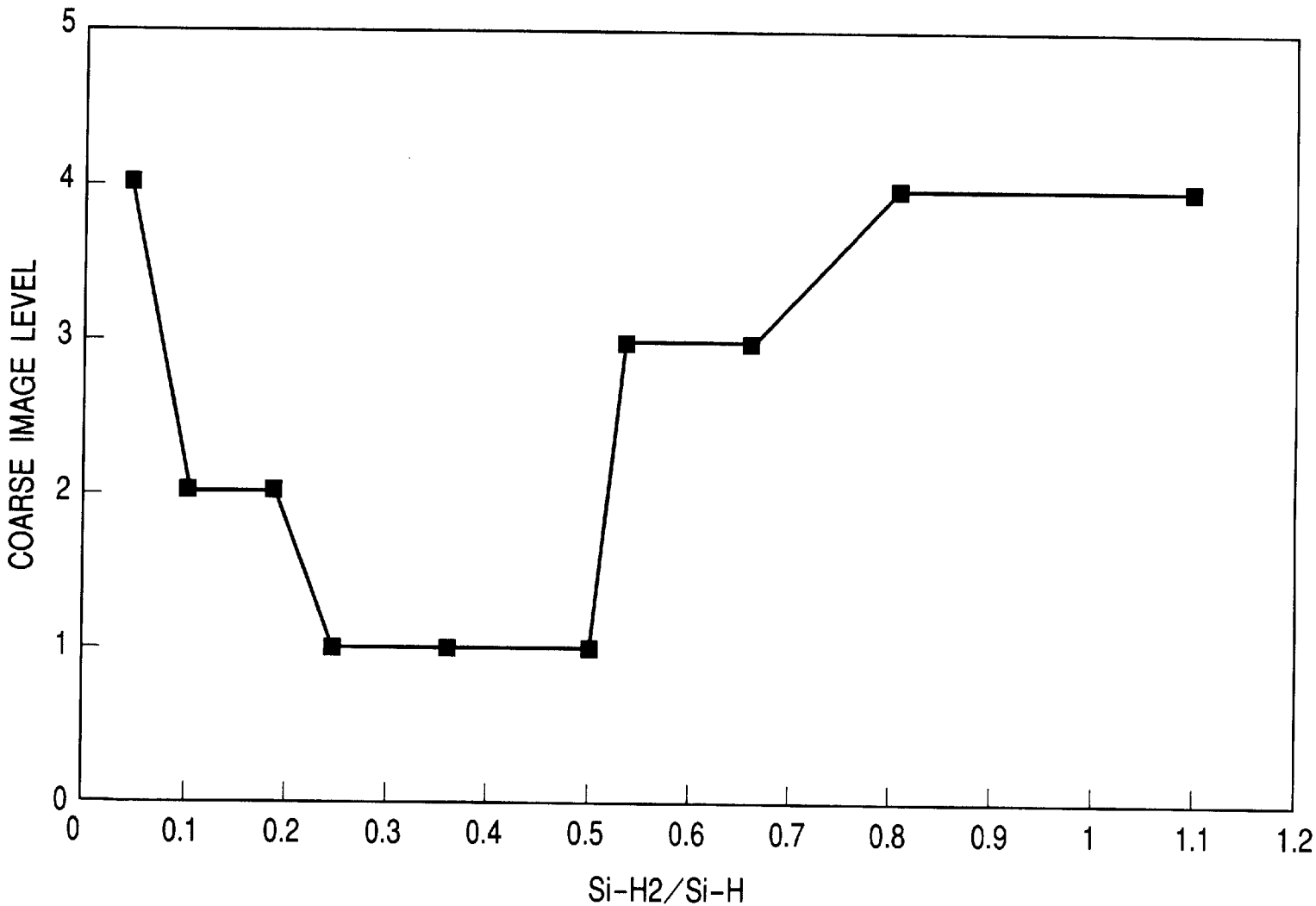
FIG. 15 is a graph illustrating the relationship between Si—$H_2$/Si—H (hydrogen bond level) and the coarse image level of a photosensitive member.

FIG. 12 shows the relationship between Eu and the temperature characteristic and FIGS. 13 and 14 show the relationships between D. O. S. and the optical memory level and the smeared image level respectively. FIG. 15 shows the relationship between the ratio of Si—$H_2$/Si—H and the coarse image level. The hydrogen contents of all the specimens were found between 10 and 30 atomic %.

As seen from FIGS. 12 through 15, it was found that excellent electrophotographs can be obtained when the characteristic energy (Eu) at the exponential Urbach's tail is between 50 and 60 meV as obtained from the subbandgap light absorption spectrum and the D. O. S. under the conduction band is between $1\times10^{14}$ and $1\times10^{16}$ $cm^{-3}$, while the hydrogen bond ratio (ratio of Si—$H_2$/Si—H) is between 0.2 and 0.5.

Electric Resistivity

Samples of surface layers were prepared in the same way and the electric resistance was measured by using a comb-shaped electrode. The electric resistance was measured within a range of applied voltage between 250 and 1 kV by means of an MΩ tester available from HIOKI. Then, the withstand voltage was measured by using the resistance of the above samples and the critical voltage for dielectric breakdown obtained by applying the above voltage to the samples.

Meanwhile, specimens of photosensitive members carrying a surface layer same as the above samples were prepared and mounted in respective image-forming apparatus, which were then left respectively in the environment of 20° C. and 10% RH for an appropriate period exceeding 72 hours to make the inside of the apparatus sufficiently and stably exposed to the environment. Additionally, a developing unit was installed and a running durability test operation was conducted by using 50,000 sheets of copy paper. Then, an imaging test was conducted continuously on 100 sheets of copy paper using a flat black chart, a half tone chart and a sheet of copy paper as originals and the obtained images were evaluated for the generation of pin hole leaks from the fine defects on the surface of the photosensitive member. The photosensitive member was also tested for the withstand voltage.

Figure 16:
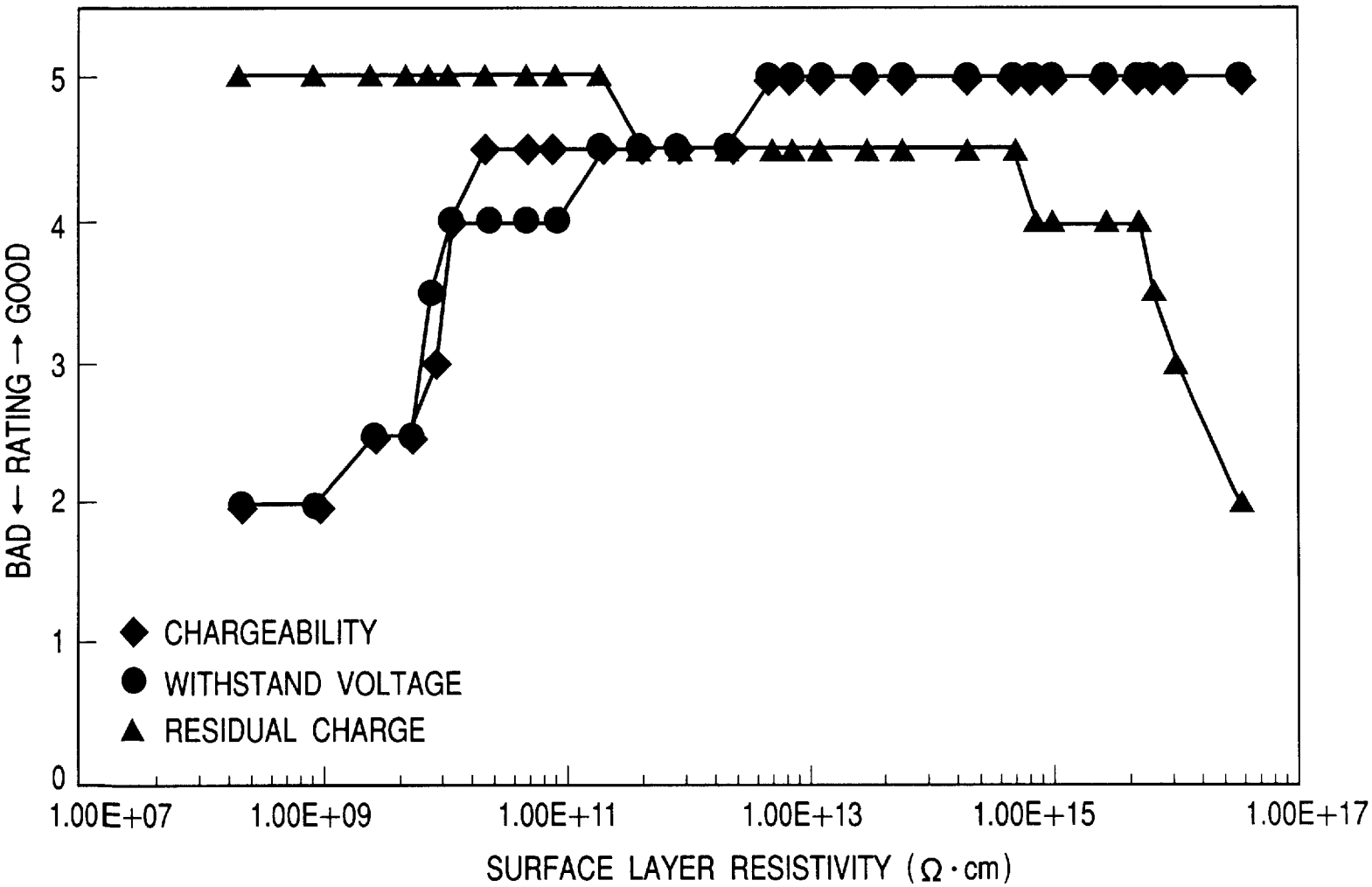
FIG. 16 is a graph illustrating the relationship between the surface layer resistivity and the rating of a photosensitive member.

As seen from FIG. 16 showing the results obtained from the samples of deposition film and photosensitive member, the electric resistance of the surface of the photosensitive member is preferably between $1\times10^{10}$ and $5\times10^{15}$ Ωcm , more preferably between $5\times10^{12}$ and $5\times10^{14}$ Ωcm in order to realize excellent electric characteristics in terms of charge bearability, electrostatic charging efficiency and residual electric charge and prevent pin hole leaks that can damage the surface layer as voltage is applied thereto.

The above durability test was conducted by removing the developing unit and the cleaning unit from the image-forming apparatus as described earlier (which is referred to as "idling apparatus" hereinafter) but arranging an electrometer in place of the developing unit and another electrometer at an appropriate position between the developing unit and the electrostatically charging member.

Note that the specimens were subjected to a running durability test equivalent to a test of running more than 100 thousands sheets for all the above listed test items under a condition of 25° C. and 45% RH unless otherwise noted although no copy paper was actually used in the test.

The environment protection heater was kept off during the running durability test operation.

Thus, the influence of a defective cleaning blade, a defective cleaning roller and/or a defective cleaning brush as well as defective cleaning due to fused toner and/or a filming phenomenon was successfully isolated from the influence of variations in the film thickness of the photosensitive member, the quantity of exposure light for forming an image and the surface potential of the photosensitive member.

The surface potential of the photosensitive member was monitored at positions other than that of the developing unit for the durability test.

The variations in the electric characteristics of the idling apparatus comprising the tested photosensitive member after the durability test were found within ±5% of the corresponding values prior to the durability test to prove that no substantial change occurred in the performance of the apparatus during the test.

EXPERIMENT 2

(*a-Si type photosensitive member/a-C surface layer**Eu, D. O. S.)

In this experiment, a film forming apparatus adapted to use an VHF-PCVD technique as shown in FIG. 10 was used to prepare a photosensitive member to be used for an image-forming apparatus. Firstly, an aluminum cylinder with a diameter of ϕ80 that had been mirror-polished and another aluminum cylinder also with a diameter of ϕ80 but whose surface had been processed to produce undulations by the above described known technique were used. Then, a charge-injection impeding layer, a photoconductive layer and a surface layer were formed on each of the cylinders under the conditions listed in Table 2 below.

TABLE 2

| | Charge-injection impeding layer | Photo-conductive layer | Surface layer |
|---|---|---|---|
| Gas Flow Rate | | | |
| $SiH_4$[SCCM] | 150 | 200 | |
| $SiF_4$[SCCM] | 5 | 3 | |
| $H_2$[SCCM] | 500 | 800 | 450 |
| $B_2H_6$[PPM] (Based on $SiH_4$) | 1500 | 3 | |
| NO[SCCM] | 10 | | |
| $CH_4$[SCCM] | 5 | | 0→200→200 |
| $CF_4$[SCCM] | | | (0→300→300) |
| Substrate Temperature [° C.] | 300 | 300 | 250 |
| Inner Pressure [Pa] | 4 | 1.3 | 2.7 |
| Power [W] | 200 | 600 | 800 |
| Film Thickness [μm] | 2 | 30 | 0.5 |

Additionally, various photosensitive members were prepared by changing the mixing ratio of $SiH_4$ and $H_2$ of the photoconductive layer and the discharge power.

Whenever necessary, the surface of the obtained specimens were polished to remove the undulations and the coarseness by means of SiC powder and diamond powder.

$CF_4$ was replaced by a-C:H for the surface layer of some of the specimens.

Meanwhile, as in Experiment 1, a 1 μm thick a-Si film was formed by deposition on a glass substrate (7059: tradename, available from Coning) and an Si wafer arranged in a cylindrical holder under the conditions of preparing a photoconductive layer. Then, a comb-shaped Al electrode was formed by evaporation on the deposition film of the glass substrate and the characteristic energy at the exponential Urbach's tail (Eu) and the localized state density (D. O. S.) were observed by means of CPM, whereas the hydrogen content of the deposition film on the Si wafer was measured by means of FT-IR (Fourier transform infra-red absorption).

As in the case of Experiment 1, it was found that excellent electrophotographs can be obtained when the characteristic energy (Eu) at the exponential Urbach's tail is between 50 and 60 meV ad obtained from the subbandgap light absorption spectrum and the D. O. S. under the conduction band is between $1\times10^{14}$ and $1\times10^{16}$ $cm^{-3}$.

Also as in the case of Experiment 1, the electric resistance of the surface of the photosensitive member is preferably between $1\times10^{10}$ and $5\times10^{15}$ Ωcm , more preferably between $1\times10^{12}$ and $1\times10^{14}$ Ωcm in order to realize excellent electric characteristics in terms of charge bearability, electrostatic charging efficiency and residual electric charge and prevent pin hole leaks that can damage the surface layer as voltage is applied thereto.

Now, the present invention will be described further by way of examples.

However, the present invention is by no means limited by the examples and any other configurations may be used for the purpose of the invention so long as such configurations provide the effects and the advantages of the present invention.

In the following examples, photosensitive members having an photoconductive layer with excellent values in terms of Eu, D. O. S. and a surface layer with an excellent resistivity were used.

EXAMPLE 1 a-Si/SiC+1 component toner

A film forming apparatus adapted to use an RF-PCVD technique as shown in FIG. 9 was used to prepare a photosensitive member to be used for an image-forming apparatus that comprises a charge-injection impeding layer, a photoconductive layer and a surface layer as in Experiment 1.

Identical photoconductive layers were prepared for the specimens of photosensitive members in such a way that they showed excellent values for D. O. S. and Eu as obtained in the experiments.

The photosensitive members with three different outer diameter of ϕ30, 80 and 108 were prepared in this example.

The surface layers of the specimens were differentiated by regulating the mixing ratio of the source gases and the discharge power. The prepared photosensitive members were polished to remove the projections and treated for the coarseness by means of SiC powder and diamond powder to see the surface free energy ($\gamma_{DRUM}$) and other characteristic values.

The obtained characteristic values of photosensitive members A1 through J1 of this example are listed in Table 3 below.

The surface free energy was determined for each specimen by means of contact angle gauge CA-S ROLL and computer software EG-11 as cited earlier (tradenames, available from Kyowa Kaimen).

The surface coarseness Rz was determined by means of surf coder SE-30D (tradename, available from Kosaka Research).

TABLE 3

| | D.O.S [$cm^{-3}$] | Eu [meV] | Surface resistivity [Ω · cm] | Surface Rz [μm] | γ DRUM [mN/m] |
|---|---|---|---|---|---|
| A1 | $4 \times 10^{15}$ | 53 | $5.0 \times 10^{10}$ | 0.12 | 40.3 |
| B1 | | | $3.1 \times 10^{11}$ | 0.24 | 42.8 |
| C1 | | | $1.5 \times 10^{12}$ | 0.21 | 53.0 |
| D1 | | | $7.8 \times 10^{12}$ | 0.46 | 46.1 |
| E1 | | | $1.3 \times 10^{13}$ | 0.34 | 56.3 |
| F1 | | | $5.1 \times 10^{13}$ | 0.10 | 43.3 |
| G1 | | | $8.8 \times 10^{13}$ | 0.40 | 60.0 |
| H1 | | | $1.4 \times 10^{14}$ | 0.35 | 58.2 |
| I1 | | | $9.8 \times 10^{14}$ | 0.28 | 47.5 |
| J1 | | | $3.1 \times 10^{15}$ | 0.30 | 43.9 |

On the other hand, toners were prepared in a manner as described below.

Toner Preparation Example 1

(1-component toner and 2-component toner)

The binder resin was prepared in the following way.

A 6.0 mol of terephthalic acid, a 3.0 mol of n-dodecenyl succinic anhydride, a 10.0 mol of propyleneoxide adduct (2.2 mol) of bis-phenol A, a 0.7 mol of trimelitic anhydride and a 0.1 mol of dibutyltinoxide were put into a reaction vessel provided with a thermometer, a stirring rod, a condenser and a nitrogen inlet pipe. After replacing the internal atmosphere with nitrogen, the temperature of the reaction vessel was raised gradually and the materials were made to react with each other at 180° C. for 5 hours. Then, the temperature was raised further to 200° C. and the internal pressure was reduced (15 hPa) to encourage the reaction for the purpose of dehydrocondensation for 4 hours, at the end of which the reaction was terminated to obtain polyester resin (1). The obtained polyester resin (1) showed a peak molecular weight of 10700 and a glass transition point of 63° C.

Then, a 100 weight portions of the polyester resin (1) obtained as binder resin, a 5 weight portions of a carbon black pigment, a 4 weight portions of chromium di-t-butysalycilate complex were preliminarily mixed by means of a Henschel mixer and then molten and kneaded by means of a biaxial extruder heated to 130° C. After cooling the kneaded mixture, it was powdered to fine particles by means of a powdering machine using a jet air stream and sorted out by means of a wind power sorter to obtain a sorted powdery product (1) having a weight average particle diameter of 8 μm.

Meanwhile a polymer A was obtained from a 1,600 g of styrene, a 400 g of butylacrylate and a 4 g of 2,2-bis (4,4-di-t-butylperoxycyclohexyl)propane by means of a suspension polymerization technique.

Similarly, a polymer B was obtained from a 2,550 g of styrene, a 450 g of butylacrylate and a 60 g of di-t-butylperoxide by means of a solution polymerization technique using xylene as solvent. Then the polymer A and the polymer B were mixed as solution to a ratio of 25:75 by weight to produce a styrene type resin (4). The obtained styrene type resin (4) showed peak molecular weights of 9,400 and 720,000 and a glass transition point of 60° C.

Then, a 100 weight portions of the styrene type resin (4) was preliminarily mixed with a 80 weight portions of magnetite (magnetic iron oxide), a 2 weight portions of chromium di-t-butyl-salycilate and a 3 weight portions of low molecular weight ethylene-propylene copolymer in a Henschel mixer and then molten and kneaded by means of a biaxial extruder heated to 130° C. After cooling the kneaded mixture, it was powdered to fine particles by means of a powdering machine using a jet air stream and sorted out by means of a wind power sorter to obtained a sorted powdery product (2) having a weight average particle diameter of 8 μm.

Outer Additive

A processed inorganic powdery material was prepared in the following way.

A 1 kg of toluene and a 200 g of a powdery material to be processed were put into a container and stirred by means of a mixer to produce a slurry, to which a prescribed processing agent was added. The mixture was further stirred in the mixer and the slurry was crushed by means of a sand mill using zirconia balls as crushing medium for 30 minutes.

Then, the slurry was taken out of the sand mill and the toluene contained therein was driven off at 60° C. under reduced pressure. Thereafter, the slurry was stirred and dried in a stainless steel container at 200 to 300° C. for 2 hours. The obtained powdery product was then crushed in a hammer mill to produce the intended and processed inorganic powdery material. The above technique is referred to as organic solvent method (solvent method).

An intended and processed inorganic may alternatively be prepared by means of a vapor phase method. With a vapor phase method, the fine powder to be processed is stirred slowly, while diluting it, if necessary, with an appropriate amount of n-hexane. Then, the powder is sprayed and the fine powder to be processed is further added thereto while the remain of the prescribed amount is sprayed. After the process of adding the prescribed amount is over, the mixture is stirred at high speed at room temperature and then heated to 200 to 300° C. Then, the mixture is cooled to room temperature, while it is being stirred, and taken out from the mixer. Then, it is taken out of the mixer and crushed by means of a hammer mill to produce the intended and processed inorganic powdery material.

The obtained inorganic powdery material is added to a 100 weight portions of the above sorted product and stirred in a Henschel mixer to produce toner a. The rate at which the outer addition is added will be selected appropriately as a function of the type of the outer additive, the hardness of the photosensitive member to be used, the quality of image to be produced and other factors. In the case of the above described outer additive, it was used by 1 to 30 weight portions relative to the above mentioned amount of the sorted product.

When using a 1-component toner, the toner a was used straight (hereinafter referred to as toner a1). When, on the other hand, using a 2-component toner, it was prepared in a manner as described below.

The toner a above was mixed with a Cu—Zn—Fe type ferrite carrier material coated with silicone resin to 0.45 wt % to achieve a toner concentration of 5 wt % and produce a developing agent (to be referred to as toner b1 hereinafter).

On the other hand, the toner a above was mixed with a Cu—Zn—Fe type ferrite carrier material coated with styrene-butylmetacrylate copolymer (weight ratio 80:20) to a 0.35 wt % and silicone resin to a 0.15 wt % to achieve a toner concentration of 0.7 wt % and produce a developing agent (to be referred to as toner c1 hereinafter).

Then, the toner a was mixed with a Cu—Fe type ferrite carrier material coated with styrene-methylmethacrylate copolymer (weight ratio 65:35) to 2.5 wt % to achieve a toner concentration of 7 wt % and produce a developing agent (to be referred to as toner d1).

Toner Preparation Example 2

Meanwhile, another toner was prepared in the following way.

A 85 weight portions of styrene, a 15 weight portions of n-butyl-acrylate and a 0.27 weight portions of monobutyl maleate were added to a reflux of a 300 portions of xylene and stirred. Then, a solution obtained by dissolving a 2 weight portions of di-tert-butyl-peroxide into a 10 weight portions of xylene was dropped therein. When the amount of the solution being dropped was reduced to nearly a half of the initial amount, a 0.05 weight portions of monobutyl maleate was added thereto. The mixture was allowed to complete the process of polymerization for 5 hours to obtain a solution of a low molecular weight polymer (L: acid value Av=0.22 ).

A suspension was prepared in a reaction vessel from a 180 weight portions of deaerated water, a 200 weight portions of 2 wt % aqueous solution of polyvinyl alcohol, a 74 weight portions of styrene, a 25 weight portions of n-butyl-acrylate, a 5 weight portions of monobutyl maleate and a 0.005 weight portions of divinylbenzene.

Thereafter, a solution of a 0.1 portion of 2,2-bis(4,4-di-tert-butylperoxycyclohexyl)propane (half life: 10 hours, temperature: 92° C.) dissolved in a 10 portions of xylene was dropped into the above suspension, when the amount of the solution being dropped was reduced to nearly a half of the initial amount, a 1 portion of monobutyl maleate was added thereto. After a given process of raising and keeping temperatures, a high molecular weight polymer (H: Av=9.45) was obtained.

After the completion of the reaction, NaOH aqueous solution was added to the suspension by an amount equivalent to a double of the Av of the high molecular weight polymer (H) followed by stirring for 2 hours and, after filtering and washing the mixture with water and drying it, it was chemically analyzed to find that the tetrahydrofuran (THF) insoluble content was only 0.7%, or substantially equal to nil.

A 100 weight portions of xylene and a 28 weight portions of the above high molecular weight polymer (H) was used as binder resin and stirred in a refluxed state at high temperature for preliminary dissolution. After keeping the above condition for 12 hours, a preliminarily dissolved uniform solution (Y) of the high molecular weight polymer (H) was obtained.

On the other hand, a 300 weight portions of a uniform solution of said low molecular weight polymer (L) was held in a refluxed state in a different container.

Said preliminarily dissolved solution (Y) and said low molecular weight polymer (L) solution were mixed with each other in a refluxed state and the organic solvent was removed therefrom. Then, the obtained resin was cooled to solidify and the obtained solid was crushed to produce toner resin (2). The resin (2) showed peaks of molecular weight at 8,000 and 690,000 and values of Mw=300,000, Mw/Mn=45, glass transition point Tg=60° C. and Av=2.61 for the entire resin.

Then, a 100 weight portions of the above resin (2), a 100 weight portions of ferromagnetic iron oxide, a 7 weight portions of wax and a 2 weight portions of a charge control agent were dissolved and kneaded in a biaxial extruder heated to 130° C. and the kneaded mixture was cooled and crushed in a hammer mill. The crushed product was then further crushed in a jet mill to produce a powdery product, which was then sorted to obtain sorted powder by means of a fixed-wall type wind power sorter. The sorted powder obtained by the above process was further sorted in a multi-division sorter utilizing the Coanda effect (Elblow Jet Sorting Machine: available from Nittetsu Mining) to separate ultrafine powder and coarse powder so that, as a result, a negatively chargeable toner with a weight-average diameter (D4) of 6.5 μm (content of magnetic toner particles having a diameter of 12.7 μm: 0.1%) was obtained.

Then, hydrophobic fine powder of silica was added by 1.8 wt % as outer additive to a 100 weight portions of the above toner and mixed to produce toner e1 by means of a Henschel mixer. The rate of adding the outer additive may be regulated within a range between 1 and 30 wt %.

Similarly, hydrophobic fine powder of silica was added by 1.2 wt % as outer additive to a 100 weight portions of the above toner and mixed to produce toner f1 by means of a Henschel mixer.

The photosensitive members and the toners as described above were tested for work of adhesion (W [mN/m]). Table 4 shows the obtained results.

TABLE 4

Work of Adhesion Between Photosensitive Member and Toner (W:mN/m)

| Photo-sensitive member | Toner | | | | | |
|---|---|---|---|---|---|---|
| | a1 | b1 | c1 | d1 | e1 | f1 |
| A1 | 78.5 | 75.8 | 72.1 | 68.0 | 62.9 | 60.2 |
| B1 | 80.3 | 79.5 | 75.2 | 72.1 | 68.2 | 64.4 |
| C1 | 82.5 | 80.5 | 78.6 | 74.8 | 72.6 | 68.8 |
| D1 | 82.3 | 83.0 | 81.5 | 78.0 | 74.5 | 72.2 |
| E1 | 87.6 | 84.6 | 82.8 | 81.3 | 78.3 | 75.0 |
| F1 | 89.9 | 88.2 | 85.7 | 82.0 | 82.1 | 80.9 |
| G1 | 94.7 | 90.1 | 88.5 | 84.6 | 83.2 | 82.5 |
| H1 | 98.1 | 94.5 | 90.6 | 88.1 | 84.7 | 83.8 |
| I1 | 102.1 | 100.2 | 94.8 | 90.5 | 88.4 | 86.0 |
| J1 | 108.6 | 102.6 | 99.1 | 95.6 | 90.6 | 88.8 |

Each of the prepared photosensitive members was mounted in one of the image-forming apparatus listed below depending on the outer diameter and evaluated for the characteristics as in Experiment 1. The photosensitive member with ϕ30 was mounted in image-forming apparatus A (GP55II: tradename, available from Canon, modified for the test) The photosensitive member with ϕ80 was mounted in image-forming apparatus B (NP6750: tradename, available from Canon, modified for the test) The photosensitive member with ϕ108 was mounted in image-forming apparatus C (NP6085: tradename, available from Canon, modified for the test)

The operating speed of the photosensitive member was made to vary within a range between 100 and 600 mm/sec and then the photosensitive member was exposed to preconditioning light from preconditioning light source 109. Then, the above described short electrostatically charging member as used to apply the predetermined voltage to the photosensitive member, which was then operated idly without using copy paper to observe the charge current, the voltage and the electric potential on the surface of the photosensitive member.

The specimens showed excellent results as in Experiment 1 in terms of temperature characteristics, optical memory, smeared image and leak spot.

The photosensitive members were mounted in respective image-forming apparatus and operated by running 200,000 sheets of copy paper to evaluate the running durability in three different environments of N/N (25° C. , 45% RH), H/H (35° C., 85% RH) and N/L (25° C., 10% RH). TC-Al Test Chart (FY9-9045-000: tradename, available from Canon) was used to produce an image specimen after running every selected sheets of paper for the running durability test.

The produced images were evaluated for defective cleaning, optical memory, smeared image and image defects such as white spots and black spots, using the rating system of Experiment 1.

Table 5 shows the results of the evaluation conducted on the produced image, the cleaning unit and the photosensitive member before and after the durability test. The rating symbols used in Table 5 are described below.

⊙: excellent (the initial image quality is maintained very well, no chipped blade, no degradation in terms of rating including fogging on the image, no degradation of smeared image). Rating 5

○: good (the initial image quality is maintained better than the prior art, chipped blade observable, rating of defective cleaning degraded by 1 level). Rating 4

●: poor (the initial image quality is maintained by a degree of the prior art or worse). Rating 3 to 1 (depending on the level of defective cleaning).

TABLE 5

Durability Evaluation

| Photo-sensitive member | Toner a1 | b1 | c1 | d1 | e1 | f1 |
|---|---|---|---|---|---|---|
| A1 | ⊙ | ⊙ | ⊙~○ | ○ | ○ | ○ |
| B1 | ⊙ | ⊙ | ⊙ | ⊙~○ | ○ | ○ |
| C1 | ⊙ | ⊙ | ⊙ | ⊙ | ⊙~○ | ○ |
| D1 | ⊙ | ⊙ | ⊙ | ⊙ | ⊙~○ | ⊙~○ |
| E1 | ⊙ | ⊙ | ⊙ | ⊙ | ⊙ | ⊙ |
| F1 | ⊙ | ⊙ | ⊙ | ⊙ | ⊙ | ⊙ |
| G1 | ⊙ | ⊙ | ⊙ | ⊙ | ⊙ | ⊙ |
| H1 | ⊙~○ | ⊙ | ⊙ | ⊙ | ⊙ | ⊙ |
| I1 | ○ | ⊙~○ | ⊙ | ⊙ | ⊙ | ⊙ |
| J1 | ○ | ○ | ⊙~○ | ⊙~○ | ⊙ | ⊙ |

EXAMPLE 2

(a-Si/a-C+1 component, 2-component toner)

A film forming apparatus adapted to use an VHF-PCVD technique as shown in FIG. 10 was used to prepare a photosensitive member to be used for an image-forming apparatus. Firstly, aluminum cylinders with respective diameters of ϕ30, 80 and 108 that had been mirror-polished and other similar aluminum cylinders whose surface had been processed to produce undulations by the above described known technique were used. Then, photosensitive members comprising a charge-injection impeding layer, a photoconductive layer and a surface layer were prepared from the above cylinders under the conditions listed in Table 6 below.

TABLE 6

| | Charge-injection impeding layer | Photo-conductive layer | Surface layer |
|---|---|---|---|
| Gas Flow Rate | | | |
| $SiH_4$[SCCM] | 150 | 200 | |
| $SiF_4$[SCCM] | 5 | 3 | |
| $H_2$[SCCM] | 500 | 800 | 450 |
| $B_2H_6$[PPM] (Based on $SiH_4$) | 1500 | 3 | |
| NO[SCCM] | 10 | | |
| $CH_4$[SCCM] | 5 | | 0→200→200 |
| Substrate Temperature [° C.] | 300 | 300 | 250 |
| Inner Pressure [Pa] | 4 | 1.3 | 2.7 |
| Power [W] | 200 | 600 | 800 |
| Film Thickness [μm] | 2 | 30 | 0.5 |

Specimens A2 through J2 of photosensitive member listed below were prepared by regulating the source gases and the discharge power for the photoconductive layer and the surface layer. Also toners a2 through f2 prepared as in Example 1 were used.

The photosensitive members and the toners as described above were tested for work of adhesion (W [mN/m]). Table 7 shows the obtained results.

TABLE 7

Work of Adhesion Between Photosensitive Member and Toner (W:mN/m)

| Photo-sensitive member | Toner a2 | b2 | c2 | d2 | e2 | f2 |
|---|---|---|---|---|---|---|
| A2 | 77.6 | 76.5 | 74.1 | 70.0 | 65.2 | 62.2 |
| B2 | 80.1 | 80.0 | 77.0 | 74.1 | 67.3 | 64.0 |
| C2 | 82.0 | 81.5 | 78.5 | 74.7 | 72.7 | 68.7 |
| D2 | 83.2 | 82.9 | 81.7 | 79.0 | 74.4 | 72.7 |
| E2 | 87.7 | 85.0 | 83.4 | 82.7 | 79.0 | 75.8 |
| F2 | 88.9 | 87.5 | 84.9 | 82.5 | 81.2 | 79.9 |
| G2 | 93.9 | 91.7 | 87.6 | 83.4 | 82.3 | 82.1 |
| H2 | 98.0 | 94.1 | 91.6 | 87.7 | 84.5 | 82.9 |
| I2 | 103.8 | 101.4 | 94.5 | 90.0 | 87.4 | 85.9 |
| J2 | 109.0 | 103.1 | 99.7 | 96.0 | 90.4 | 88.4 |

Each of the prepared photosensitive members was mounted in one of the image-forming apparatus depending on the outer diameter and evaluated for the characteristics as in Experiment 1. They showed a satisfactory result in terms of durability as shown in Table 8 and as in the case of Example 1. The chippings of the blade due to the projections of the surface of the photosensitive member were found to have been reduced or eliminated.

TABLE 8

Durability Evaluation

| Photo-sensitive member | Toner a2 | b2 | c2 | d2 | e2 | f2 |
|---|---|---|---|---|---|---|
| A2 | ⊙ | ⊙ | ⊙~○ | ⊙~○ | ○ | ○ |
| B2 | ⊙ | ⊙ | ⊙ | ⊙~○ | ○ | ○ |
| C2 | ⊙ | ⊙ | ⊙ | ⊙~○ | ⊙~○ | ○ |
| D2 | ⊙ | ⊙ | ⊙ | ⊙ | ⊙~○ | ⊙~○ |
| E2 | ⊙ | ⊙ | ⊙ | ⊙ | ⊙ | ⊙ |
| F2 | ⊙ | ⊙ | ⊙ | ⊙ | ⊙ | ⊙ |

TABLE 8-continued

Durability Evaluation

| Photo-sensitive member | Toner a2 | b2 | c2 | d2 | e2 | f2 |
|---|---|---|---|---|---|---|
| G2 | ◎ | ◎ | ◎ | ◎ | ◎ | ◎ |
| H2 | ◎~○ | ◎ | ◎ | ◎ | ◎ | ◎ |
| I2 | ○ | ○ | ◎ | ◎ | ◎ | ◎ |
| J2 | ○ | ○ | ◎~○ | ◎~○ | ◎ | ◎ |

EXAMPLE 3

(a-Si/a-C: F+1 component, 2-component toner)

A film forming apparatus adapted to use an VHF-PCVD technique as shown in FIG. 10 was used to prepare a photosensitive member to be used for an image-forming apparatus. Firstly, aluminum cylinders with respective diameters of ϕ30, 80 and 108 that had been mirror-polished and other similar aluminum cylinders whose surface had been processed to produce undulations by the above described known technique were used. Then, photosensitive members comprising a charge-injection impeding layer, a photoconductive layer and a surface layer were prepared from the above cylinders under the conditions listed in Table 9 below.

TABLE 9

| | Charge-injection impeding layer | Photo-conductive layer | Surface layer |
|---|---|---|---|
| Gas Flow Rate | | | |
| $SiH_4$[SCCM] | 150 | 200 | |
| $SiF_4$[SCCM] | 5 | 3 | |
| $H_2$[SCCM] | 500 | 800 | 450 |
| $B_2H_6$[PPM] (Based on $SiH_4$) | 1500 | 3 | |
| NO[SCCM] | 10 | | |
| $CH_4$[SCCM] | 5 | | 0→50→30 |
| $CF_4$[SCCM] | | | (0→100→170) |
| Substrate Temperature [° C.] | 300 | 300 | 250 |
| Inner Pressure [Pa] | 4 | 1.3 | 2.7 |
| Power [W] | 200 | 600 | 800 |
| Film Thickness [μm] | 2 | 30 | 0.5 |

Specimens A3 through J3 of photosensitive member listed below were prepared by regulating the source gases and the discharge power for the photoconductive layer and the surface layer. Also the toners used in Example 2 were used in this example. The photosensitive members and the toners as described above were tested for work of adhesion (W [mN/m]). Table 10 shows the obtained results.

TABLE 10

Work of Adhesion Between Photosensitive Member and Toner (W:mN/m)

| Photo-sensitive member | Toner a2 | b2 | c2 | d2 | e2 | f2 |
|---|---|---|---|---|---|---|
| A3 | 77.4 | 76.0 | 74.0 | 68.5 | 63.2 | 60.1 |
| B3 | 78.8 | 78.0 | 77.0 | 74.1 | 67.3 | 64.0 |
| C3 | 81.5 | 80.5 | 77.6 | 75.0 | 72.7 | 70.0 |
| D3 | 82.3 | 82.0 | 79.6 | 77.4 | 75.1 | 73.5 |

TABLE 10-continued

Work of Adhesion Between Photosensitive Member and Toner (W:mN/m)

| Photo-sensitive member | Toner a2 | b2 | c2 | d2 | e2 | f2 |
|---|---|---|---|---|---|---|
| E3 | 87.0 | 84.1 | 82.7 | 80.7 | 78.1 | 75.2 |
| F3 | 87.9 | 86.2 | 83.4 | 81.4 | 80.1 | 78.7 |
| G3 | 92.4 | 90.3 | 86.6 | 82.0 | 81.9 | 80.4 |
| H3 | 95.0 | 93.3 | 90.7 | 86.5 | 83.4 | 81.3 |
| I3 | 98.4 | 97.6 | 94.5 | 90.0 | 87.4 | 85.9 |
| J3 | 104.0 | 103.1 | 99.1 | 96.0 | 90.4 | 88.4 |

Each of the prepared photosensitive members was mounted in one of the image-forming apparatus depending on the outer diameter and evaluated for the characteristics as in Experiment 1. They showed a satisfactory result in terms of durability as shown in Table 11 and as in the case of Example 1 above. Moreover, the work of adhesion of each of the specimens of this example was found to have been shifted favorably if compared with Example 2 although the same toners were used. Additionally, the specimens of this example using an a-C:F surface layer was found to perform better than their counterparts of Example 2 using an a-C:H surface layer. The chippings of the blade due to the projections of the surface of the photosensitive member were found to have been reduced or eliminated.

TABLE 11

Durability Evaluation

| Photo-sensitive member | Toner a2 | b2 | c2 | d2 | e2 | f2 |
|---|---|---|---|---|---|---|
| A3 | ◎ | ◎ | ◎~○ | ○ | ○ | ○ |
| B3 | ◎ | ◎ | ◎ | ◎~○ | ○ | ○ |
| C3 | ◎ | ◎ | ◎ | ◎ | ◎~○ | ○ |
| D3 | ◎ | ◎ | ◎ | ◎ | ◎ | ◎~○ |
| E3 | ◎ | ◎ | ◎ | ◎ | ◎ | ◎ |
| F3 | ◎ | ◎ | ◎ | ◎ | ◎ | ◎ |
| G3 | ◎ | ◎ | ◎ | ◎ | ◎ | ◎ |
| H3 | ◎ | ◎ | ◎ | ◎ | ◎ | ◎ |
| I3 | ◎~○ | ◎~○ | ◎ | ◎ | ◎ | ◎ |
| J3 | ○ | ○ | ◎~○ | ◎ | ◎ | ◎ |

EXAMPLE 4

(OPC+1 component, 2-component toner)

An OPC (organic photosensitive member) comprises a substrate, a charge-generating layer and a carge-transporting layer. If necessary, a protective layer or a surface layer and an intermediary layer may additionally be provided.

The preparing condition of each of the OPC photosensitive member, more specifically that of the surface layer, the electrostatic layer, the intermediary layer, if provided, and particularly the surface layer were made to vary in this example.

The preparing condition was made to vary by regulating the work of adhesion W with emphasis on making no significant differentiation in terms of the electric characteristics including photosensitivity and the hardness.

While no surface coat layer (or surface protection layer) was used in this example, such a surface coat layer may be used if it does not adversely affect the effect of the present invention.

As in the preceding examples, specimens with outer diameters of ϕ30, 80 and 108 were prepared in this example.

The work of adhesion W of each of the combinations of the photosensitive members A4 through J4 of this example and toners a4 through f4 prepared as in the preceding examples except the mixing ratio of the outer additive and the composition ratio of the binder resin. The prepared photosensitive members were mounted in respective image-forming apparatus of the types as listed in Example 1 depending on the outer diameter and thousands to tens of thousands sheets of copy paper were used for the durability test in the environments described in Example 1 to evaluate the specimens. Tables 12 and 13 below show the obtained results.

TABLE 12

Work of Adhesion Between Photosensitive Member and Toner (W:mN/m)

| Photo-sensitive member | Toner a4 | b4 | c4 | d4 | e4 | f4 |
|---|---|---|---|---|---|---|
| A4 | 73.8 | 72.0 | 70.0 | 68.5 | 62.0 | 60.1 |
| B4 | 77.2 | 74.5 | 71.9 | 74.1 | 63.5 | 60.3 |
| C4 | 81.0 | 78.5 | 72.6 | 75.0 | 64.3 | 60.6 |
| D4 | 82.9 | 80.4 | 76.0 | 77.4 | 70.5 | 65.3 |
| E4 | 87.2 | 84.1 | 81.2 | 80.7 | 75.9 | 70.5 |
| F4 | 90.2 | 86.2 | 82.9 | 81.4 | 76.3 | 74.5 |
| G4 | 96.1 | 90.3 | 85.7 | 81.7 | 78.6 | 75.5 |
| H4 | 98.1 | 95.4 | 92.1 | 86.5 | 88.0 | 76.7 |
| I4 | 100.0 | 97.6 | 97.2 | 94.8 | 92.6 | 80.5 |
| J4 | 103.6 | 102.7 | 101.5 | 100.0 | 98.0 | 85.8 |

In this example, the specimens maintained the initial conditions in terms of cleaning feasibility and image quality. The rate of scraping the photosensitive member was also reduced to prove that the use of OPC can improve the service life.

No fusion of toner nor chipped blades were found.

TABLE 13

Durability Evaluation

| Photo-sensitive member | Toner a4 | b4 | c4 | d4 | e4 | f4 |
|---|---|---|---|---|---|---|
| A4 | ◎~○ | ◎~○ | ◎~○ | ○ | ○ | ○ |
| B4 | ◎ | ◎~○ | ◎~○ | ◎~○ | ○ | ○ |
| C4 | ◎ | ◎ | ◎~○ | ◎ | ○ | ○ |
| D4 | ◎ | ◎ | ◎ | ◎ | ◎~○ | ○ |
| E4 | ◎ | ◎ | ◎ | ◎ | ◎ | ◎~○ |
| F4 | ◎ | ◎ | ◎ | ◎ | ◎ | ◎~○ |
| G4 | ◎~○ | ◎ | ◎ | ◎ | ◎ | ◎ |
| H4 | ◎~○ | ◎ | ◎ | ◎ | ◎ | ◎ |
| I4 | ◎~○ | ◎~○ | ◎~○ | ◎ | ◎ | ◎ |
| J4 | ○ | ○ | ○ | ◎~○ | ◎~○ | ◎ |

EXAMPLE 5

(OPC/PTFE+1 component, 2-component toner)

Photosensitive members same as those used in Example 4 were used with an additional surface coat layer.

While any known surface coat layer may be used for the purpose of the invention, a fluorine-containing material such as polytetrafluoroethylene (PTFE, such as "Teflon" (tradename)) was used in this example.

The specimens of the photosensitive members were differentiated by using PTFE particles with different average particle diameters and different contents. As a result, it was found that the average particle diameter of fluorine type resin to be used for the purpose of the invention should be less than that of toner, preferably less than 3 μm, more preferably less than 1 μm, most preferably less than 0.5 μm from the viewpoint of image quality and surface hardness.

On the other hand, the content of fluorine type resin is preferably between 5 to 70 wt % relative to the entire weight of the surface coat layer from the viewpoint of correlation of the surface free energy γ, the work of adhesion W, the charge bearability and the surface durability.

While a photosensitive member having a surface not containing fluorine nor carrying a coat layer may operate equally well in terms of water-repellency and cleaning feasibility, a photosensitive member having a surface containing fluorine and/or carrying a coat layer is apt to show a value that tends to be found within an effective range for the work of adhesion W. Such a photosensitive member shows a surface that is highly convergent in terms of work of adhesion, highly smooth and very durable.

PTFE particles were made to be mixed with the material of the photosensitive members used in Example 4 to prepare photosensitive members A5 through J5.

The particle diameter of the PTFE particles used in those photosensitive members was within an appropriate range.

The photosensitive members A5 through J5 of this example and the toners as used in Example 4 were combined to observe the work of adhesion W of each of the combinations. The prepared photosensitive members were mounted in respective image-forming apparatus depending on the outer diameter and subjected to a durability test as in Example 1. Tables 14 and 15 show the obtained results.

TABLE 14

Work of Adhesion Between Photosensitive Member and Toner (W:mN/m)

| Photo-sensitive member | Toner a4 | b4 | c4 | d4 | e4 | f4 |
|---|---|---|---|---|---|---|
| A5 | 75.8 | 73.7 | 71.2 | 70.2 | 62.8 | 62.2 |
| B5 | 77.5 | 76.1 | 72.9 | 74.9 | 65.0 | 63.4 |
| C5 | 80.1 | 79.0 | 75.9 | 75.2 | 68.7 | 65.1 |
| D5 | 82.7 | 82.1 | 76.7 | 76.1 | 72.6 | 68.1 |
| E5 | 85.6 | 85.7 | 82.0 | 79.7 | 76.5 | 72.7 |
| F5 | 89.4 | 87.1 | 83.6 | 82.1 | 78.0 | 75.4 |
| G5 | 92.7 | 90.0 | 85.0 | 83.7 | 78.7 | 75.8 |
| H5 | 96.8 | 94.6 | 90.4 | 85.6 | 87.5 | 77.5 |
| I5 | 97.0 | 96.7 | 96.1 | 93.1 | 91.2 | 79.5 |
| J5 | 100.4 | 99.4 | 97.8 | 97.0 | 96.1 | 85.4 |

The work of adhesion of each of the specimens of this example was found to have been shifted favorably if compared with Example 4 although the same toners were used.

As a result of a durability test, the specimens of this example comprising a fluorine-containing surface layer operated better than the counterparts of Example 4 that did not comprise such a surface layer particularly in terms of abnormal noise, i.e., so-called "creake", that can be produced by the cleaning blade due to the friction between the blade and the photosensitive member if the operating speed and the environment were made to vary. No chipped blade was found as in Example 4.

TABLE 15

Durability Evaluation

| Photo-sensitive member | Toner a4 | b4 | c4 | d4 | e4 | f4 |
|---|---|---|---|---|---|---|
| A5 | ◎ | ◎~○ | ◎~○ | ◎~○ | ○ | ○ |
| B5 | ◎ | ◎ | ◎~○ | ◎ | ○ | ○ |
| C5 | ◎ | ◎ | ◎ | ◎ | ○ | ○ |
| D5 | ◎ | ◎ | ◎ | ◎ | ◎~○ | ○ |
| E5 | ◎ | ◎ | ◎ | ◎ | ◎ | ◎~○ |
| F5 | ◎ | ◎ | ◎ | ◎ | ◎ | ◎ |
| G5 | ◎ | ◎ | ◎ | ◎ | ◎ | ◎ |
| H5 | ◎~○ | ◎ | ◎ | ◎ | ◎ | ◎ |
| I5 | ◎~○ | ◎~○ | ◎~○ | ◎ | ◎ | ◎ |
| J5 | ○ | ◎~○ | ◎~○ | ◎~○ | ◎~○ | ◎ |

While the surface of the photosensitive members was made to contain fluorine in an dispersed state in this example, the photosensitive members may alternatively be made to have a surface layer realized by coating the surface with a fluorine-containing composition.

As for coating the surface, the produced coat preferably contain fluorine in an appropriately dispersed state to control the charge bearability and the photosensivity. When the surface is coated with fluorine type resin powder, the fluorine content may be selected by taking the uniformity of electrostatic charge and the quality of image.

Thus, fluorine resin may be contained in a dispersed state in the surface of a photosensitive member and/or a fluorine-containing coat may be formed on the surface for the purpose of the invention.

Now, comparative examples will be described below.

COMPARATIVE EXAMPLE (photosensitive members and toners departing from the above specifications)

As in Example 1, a-Si photosensitive members I through X were prepared by varying the discharge power, the mixing ratio of the source gases particularly during the step of forming the surface layer. Toners i through vi were also prepared in a manner as described by referring to the above examples except the mixing ratio of the outer additive and that of the binder resin. Then, the work of adhesion (W [mN/m]) of each of the combinations was evaluated. Table 16 below shows the results.

TABLE 16

Work of Adhesion Between Photosensitive Member and Toner (W:mN/m)

| Photo-sensitive member | Toner i | ii | iii | iv | v | vi |
|---|---|---|---|---|---|---|
| I | 119.8 | 118.8 | 117.1 | 115.5 | 111.9 | 110.5 |
| II | 120.1 | 119.5 | 119.2 | 116.1 | 115.7 | 111.9 |
| III | 121.8 | 120.5 | 119.6 | 115.8 | 116.4 | 114.2 |
| IV | 122.9 | 121.4 | 120.5 | 116.7 | 117.2 | 115.7 |
| V | 124.0 | 122.7 | 122.8 | 117.3 | 118.2 | 116.0 |
| VI | 124.7 | 123.5 | 123.7 | 118.0 | 119.1 | 117.9 |
| VII | 125.1 | 123.7 | 122.5 | 120.6 | 120.2 | 118.2 |
| VIII | 125.8 | 124.9 | 123.6 | 122.1 | 121.3 | 119.8 |
| IX | 127.4 | 126.0 | 124.8 | 123.5 | 121.9 | 120.7 |
| X | 128.6 | 127.4 | 126.1 | 125.0 | 123.6 | 122.8 |

Table 17 shows the results obtained by a durability test.

TABLE 17

Durability Evaluation

| Photo-sensitive member | Toner i | ii | iii | iv | v | vi |
|---|---|---|---|---|---|---|
| I | ● | ● | ● | ● | ● | ●~○ |
| II | ● | ● | ● | ● | ● | ● |
| III | ● | ● | ● | ● | ● | ● |
| IV | ● | ● | ● | ● | ● | ● |
| V | ● | ● | ● | ● | ● | ● |
| VI | ● | ● | ● | ● | ● | ● |
| VII | ● | ● | ● | ● | ● | ● |
| VIII | ● | ● | ● | ● | ● | ● |
| IX | ● | ● | ● | ● | ● | ● |
| X | ● | ● | ● | ● | ● | ● |

In this comparative example where the work of adhesion (W) exceeded 110 mN/m, toners were very often fused to produce chipped cleaning blades and other defective cleaning blades.

COMPARATIVE EXAMPLE 2

As in Example 4, OPCs (organic photosensitive members) I' through X' were prepared by varying the resin composition ratios and the production temperature. Toners i' through vi' were also prepared as in Example 4 by using varying the resin composition ratios and the production temperature as well as the rate of adding the outer additive.

Then, the work of adhesion (W [mN/m]) of each of the combinations of OPCs I' through X' and toners i' through vi' was evaluated. Table 18 below shows the results.

TABLE 18

Work of Adhesion Between Photosensitive Member and Toner (W:mN/m)

| Photo-sensitive member | Toner i' | ii' | iii' | iv' | v' | vi' |
|---|---|---|---|---|---|---|
| I' | 50.8 | 49.8 | 49.2 | 49.0 | 47.6 | 47.5 |
| II' | 51.1 | 50.5 | 50.0 | 49.5 | 48.0 | 47.7 |
| III' | 52.0 | 51.4 | 50.9 | 49.8 | 48.5 | 48.0 |
| IV' | 52.6 | 51.9 | 51.3 | 50.4 | 48.7 | 48.2 |
| V' | 53.8 | 53.2 | 52.0 | 51.9 | 51.0 | 49.7 |
| VI' | 55.1 | 54.0 | 52.7 | 52.2 | 51.7 | 50.6 |
| VII' | 56.7 | 55.1 | 53.7 | 52.5 | 52.8 | 51.2 |
| VIII' | 57.4 | 56.0 | 54.9 | 54.1 | 53.3 | 52.4 |
| IX' | 59.2 | 57.4 | 55.9 | 55.3 | 54.2 | 53.6 |
| X' | 59.6 | 59.1 | 57.1 | 56.4 | 55.7 | 55.1 |

Table 19 shows the results obtained by a durability test.

TABLE 19

Durability Evaluation

| Photo-sensitive member | Toner i' | ii' | iii' | iv' | v' | vi' |
|---|---|---|---|---|---|---|
| I' | ● | ● | ● | ● | ● | ●~○ |
| II' | ● | ● | ● | ● | ● | ● |
| III' | ● | ● | ● | ● | ● | ● |
| IV' | ● | ● | ● | ● | ● | ● |
| V' | ● | ● | ● | ● | ● | ● |
| VI' | ● | ● | ● | ● | ● | ● |
| VII' | ● | ● | ● | ● | ● | ● |

TABLE 19-continued

| Photo-sensitive member | Durability Evaluation | | | | | |
|---|---|---|---|---|---|---|
| | Toner | | | | | |
| | i' | ii' | iii' | iv' | v' | vi' |
| VIII' | ● | ● | ● | ● | ● | ● |
| IX' | ● | ● | ● | ● | ● | ● |
| X' | ● | ● | ● | ● | ● | ● |

Since the work of adhesion (W) was held to less than 60 mN/m in this comparative example, no fusion of toner nor chipped cleaning blade due to such fusion or projections on the surface of the photosensitive member occurred.

On the other hand, however, the amount of toner at the site of abutment of the cleaning blade and the surface of the photosensitive member was reduced during the durability test to give rise to a burred cleaning blade that produced abnormal noise and a filming phenomenon. Thus, the specimens showed a narrowed latitude to such problems.

Additionally, the photosensitive member was apt to be scrubbed unevenly to produce locally smeared images.

Figure 17:
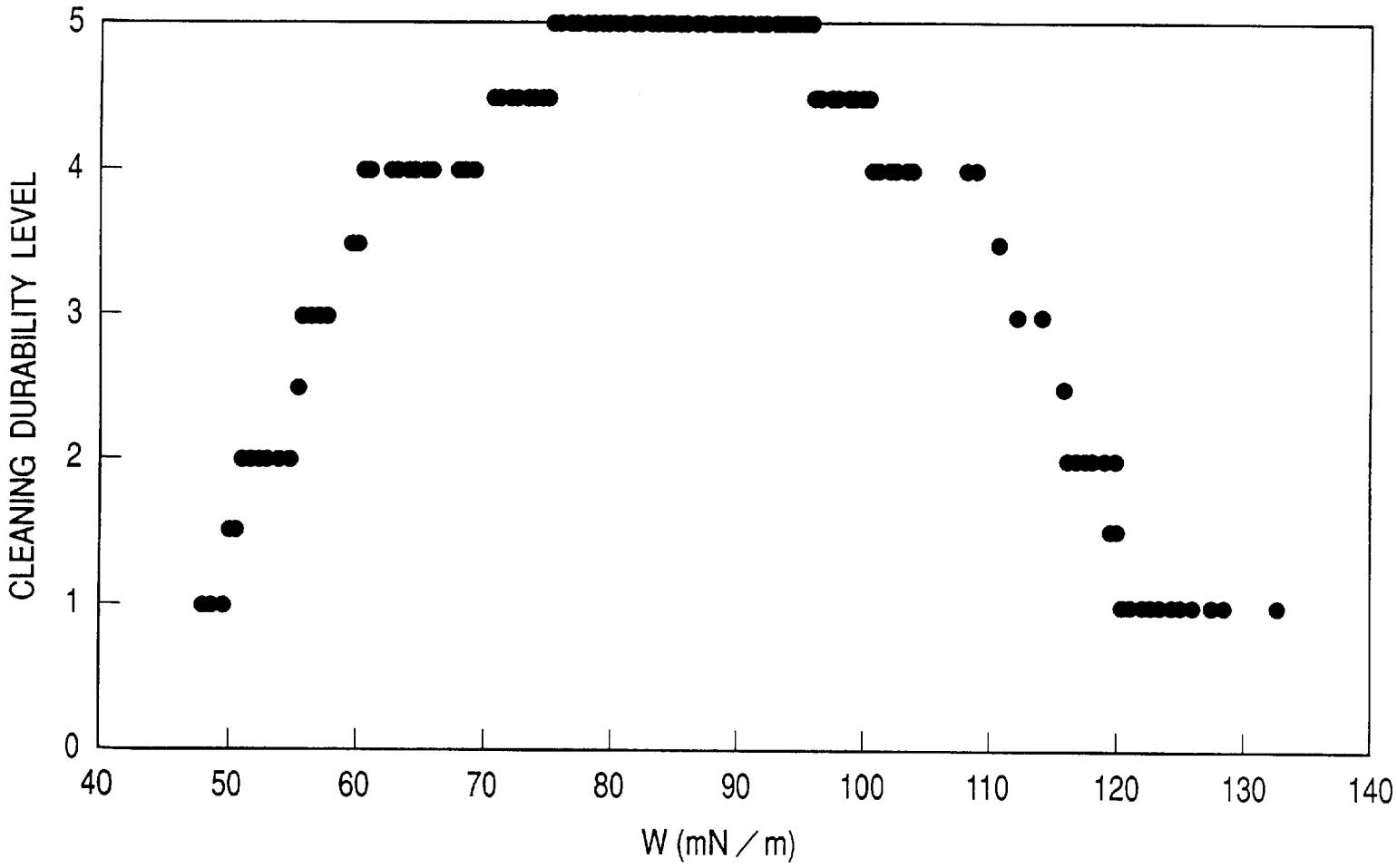
FIG. 17 is a graph illustrating the relationship between the work of adhesion and the cleaning feasibility in a prolonged use.
Figure 18:
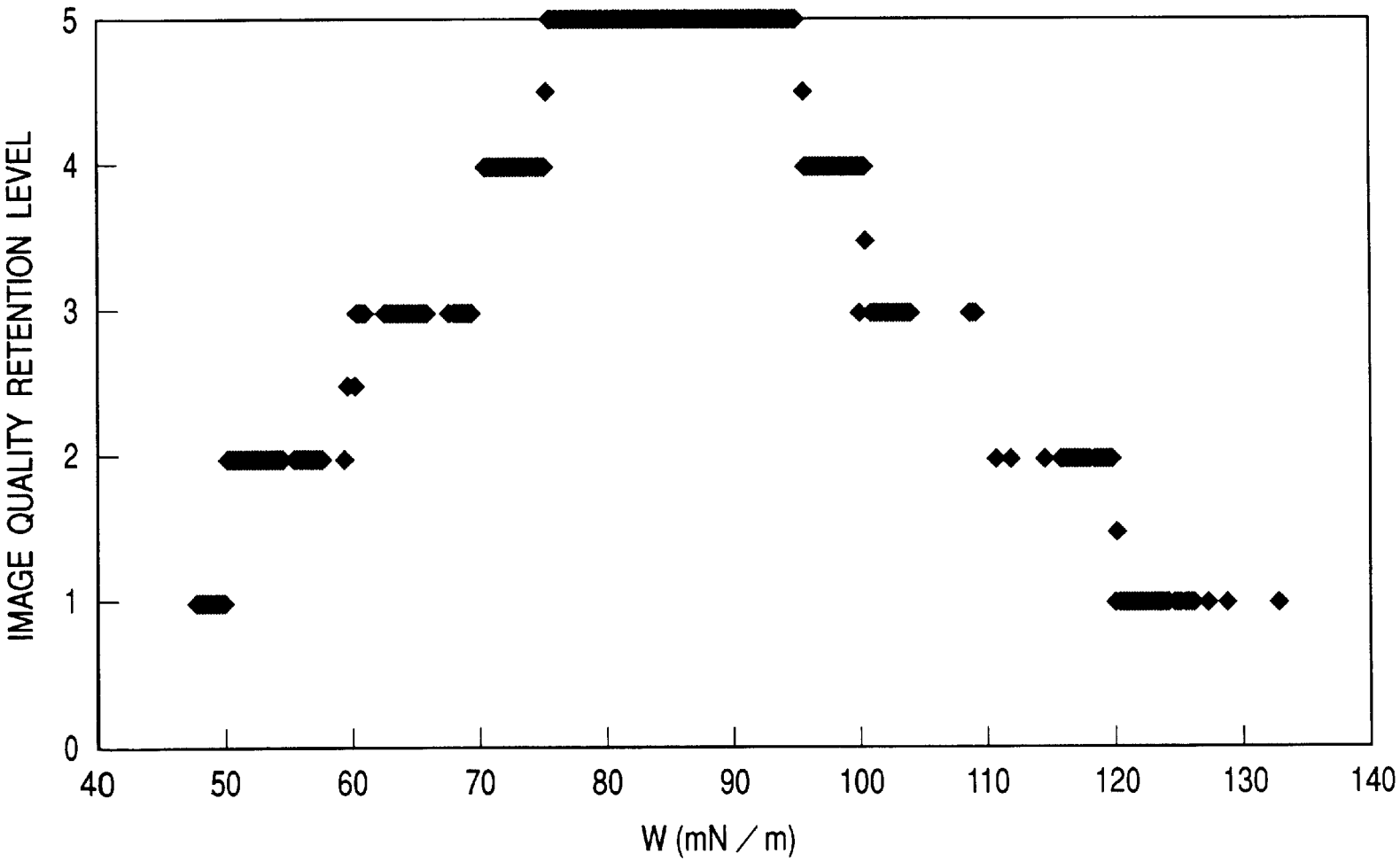
FIG. 18 is a graph illustrating the relationship between the work of adhesion and the image quality in a prolonged use.

The cleaning feasibility of the specimens of the above examples and comparative examples was also evaluated as in Experiments. FIGS. 17 and 18 respectively show the relationship between the work of adhesion and the cleaning feasibility and the relationship between the work of adhesion and the image quality. As seen from FIGS. 17 and 18, in addition of the above results, the work of adhesion is preferably between 60 and 110 mN/m, more preferably between 75 and 95 mN/m for the purpose of the invention.

As described above in detail, the present invention can effectively dissolve the above pointed out problems of electrophotography apparatus particularly those of digital electrophotography apparatus.

Specifically:

1. The load of cleaning necessary for separating the photosensensitive member and the foreign objects including toner on the surface of the photosensitive member can be reduced by confining the work of adhesion (W), or the adhesivity, between the surface of a photosensitive member and toner, which represents the wetting effect of the surface with the foreign objects.

2. As the load of the photosensitive member is reduced, the service life of the photosensitive member is prolonged particularly in the case of an OPC or a photosensitive member carrying a surface coat of thin film.

3. As the load of the cleaning unit including the cleaning blade is reduced, the regular maintenance service of the cleaning blade can be conducted with extended intervals. This effect is particularly advantageous to reduce the labor cost and the cartridge cost and also to reduce the size of the cleaning unit and hence the image-forming apparatus itself.

4. The motor for driving the photosensitive member can be down-sized with the benefit of energy saving.

5. A good image quality can be realized to broaden the latitude for fusion by using a photosensitive member showing good temperature characteristics without the use of drum heater. Thus, the use of a photosensitive member without a drum heater provides the benefit of energy saving.

Additionally, an unexpected effect of reducing the rate of production of waste toner was obtained.

This may be because the reduction in the wetting effect of the photosensitive member reduced the residual toner. Thus, the cartridge and other components may be further downsized.

The present invention is not limited to the above examples, which may be modified without departing from the scope of the invention.

What is claimed is:

1. A photosensitive member to be used for an image-forming apparatus that is adapted to repeatedly form an image by following an image-forming process comprising steps of:

forming a latent image by electrostatically charging the photosensitive member and exposing it to light;

forming a toner image;

transferring the toner image onto copy paper; and cleaning the surface of the photosensitive member by removing adherers thereon;

the wettability (W) of the surface of the photosensitive member relative to the adherers being between 60 and 110 mN/m.

2. A photosensitive member to be used for an image-forming apparatus according to claim 1, wherein said adherers are the toner supplied for the image-forming operation of the apparatus.

3. A photosensitive member to be used for an image-forming apparatus according to claim 1, wherein the value of said W is between 75 and 95 mN/m.

4. A photosensitive member to be used for an image-forming apparatus according to claim 1, wherein the value of said W is obtained from the surface free energy (γ) obtained on the basis of the Forkes's theory.

5. A photosensitive member to be used for an image-forming apparatus according to claim 1, comprising:

(a) an electroconductive substrate; and (b) an light-receiving layer made of an amorphous material containing silicon as parent substance and hydrogen and/or halogen;

the resistivity of the uppermost surface thereof being between $1\times10^{10}$ and $5\times15^{15}$ Ωcm.

6. A photosensitive member to be used for an image-forming apparatus according to claim 5, wherein said light-receiving layer has at least a surface region principally made of amorphous silicon carbide.

7. A photosensitive member to be used for an image-forming apparatus according to claim 5, wherein said light-receiving layer has at least a surface region principally made of amorphous carbon.

8. A photosensitive member to be used for an image-forming apparatus according to claim 7, wherein said amorphous carbon contains fluorine.

9. A photosensitive member to be used for an image-forming apparatus according to claim 7, wherein carbon atoms of said amorphous carbon are bonded to fluorine atoms.

10. A photosensitive member to be used for an image-forming apparatus according to claim 1, wherein said photosensitive member has a photoconductive layer principally made of an organic photosensitive material.

11. A photosensitive member to be used for an image-forming apparatus according to claim 10, wherein said photoconductive layer has a surface region containing fluorine.

12. An image-forming apparatus comprising:

a photosensitive member;

a latent image forming means for forming a latent image by electrostatically charging the photosensitive member and exposing it to light;

a toner image forming means for forming a toner image by applying toner to the latent image; and a cleaning means for removing any unnecessary toner from the surface of the photosensitive member;

the wettability (W) of the surface of the photosensitive member relative to the toner being between 60 and 110 mN/m.

13. An image-forming apparatus according to claim 12, wherein the value of said W is between 75 and 95 mN/m.

14. An image-forming apparatus according to claim 12, wherein the value of said W is obtained from the surface free energy (γ) obtained on the basis of the Forkes's theory.

15. An image-forming method comprising steps of:

electrostatically charging a photosensitive member and exposing it to light to form a latent image; and forming a toner image; and removing any unnecessary toner from the surface of the photosensitive member;

the wettability (W) of the surface of the photosensitive member relative to the toner being between 60 and 110 mN/m.

16. An image-forming method according to claim 15, wherein the value of said W is between 75 and 95 mN/m.

17. An image-forming method according to claim 15, wherein the value of said W is obtained from the surface free energy (γ) obtained on the basis of the Forkes's theory.

* * * * *

UNITED STATES PATENT AND TRADEMARK OFFICE

CERTIFICATE OF CORRECTION

PATENT NO. : 6,108,502
DATED : August 22, 2000
INVENTOR(S) : Masaya Kawada et al.

It is certified that error appears in the above-identified patent and that said Letters Patent is hereby corrected as shown below:

Column 1,
Line 45, "appratus" should read -- apparatus --.

Column 3,
Line 35, "an desired" should read -- a desired --.

Column 5,
Line 32, "requirement" should read -- requirements -- and "of" (2d occurrence) should read -- of a --; and
Line 36, "prolong" should read -- prolonged --.

Column 7,
Line 67, "are" should read -- are, -- and "example" should read --example, --.

Column 10,
Line 59, "as its is" should read -- is --.

Column 12,
Line 37, "is scrubbed"should read -- are scrubbed --.

Column 13,
Line 30, "stand still," should read -- standstill, --.

Column 14,
Line 1, "avobe," should read -- above, --.

Column 15,
Line 22, "bond=adhesion." should read -- bond=adhesion). --;
Line 31, "bond." should read -- bond). --; and
Line 60, "an" should read -- a --.

Column 17,
Line 44, "contact" should read -- contracts --.

Column 19,
Line 5, "member. A.Si" should read -- member. ¶ A-Si --; and
Line 49, "monocystalline" should read -- monocrystalline --.

UNITED STATES PATENT AND TRADEMARK OFFICE

CERTIFICATE OF CORRECTION

PATENT NO. : 6,108,502
DATED : August 22, 2000
INVENTOR(S) : Masaya Kawada et al.

It is certified that error appears in the above-identified patent and that said Letters Patent is hereby corrected as shown below:

Column 20,
Line 15, "Substrte" should read -- Substrate --;
Line 62, "typicality" should read -- typically --; and
Line 66, "invention" should read -- this invention --.

Column 21,
Line 57, "includes" should read -- include --.

Column 23,
Line 54, "expected to" should read -- expected of --.

Column 24,
Line 58, "principle" should read -- principal --.

Column 25,
Line 11, "used" should read -- uses --; and
Line 20, "abnormally" should read -- abnormal --.

Column 26,
Line 40, "be" should read -- are --.

Column 27,
Line 15, ""Fr-PCVD)," should read -- "Rf-PCVD"). --;
Line 26, "sources" should read -- source --;
Line 37, ""VHf-PCVD)" should read -- "VHf-PCVD"). --; and
Line 53, "sources" should read -- source --.

Column 28,
Line 16, "PTfE)" should read -- "PTFE") --;
Line 27, "of a" should read -- of an --;
Line 43, "etheyleneglycol," should read -- ethylenegylcol, --;
Line 56, "0.65 dlg" should read -- 0.65 dl/g --; and
Line 64, "terephtalic" should read -- terephthalic --.

Column 29,
Line 9, "naphthalanedicarboxylic" should read -- naphthalenedicarboxlic --; and
Line 51, "into a" should read -- is put into a --.

UNITED STATES PATENT AND TRADEMARK OFFICE

CERTIFICATE OF CORRECTION

PATENT NO. : 6,108,502
DATED : August 22, 2000
INVENTOR(S) : Masaya Kawada et al.

It is certified that error appears in the above-identified patent and that said Letters Patent is hereby corrected as shown below:

Column 32,
Line 21, "means the" should read -- means of the --;
Lines 49, 51, 53, and 56, "to environment" should read -- to as environment --.

Column 33,
Lines 23, and 30, "thousands" should read -- fifty thousand --.

Column 35,
Line 66, "and White" should read -- and ¶White --.

Column 36,
Line 4, "be every" should read -- after an --; and
Line 9, "Coning)" should read -- Corning --.

Column 38,
Line 8, "Coning)" should read -- Corning --;
Line 20, "an obtained" should read -- and obtained --; and
Line 56, "diameter" should read -- diameters --.

Column 39,
Table 3 should read:

TABLE 3

--

| | D.O.S [$cm^{-3}$] | Eu [meV] | Surface resistivity [Ω•cm] | Surface Rz [μm] | γ DRUM [mN/m] |
|---|---|---|---|---|---|
| A1 | $4 \times 10^{15}$ | 53 | $5.0 \times 10^{10}$ | 0.12 | 40.3 |
| B1 | $4 \times 10^{15}$ | 53 | $3.1 \times 10^{11}$ | 0.24 | 42.8 |
| C1 | $4 \times 10^{15}$ | 53 | $1.5 \times 10^{12}$ | 0.21 | 53.0 |
| D1 | $4 \times 10^{15}$ | 53 | $7.8 \times 10^{12}$ | 0.46 | 46.1 |
| E1 | $4 \times 10^{15}$ | 53 | $1.3 \times 10^{13}$ | 0.34 | 56.3 |
| F1 | $4 \times 10^{15}$ | 53 | $5.1 \times 10^{13}$ | 0.10 | 43.3 |
| G1 | $4 \times 10^{15}$ | 53 | $8.8 \times 10^{13}$ | 0.40 | 60.0 |
| H1 | $4 \times 10^{15}$ | 53 | $1.4 \times 10^{14}$ | 0.35 | 58.2 |
| I1 | $4 \times 10^{15}$ | 53 | $9.8 \times 10^{14}$ | 0.28 | 47.5 |
| J1 | $4 \times 10^{15}$ | 53 | $3.1 \times 10^{15}$ | 0.30 | 43.9 |

--

UNITED STATES PATENT AND TRADEMARK OFFICE

CERTIFICATE OF CORRECTION

PATENT NO. : 6,108,502
DATED : August 22, 2000
INVENTOR(S) : Masaya Kawada et al.

It is certified that error appears in the above-identified patent and that said Letters Patent is hereby corrected as shown below:

Column 40,
Line 13, "obtained" should read -- obtain --; and
Line 39, "remain" should read -- remainder --.

Column 42,
Line 10, "Elbow" should read -- (Elbow --; and
Line 62, "above described" should read -- above-described --.

Column 43,
Line 63, "above described" should read -- above-described --.

Column 45,
Line 24, "above described" should read -- above-described --.

Column 46,
Line 51, "carge-transporting" should read -- cargo-transporting --.

Column 49,
Line 26, "contain" should read -- contains --.

Column 50,
Line 28, "using" should be deleted.

Column 52,
Line 32, "an light-" should read -- a light- --; and
Line 36, "Ωcm." should read -- Ω•cm. --.

Signed and Sealed this

Fifth Day of February, 2002

*Attest:*

*Attesting Officer*

JAMES E. ROGAN
*Director of the United States Patent and Trademark Office*